US005493377A

United States Patent [19]

Nishikawa et al.

[11] Patent Number: 5,493,377

[45] Date of Patent: Feb. 20, 1996

[54] CONTINUOUS FORM PRINTER

[75] Inventors: Tomoyuki Nishikawa; Tsutomu Sato; Tsukasa Yanashima, all of Tokyo, Japan

[73] Assignee: Asahi Kogaku Kogyo Kabushiki Kaisha, Tokyo, Japan

[21] Appl. No.: 341,967

[22] Filed: Nov. 14, 1994

[30] Foreign Application Priority Data

Nov. 13, 1993 [JP] Japan ..... 5-307247

[51] Int. Cl.[6] ..... G03G 15/20; G03G 21/00

[52] U.S. Cl. ..... 355/285; 355/309; 355/290

[58] Field of Search ..... 355/285, 286, 355/308, 282, 290, 309, 310, 316

[56] References Cited

U.S. PATENT DOCUMENTS

| | | | |
|---|---|---|---|
| 4,963,941 | 10/1990 | Negishi et al. | 355/282 |
| 4,998,835 | 3/1991 | Negishi et al. | 400/611 |
| 5,023,667 | 6/1991 | Negoro et al. | 355/274 |
| 5,170,215 | 12/1992 | Pfeuffer | 355/285 |
| 5,194,903 | 3/1993 | Negishi et al. | 355/316 |
| 5,371,571 | 12/1994 | Asanae | 355/285 X |
| 5,425,694 | 6/1995 | Negishi | 493/320 |

*Primary Examiner*—R. L. Moses
*Attorney, Agent, or Firm*—Sandler, Greenblum & Bernstein

[57] ABSTRACT

An electrophotographic printer includes a fixing unit having a movable pressure roller, movable toward and away from a heat roller. The heat roller of the fixing unit is above a plane formed between a pair of discharge rollers and a tractor, so that the paper path between the tractor and the discharge rollers is straight when the pressure roller is retracted, and the paper path is bent when the pressure roller is moved to contact the heat roller. The paper path is bent by a guide member upstream of the pressure roller so that the path is not bent around the pressure roller itself.

17 Claims, 53 Drawing Sheets

PRINT STARTING OPERATION

CONTINUOUS PRINTING OPERATION

PRINT START OPERATION

PRINT STOP OPERATION

CONTINUOUS FORM PRINTER

BACKGROUND OF THE INVENTION

The present invention relates to continuous form electrophotographic printers, and more specifically to a structure and control method for a fixing unit for fixing toner images to continuous form paper.

Conventionally, continuous form electrophotographic printers have some method of separating a fixing heat roller from the continuous form paper when a fixing operation is idle, so that the paper will not become deformed or scorched. It is known to lower a pressure roller away from a heat roller where the heat roller is positioned above the paper path, so that the paper will follow the pressure roller down and away from the heat roller.

However, if the apparatus for separating the pressure roller is arranged so that the paper path bends at the contact point between the pressure and heat rollers, inconsistent fixing and poor speed control can result. Furthermore, if the paper is not driven during the separation phase, the paper tends to stick to the heat roller by the adhesive properties of melted toner.

For these reasons there exists a need for an electrophotographic printer able to separate a toner-bearing page from a heat roller reliably and effectively, and without bending the paper path at the fixing interface.

SUMMARY OF THE INVENTION

It is therefore an object of the invention to provide an electrophotographic printer able to separate a toner-bearing page from a heat roller reliably and effectively, and without bending the paper path at the fixing interface.

According to one aspect of the present invention, an electrophotographic printer using continuous form paper includes a controller, at least one tractor for feeding the paper along a paper path of the printer, a driving unit, a heat roller rotatably mounted and driven by the driving unit, the heat roller being downstream along the paper path from the at least one tractor, a pressure roller freely rotatably mounted and placed adjacent to the heat roller, the pressure roller movable between a contact position in contact with the heat roller and a retracted position remote from the heat roller, the pressure roller being downstream along the paper path from the at least one tractor, and the paper path passing between the heat roller and the pressure roller, shifting device for moving the pressure roller between the contact position and the retracted position, and a pair of discharge rollers provided downstream along the paper path from the pressure roller, the discharge rollers able to feed the paper, at least one of the discharge rollers driven by the driving unit, wherein the paper path is substantially straight between the at least one tractor and the discharge rollers when the pressure roller is in the retracted position, and wherein a bend in the paper path is formed when the pressure roller is in the contact position, and a region of contact between the pressure roller and the heat roller is position between the bend and the discharge rollers when the pressure roller is in the contact position. Preferably, the controller controls the discharge rollers to feed the paper when the pressure roller is between the contact position and the retracted position. Further preferably, the electrophotographic printer further includes a guide unit, synchronized with the movement of the pressure roller. In this case, the guide unit is moved into the paper path, and the bend in the paper path is formed at the guide means, when the pressure roller is in the contact position.

The guide means is removed from the paper path when the pressure roller is in the retracted position, so that the paper path becomes straight between the tractor and the discharge rollers.

Yet further preferably, the paper path is straight between the guide means and the discharge rollers; a line joining the axes of the discharge rollers is perpendicular to the paper path; and a line joining the axis of the pressure roller and the heat roller is perpendicular to the paper path, when the pressure roller is in the contact position and the bend is formed at the guide means.

DETAILED DESCRIPTION OF THE PREFERRED EMBODIMENTS

With reference to the drawings, an embodiment of the present invention is described.

Figure 1:
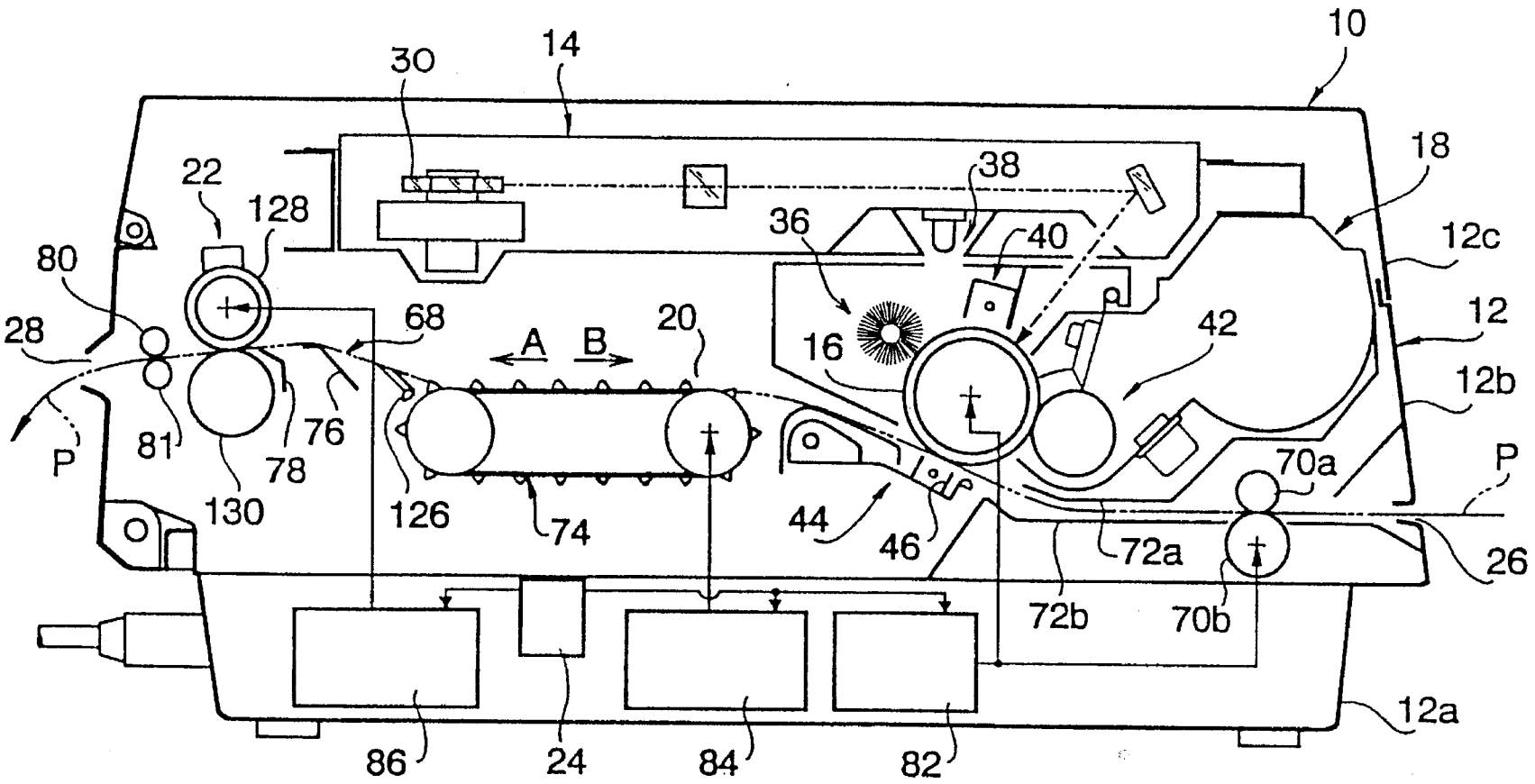
FIG. 1 is a schematic of a continuous form electrophotographic printer embodying the present invention.

The continuous form printer 10 embodying the invention is preferably an electrophotographic printer, and uses conventional fanfold paper P, as shown in FIG. 1. The fanfold paper P has feeding holes Pa at a predetermined pitch (the distance between holes Pa) on either lateral side of the paper P. Furthermore, the conventional fanfold paper P has separation perforations Pb, at an interval corresponding to one of several standard sheet sizes, in order that individual sheets of the fanfold paper P may be easily separated at page intervals. The continuous form printer 10 according to the invention may use either normal paper or label paper bearing stick-on labels at known lateral and lengthwise intervals.

The printer 10 is conventionally controlled with the following features: (i) after a last page is printed, the paper P is fed outside the printer body to be easily viewed or separated, (ii) when printing is restarted, the paper P is retracted into the printer to print on a leading blank sheet, and (iii) when initially set, the printer 10 begins printing on the second page (sheet) of the paper P.

The printer 10 includes a base 12*a*, a housing 12, a developing unit 18, a laser scanning unit 14, a transfer unit 44, a sheet feeding system 20, and a fixing unit 22. The housing 12 is divided into lower and upper portions 12*b*, and 12*c* respectively, the upper housing 12*c* having a support frame (not shown) for supporting elements of the printer 10. The base 12*a* houses a controller 24, fixing unit motor 86, tractor motor 84, and main motor 82. The fixing unit 22 and the sheet feeding system 20 are mounted in the lower housing 12*b*. A paper inlet 26 and a paper outlet 28 are provided on opposite sides of the lower housing 12*b*.

The upper housing 12*c*, including the support frame, is swingably supported relative to the lower housing 12*b* by a conventional pivot assembly, and can be swung away from the lower housing 12*b* to allow access to the interior of the printer 10. The scanning unit 14 is housed and mounted to the support frame within the upper housing 12*c*. The scanning unit 14 comprises a polygonal mirror assembly 30, and is otherwise a conventional laser scanning unit as used in electrophotographic printers. The scanning unit 14 is controlled by the controller 24 to generate a latent image on the photoconductive drum 16, scanning a laser beam along the length of the drum 16 while the drum 16 is rotated to generate the latent image on the surface of the drum 16.

A processing unit 18 includes a developing unit 42 (including a developing roller) for applying toner to a latent image formed on the drum 16 by the laser scanning unit 24, and a toner reservoir, and the processing unit 18 is supported by the support frame of the upper housing 12*c*. The support frame of the upper housing 12*c* further supports a rotatably mounted photoconductive drum 16, a toner cleaning brush 36 for removing toner remaining on the photoconductive surface of the drum 16, a discharging unit 38 for removing a charge on the photoconductive drum 16, a charging unit 40 for uniformly charging the photoconductive surface of the drum 16, all of which may be swung up and away from the lower housing 12*b* and the paper path 68 with the upper housing 12*c*. A transfer unit 44 for transferring a toner image on the drum 16 onto the fan-fold sheet P is disposed on the opposite side of the paper path 68 from the drum 16.

The image formation process uses each of the described elements 16, 36, 38, 40, 42, and 44, for forming images on the continuous sheet P.

Figure 2:
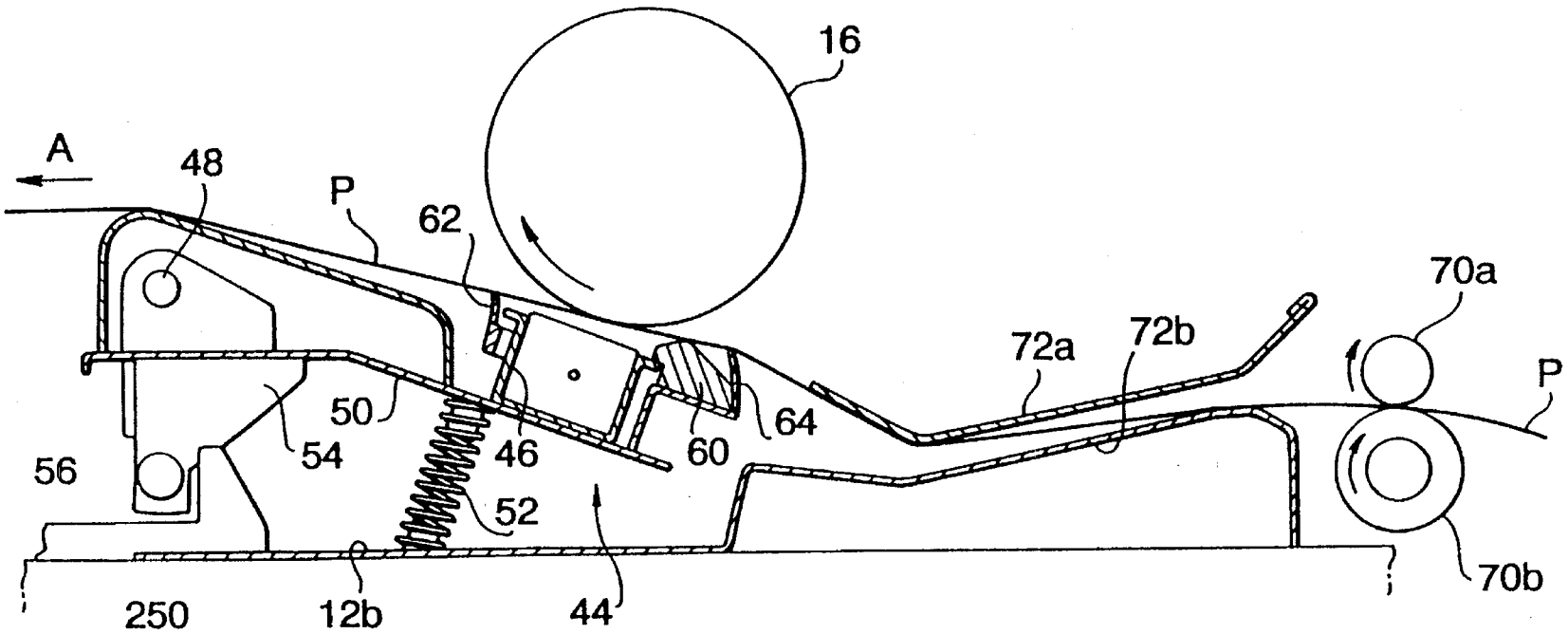
FIG. 2 is a side view of a transfer unit of the continuous form printer, showing an operating position.

As shown in FIG. 2, the transfer unit 44, including a corona charger 46 and support arm 50, is swingable about axis 48 and biased towards the drum 16 by a spring 52. The spring 52 is supported by the main chassis 12*d*. The swinging of the transfer unit 44 towards the drum 16 is limited by a stopper member (not shown). The support arm 50 further includes a lever 54 and pin 56, displaced from the axis 48.

The transfer unit 44 is swung away from the drum 16 (FIG. 3) by a transfer unit retractor 250 operating on the pin 56. A discharge brush 62 is mounted to the transfer unit 44 downstream of the corona charger 46.

A. Paper Feed System

The paper feed system 20 is arranged along a paper path 68 extending from the inlet 26 to the outlet 28. The feed system 20, as shown in FIG. 1, includes: back tension rollers 70*a* and 70*b* for providing back tension to the paper P; guide plates 72*a* and 72*b* for guiding the paper P to a printing position; a tractor unit 74 for feeding the paper P in forward (A) and reverse (B) directions; a tension sensor 76 for measuring the tension of the paper P; a guide plate 78 for displacing the paper P and changing the paper path 68; the fixing unit 22; and discharge rollers 80 and 81 for discharging the paper P, arranged in order along the paper path 68 from the inlet 26 to the outlet 28. The controller 24 controls the main motor 82 to drive the processing unit 18, the tractor motor 84 to feed the paper P, and the fixing unit motor 86 for driving both the fixing unit 22 rollers and the lower discharge roller 81.

Figure 6:
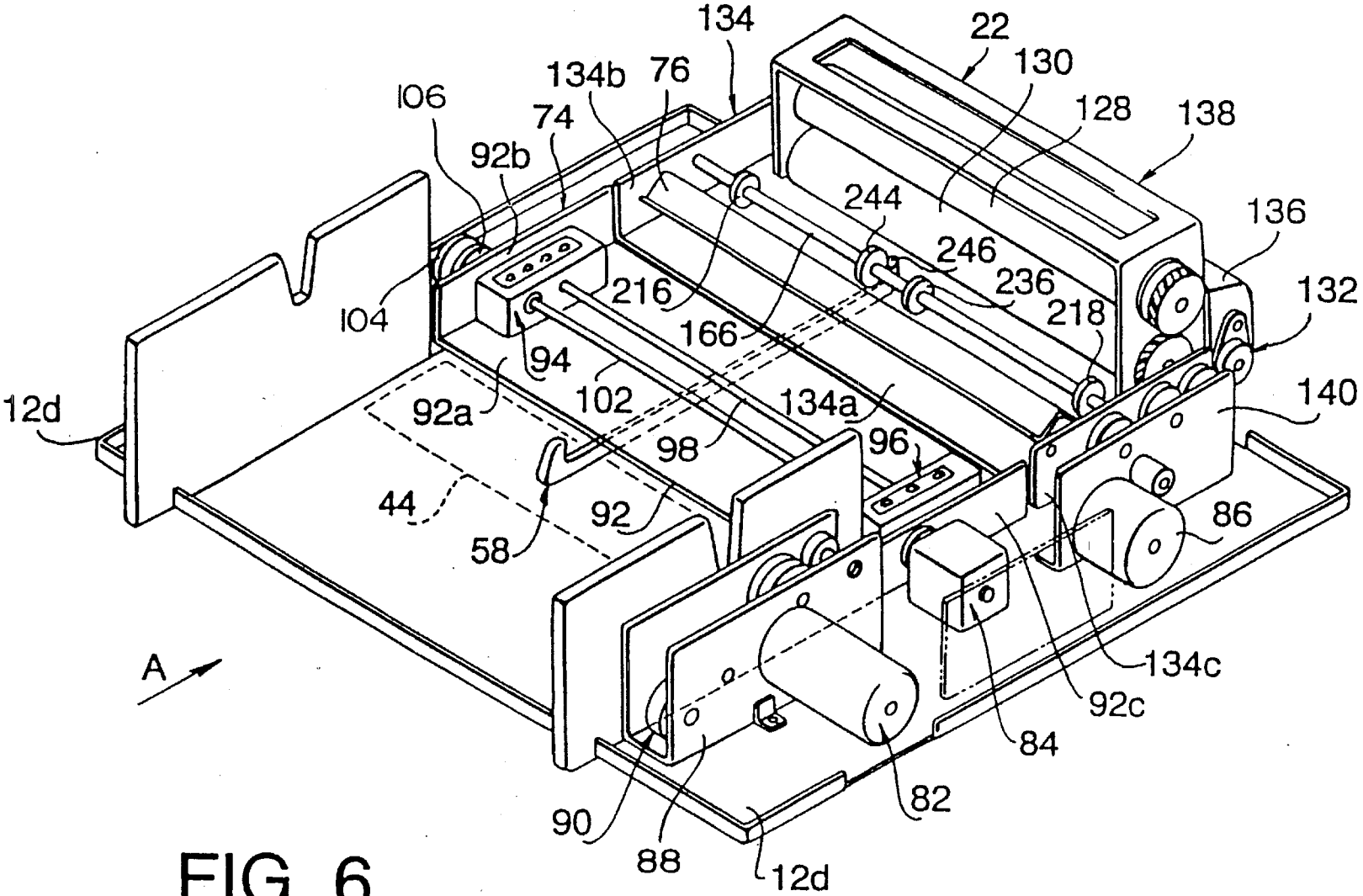
FIG. 6 is a perspective view of components held by a main chassis of the continuous form printer.

The main motor 82 drives the photoconductive drum 16, the toner cleaning brush 36, the developing roller in the developing unit 42, and the bottom back-tension roller 70*b* by means of a power transmission assembly 90 (see FIG. 6). The power transmission assembly 90 is a conventional set of reduction gears and idler gears, mounted in a transmission mounting frame 88, and arranged to drive the aforementioned rollers, the drum 16, and the brush 36. The power transmission assembly 90 engages the driven portions when the upper cover 12*c* is closed. The bottom back-tension roller 70*b* is covered by an elastic, high-friction material such as rubber, and presses against the top back-tension roller 70*a*. The bottom back-tension roller is driven by the power transmission assembly 90 in a direction opposite the forward feeding direction, at a speed slightly faster than the reverse feeding speed. When the paper P is fed forward, the bottom back-tension roller 70*b* turning in the reverse direction to the feeding direction provides back tension. When the paper P is fed in a reverse direction, the bottom back-tension roller 70*b*, driven slightly faster than the paper P in same direction, still provides back tension. The top back-tension roller 70*a* turns passively when in contact with the paper, and is made of a low-friction plastic or other low-friction material.

The upper housing 12*c* and the upper support frame (not shown) may be swung up and away from the lower housing 12*b* and paper path 68, carrying the laser scanning unit 14, the processing unit 18, the charging unit 40, the discharge unit 38, and the toner cleaning brush 36 away from the paper path 68, and thereby allowing access to the paper path 68. Initially, the paper P is inserted from the inlet 26 with the upper housing 12*c* swung open, and is fed by hand to the tractor unit 74. The rotation of the back-tension roller 70*b* is stopped when the upper housing 12*c* is swung up in order to facilitate initial paper feeding.

Figure 3:
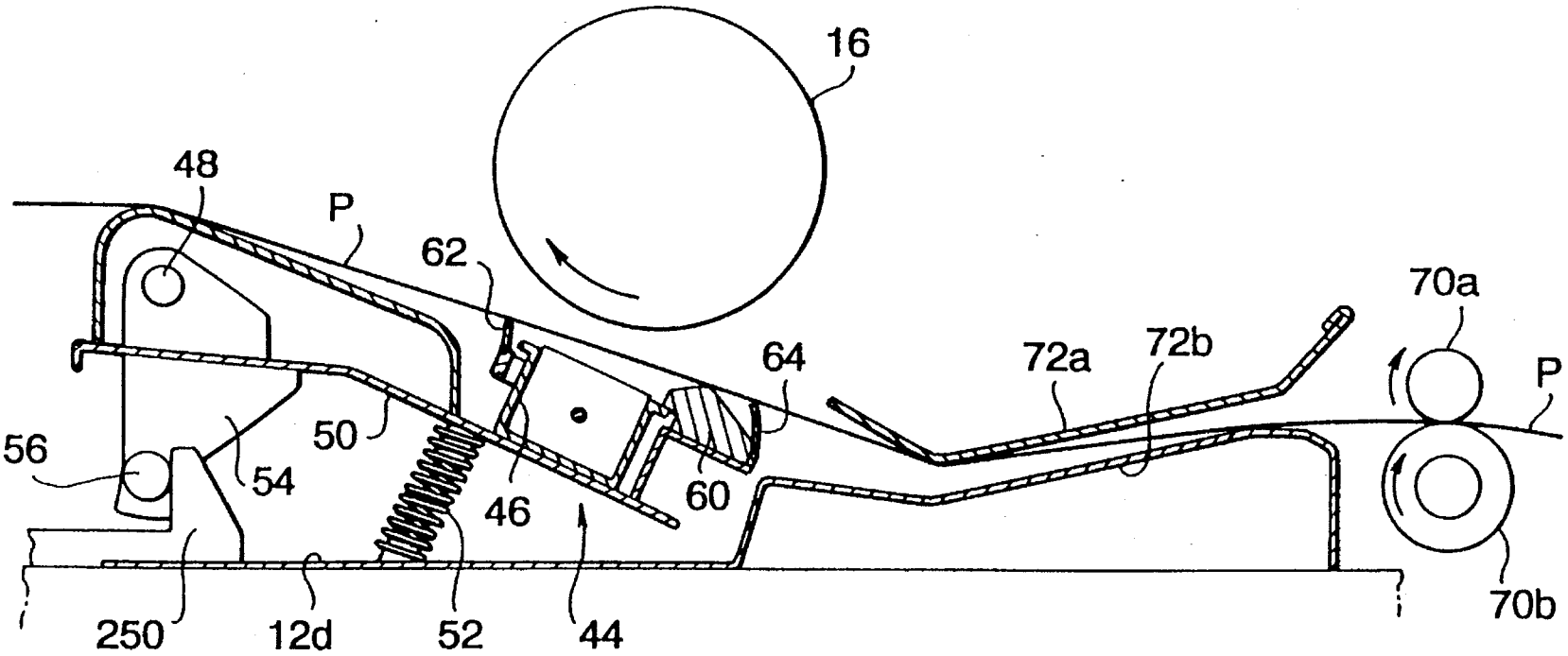
FIG. 3 is a side cross-sectional view of a transfer unit of the continuous form printer, similar to that of FIG. 2, but showing a retracted position.

As shown in FIGS. 2 and 3, the guide plates 72*a* and 72*b* slope downwards from their up stream side, and the paper P is fed between the plates 72*a* and 72*b*. At a predetermined point, the plates 72*a*, 72*b* begin to slope upwards towards the transfer area (at the transfer unit 44).

B. Pushing Member

A guide member 60, shown in FIGS. 2 and 3, and center urging member 64 (in FIG. 4 or 66, in FIG. 5) compensate for any deformation of retracted paper after a fixing operation.

Figure 4:
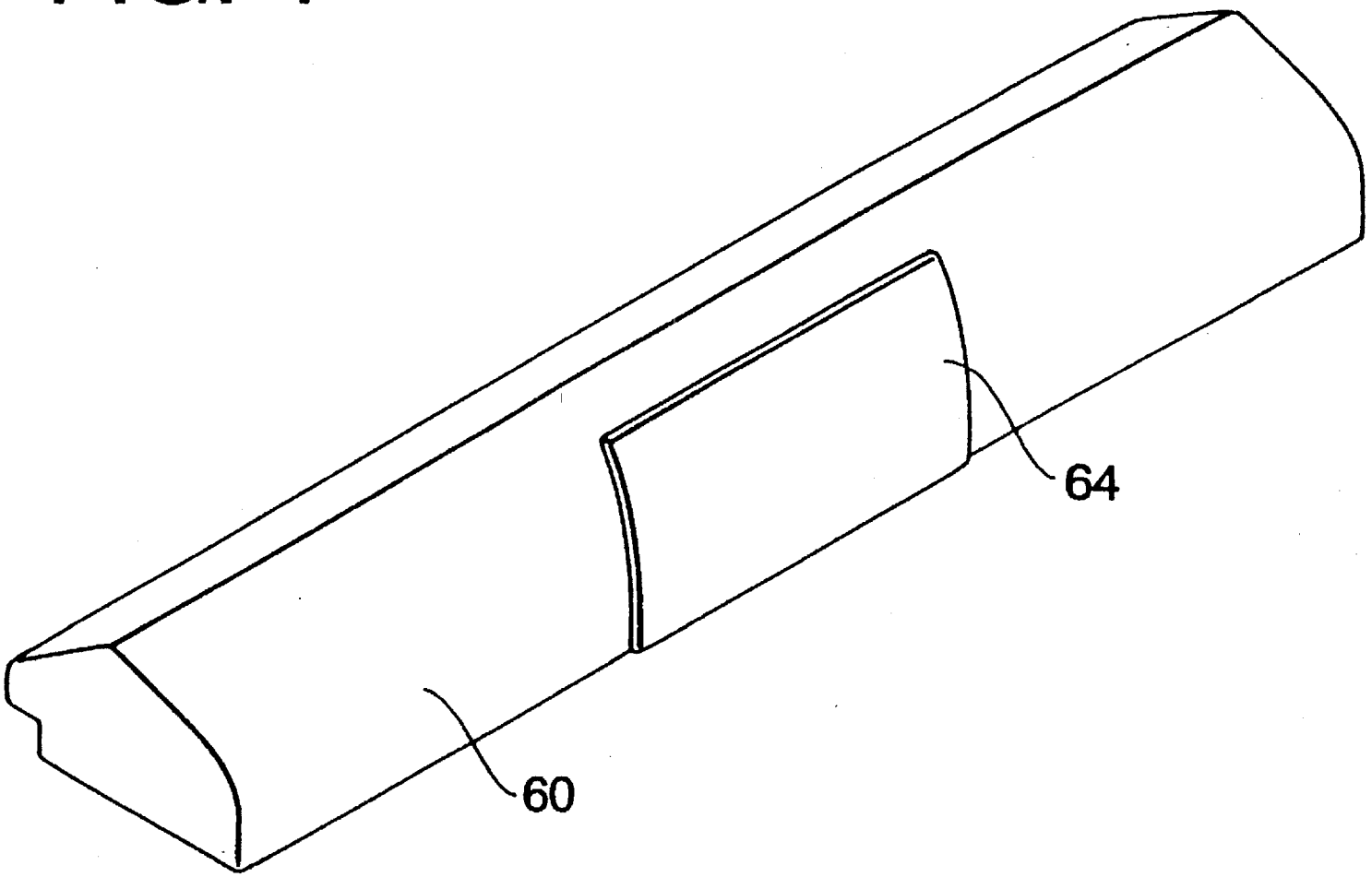
FIG. 4 is a perspective view of a pushing member.

The guide member 60 is mounted to the transfer unit 44, upstream of the corona charger 46. The guide member 60 and the discharge brush 62 hold the paper P to the drum 16 during an image transfer. As shown in FIG. 4, the center urging member 64, made of a flexible plastic such as Mylar, is mounted to the guide member 60 upstream of the guide member 60, and the central urging member 64 projects slightly into the path of the paper P.

When a printed page of the paper P is fixed at the fixing unit 22, the following page also passes through the fixing unit 22 and is heated. The central portion of the following page may warp (in the case of label paper) or wrinkle (in the case of normal paper). As mentioned, the printer is controlled to retract the following page for the next printing operation in order to reduce paper waste; since the following page is to be printed, the warp or wrinkle may result in uneven printing on that page.

The central urging member 64 urges the central portion of the fanfold paper P towards the drum 16, smoothing any wrinkles or warp caused by pre-heating at the fixing unit 22. All printing is performed on smoothed pages, and printing is therefore evenly distributed.

Figure 5:
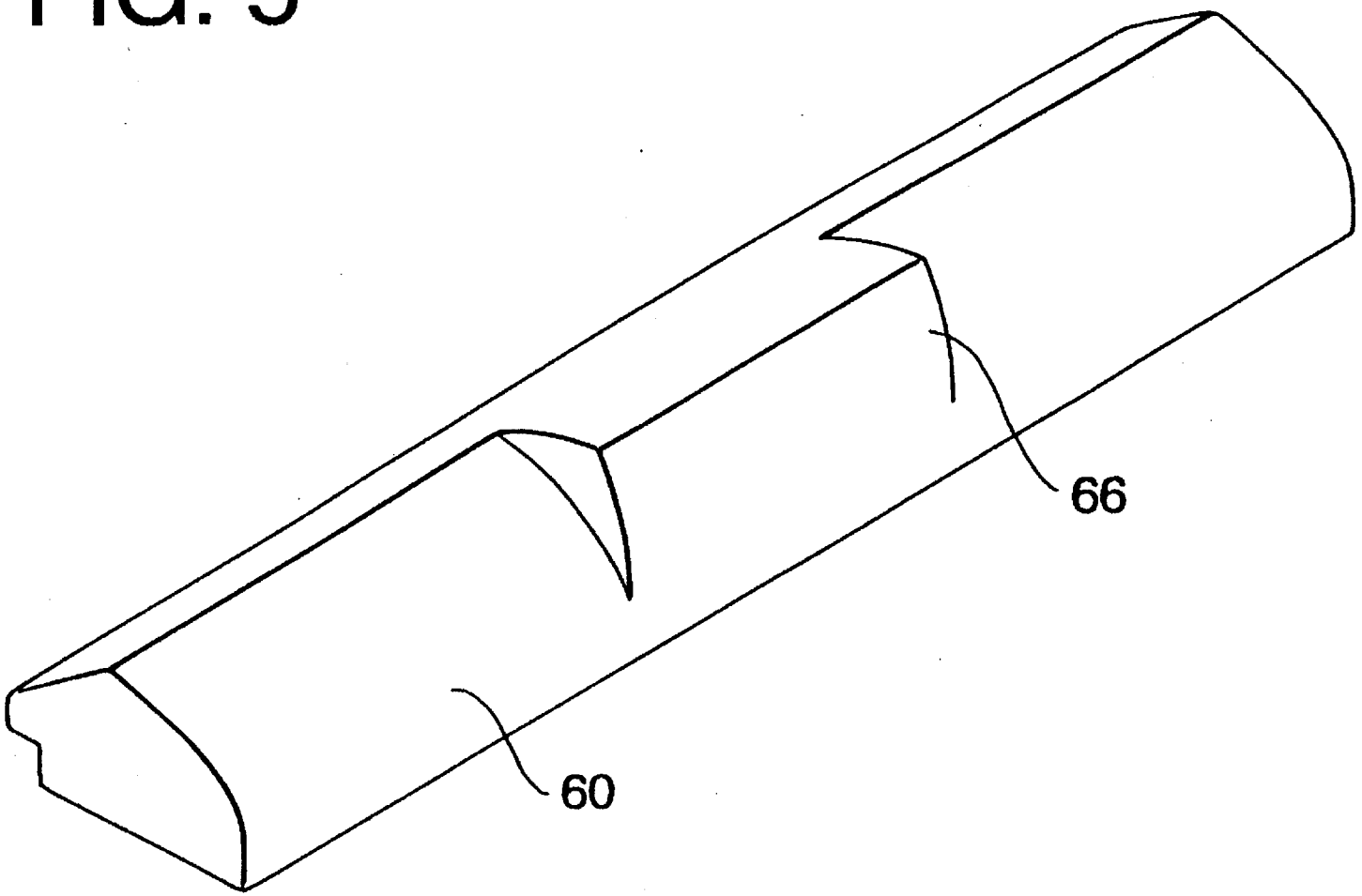
FIG. 5 is a perspective view of a second embodiment of a pushing member.

The central urging member 64 is not necessarily a flexible plastic sheet mounted upstream of the guide member 60. As shown in FIG. 5, a second variation of the smoothing device uses a unitary projection 66 on the upstream side of the guide member 60, having a similar effect although the projection 66 is not necessarily resilient..

C. Adaptive Tractor Unit

The tractor unit 74 is held by a U-shaped tractor frame 92 provided on the main chassis 12*d*, as shown in FIG. 6, and can be removed from the printer 10 with the main chassis 12*d*. The U-shaped tractor frame 92 includes a bottom plate 92*a* and side plates 92*b* and 92*c*, and supports movable tractors 94 and 96.

The tractors 94 and 96 are slidably supported on a guide shaft 98; the guide shaft 98 extends between the side plates 92*b* and 92*a*. The guide shaft 98 further supports paper guides 100*a* and 100*b* (see FIGS. 7 and 8) between the tractors 94 and 96. A drive shaft 102, formed as a square in cross-section between the tractors 94 and 96 and a circle in cross-section at a driven gear 108 (FIGS. 7 and 8), is driven by driven gear 108 at an end near the side plate 92*c*, and drives tractors 94 and 96. A first and a second rotary encoder 104 and 106 are coaxially attached to the drive shaft 102. The first encoder 104 is encoded to generate a Pulse Feed Signal (PFS) for every ⅙ inch of paper advance; the second encoder 106 is encoded at ⅛ inch PFS intervals. The PFS position of the first and second encoders 104 and 106 is detected by first and second photo-interruptor PFS sensors 120 and 122 (in FIG. 8) respectively.

Figure 7:
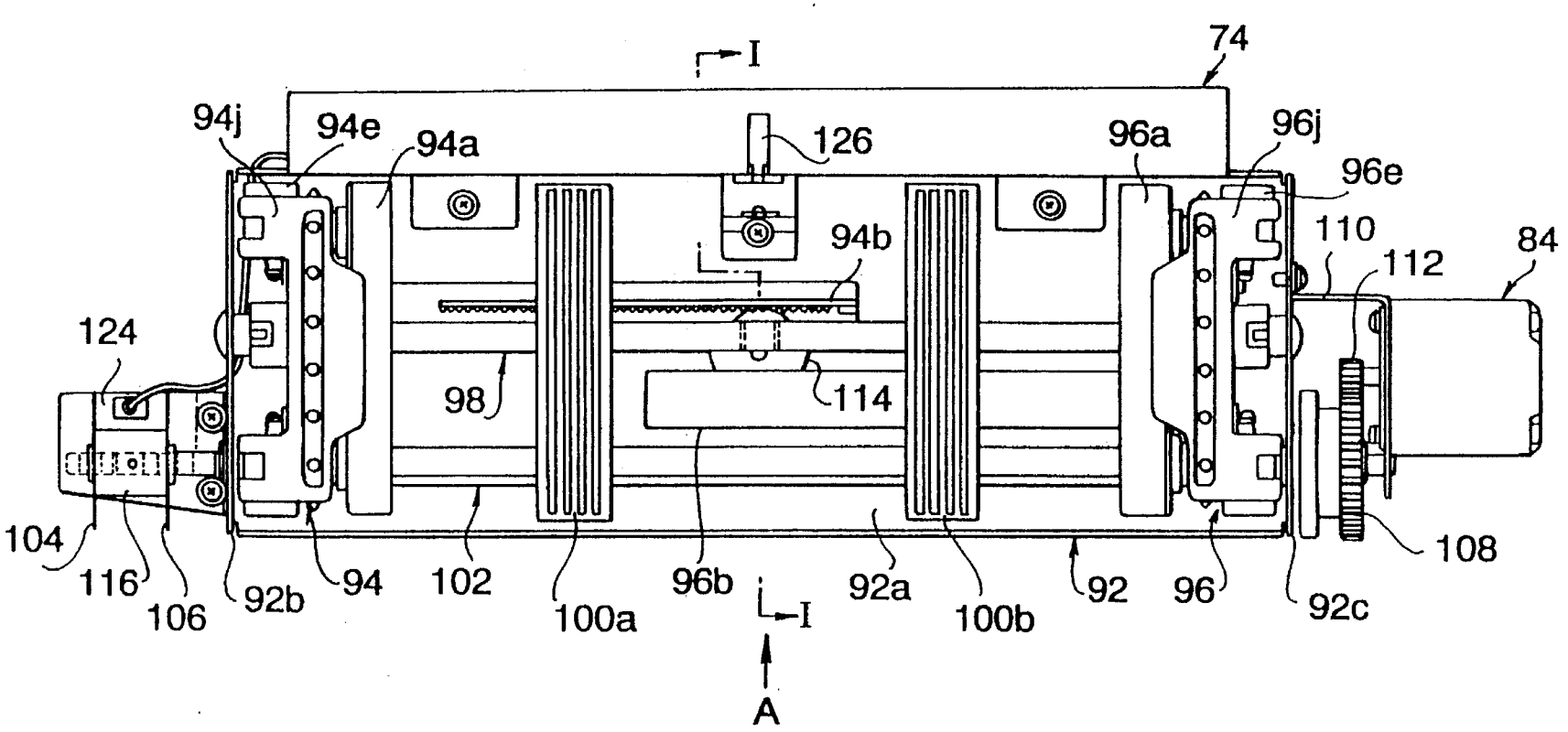
FIG. 7 is a plan view of a tractor unit of the continuous form printer.
Figure 8:
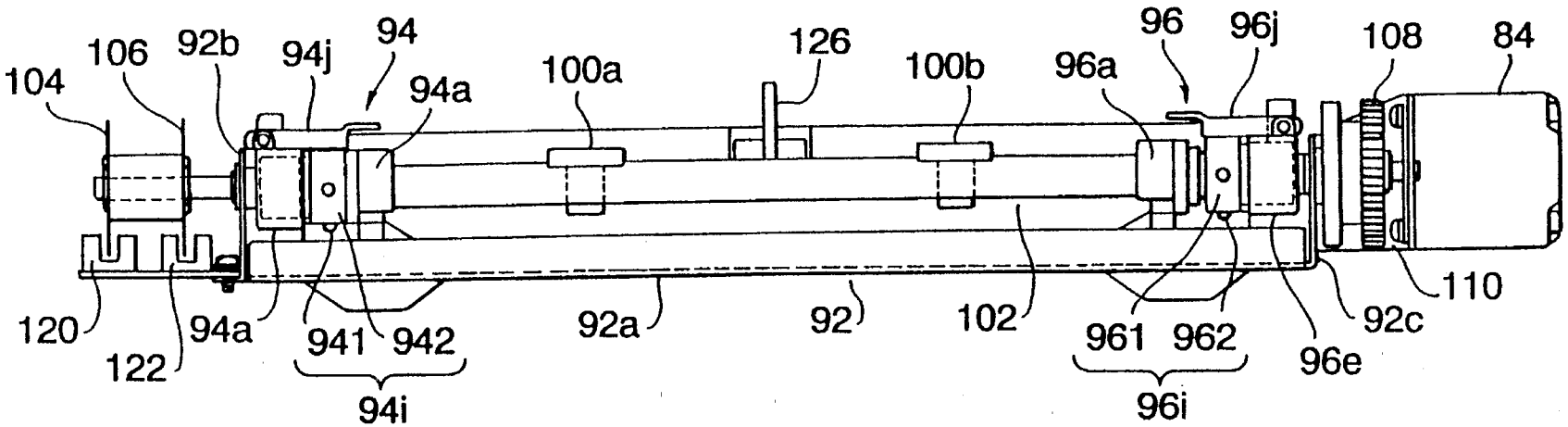
FIG. 8 is a front view of the tractor unit.
Figure 9:
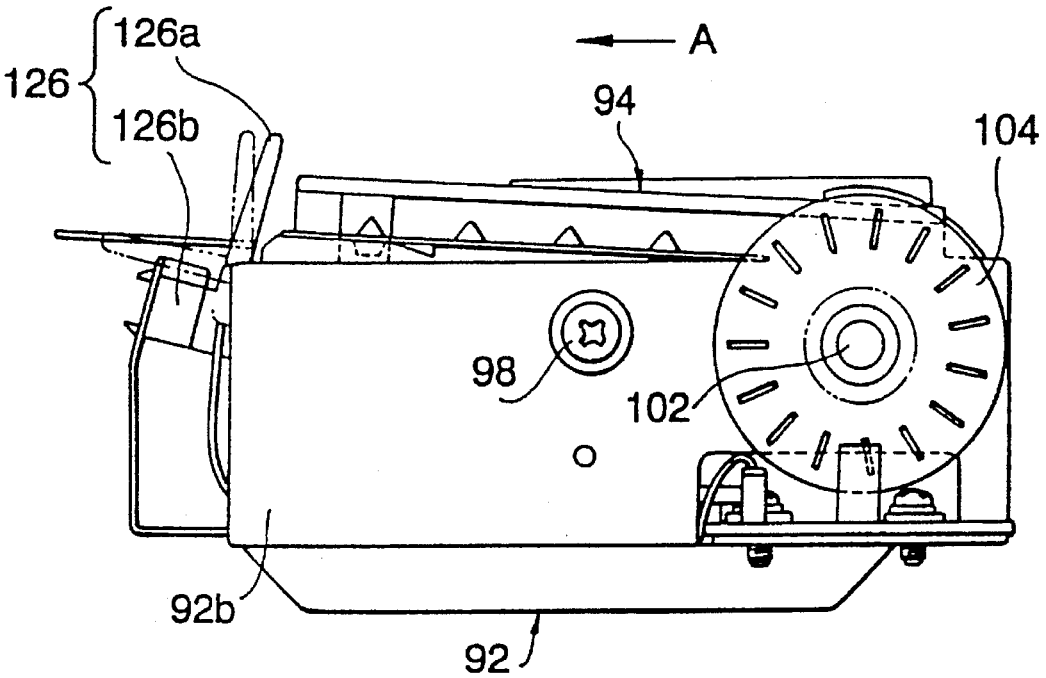
FIG. 9 is a left side view of the tractor unit.
Figure 10:
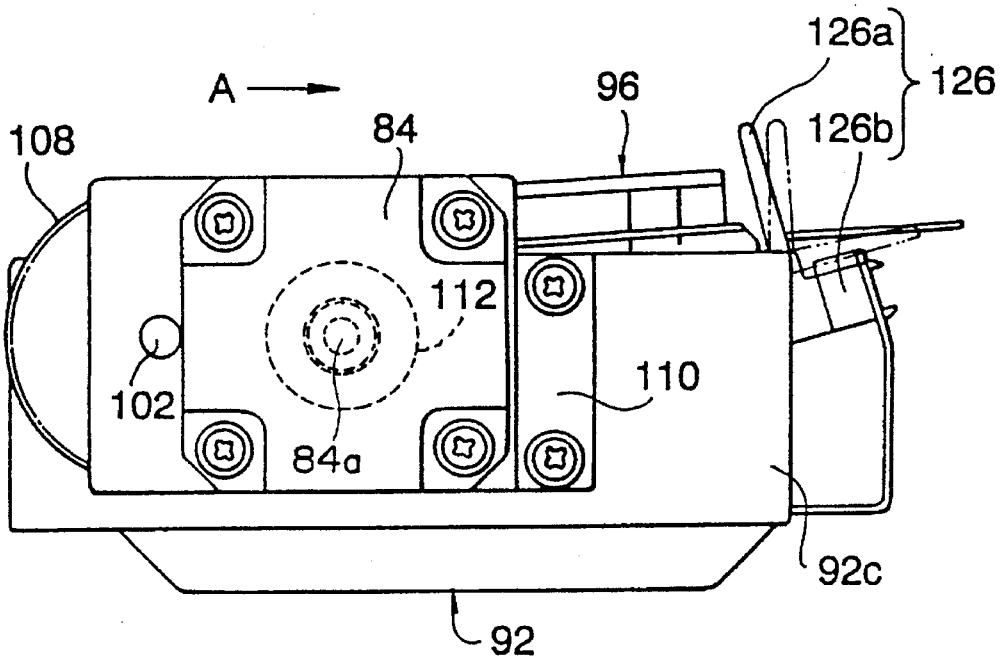
FIG. 10 is a right side view of the tractor unit.
Figure 11:
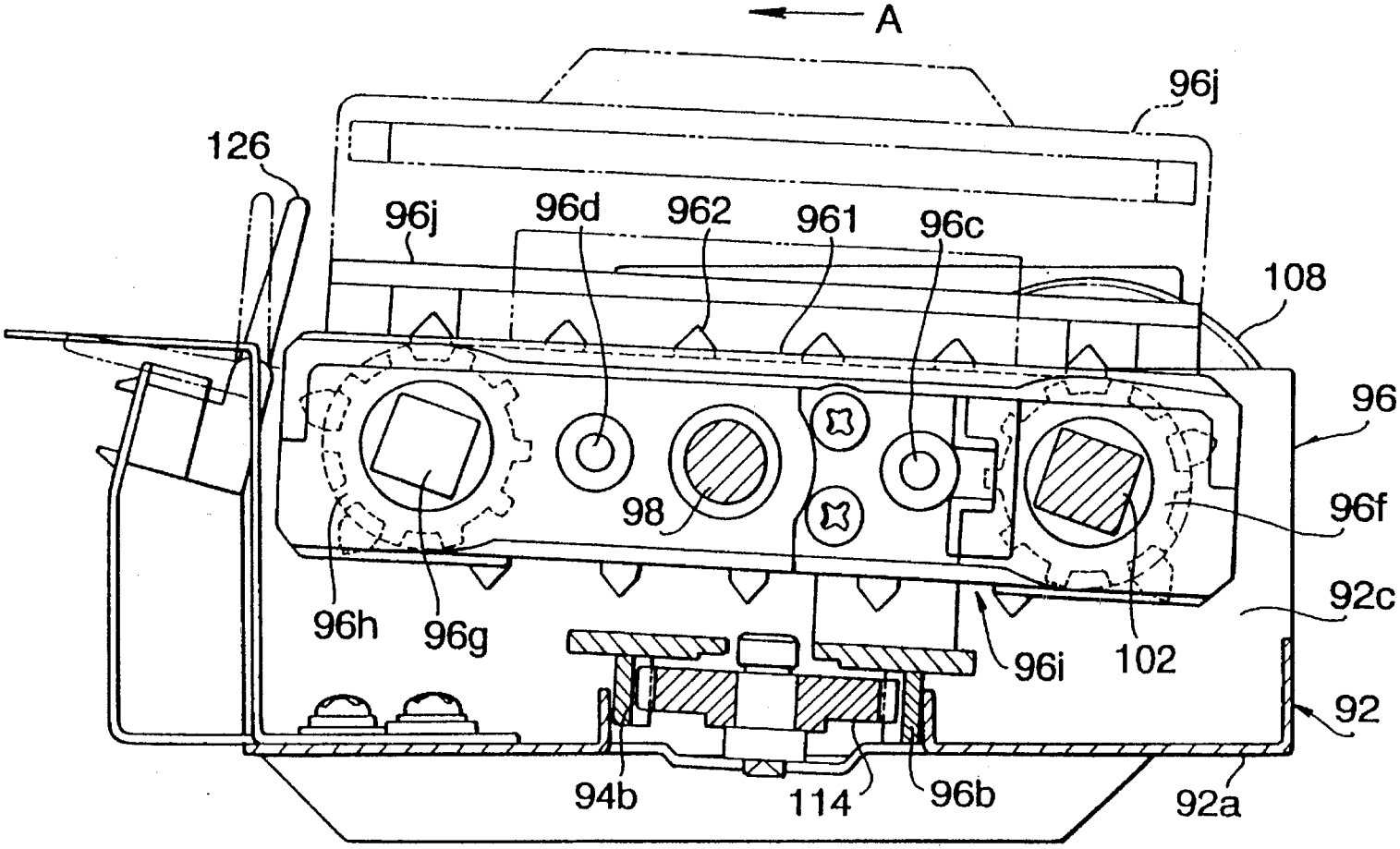
FIG. 11 is a schematic side view of the tractor unit.

Referring to FIGS. 8 through 10, the tractor motor 84 is mounted in a motor bracket 110 fixed to the outside of the side plate 92*c*. The tractor motor 84 drives the driven gear 108 via a pinion 112 mounted to a motor shaft 84*a*. As shown in FIGS. 7 and 11, a center pinion 114 is mounted below the feed system 20, and the first and second racks 96*b* and 94*b* therefore move by symmetrical amounts in opposite directions.

The tractors 94 and 96 are symmetrically constructed and arranged, and the following description of the construction of tractor 96 also describes symmetrical tractor 94; thus, any element of tractor 94 having similar components and configuration to an element of tractor 96 as described herein is referred to with a matching letter suffix (e.g. 94*a*, is symmetrical or analogous to 96*a*), even if not specifically denoted in the drawings. As shown in FIGS. 11 through 16, the tractor 96 includes: a tractor body 96*a* including a sleeve; the rack 96*b* (engaged with pinion 114); support pins 96*c* and 96*d*; a movable housing 96*e* (movably supported by the support pins 96*c*, 96*d*); a drive pulley 96*f* rotatable supported by the housing 96*e*; a rotatable support shaft 96*g*; a driven pulley 96*h* coaxially fixed to the support shaft 96*g*, an endless tractor belt 96*i* looping around pulleys 96*f* and 96*h*; an upper cover 96*j*; and a coil spring 96*k* that biases the cover 96*j* in a closing direction. The tractor belt 96*i* further includes a belt portion 961 and tractor pins or projections 962 (belt 941 and pins 942 on the tractor 94 side). The tractor pins 962 are spaced at the same pitch as the feed holes Pa of the engaging paper P along the belt portion 961.

Figure 12:
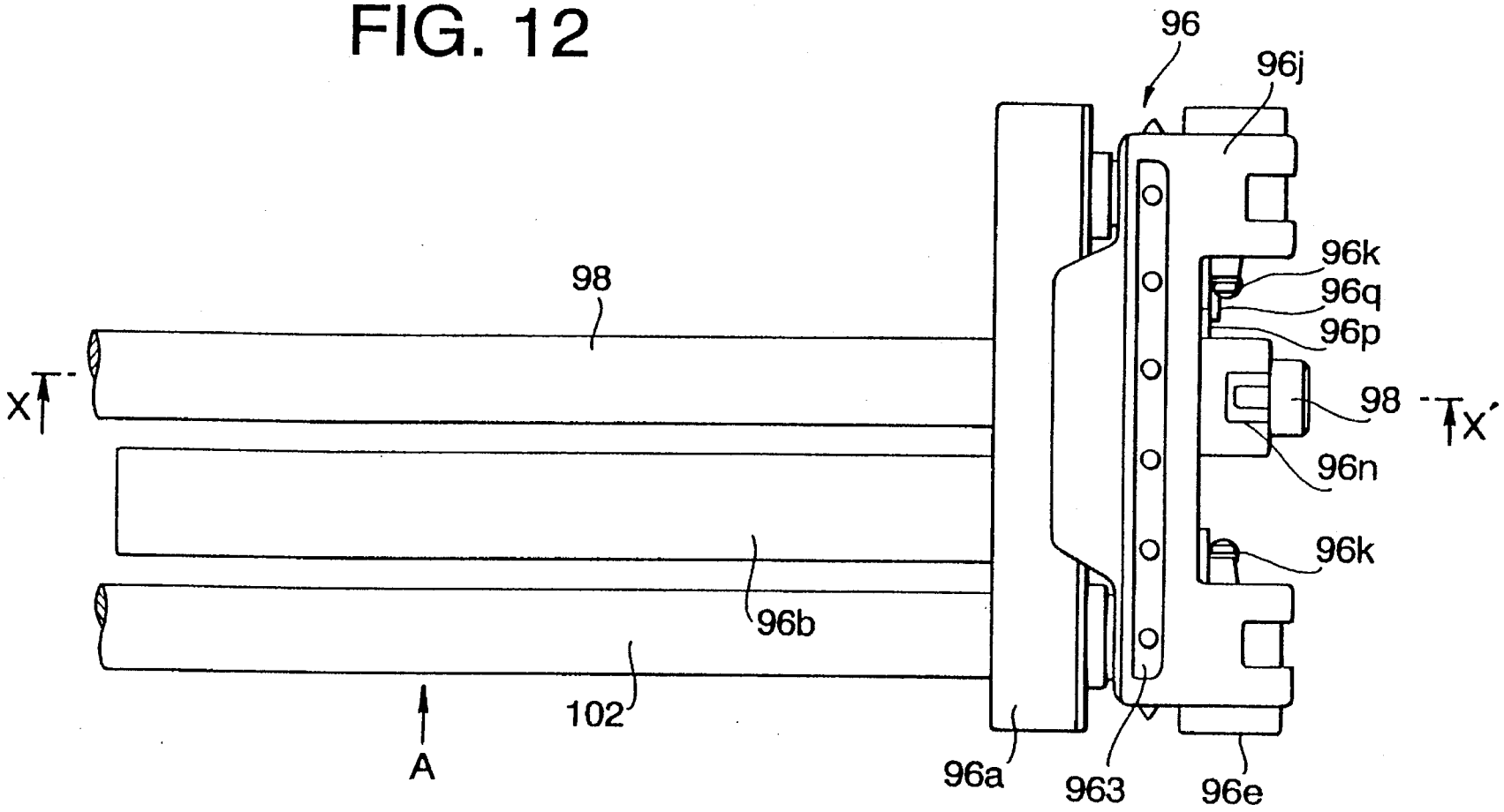
FIG. 12 is a top plan view of a right side tractor of the tractor unit.
Figure 13:
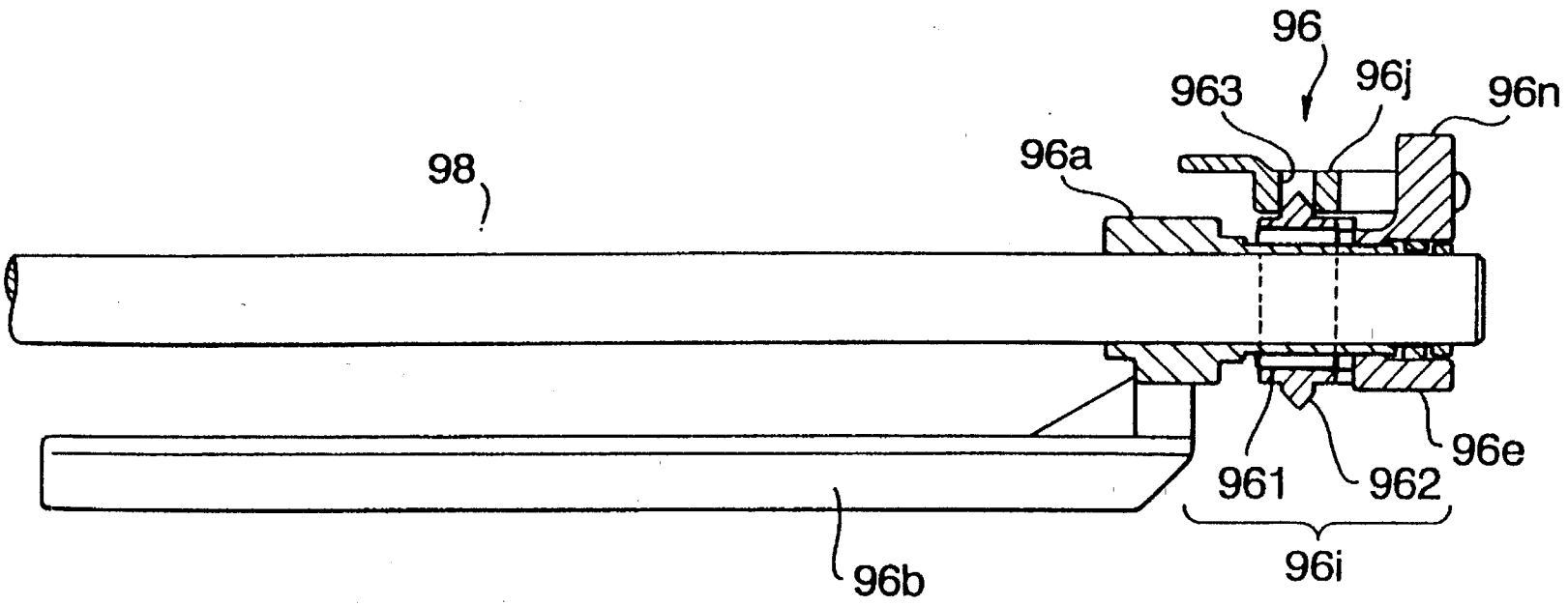
FIG. 13 is a front cross sectional view of the right side tractor, taken along line X—X of FIG. 12.
Figure 14:
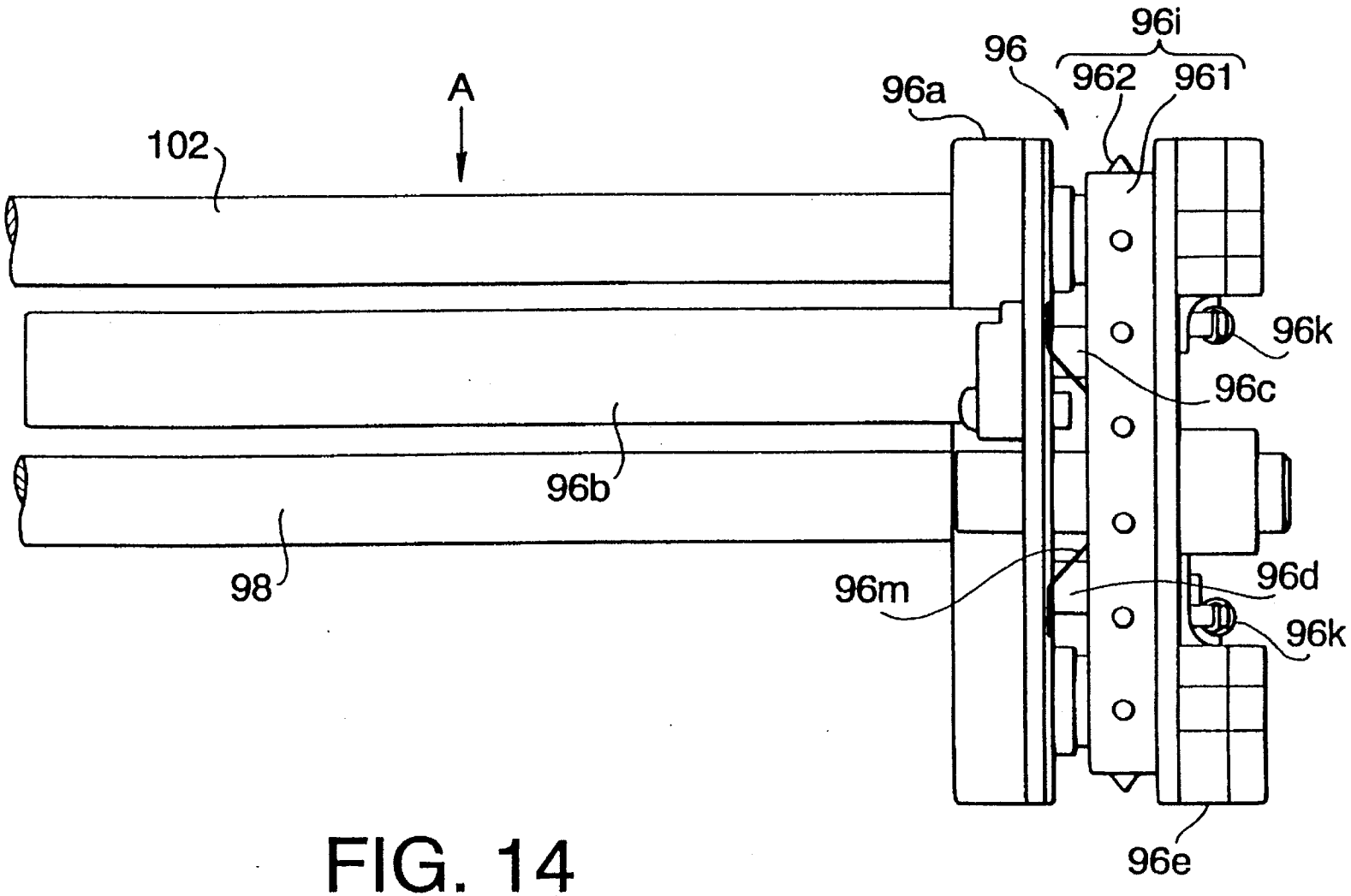
FIG. 14 is a bottom plan view of the right side tractor.
Figure 15:
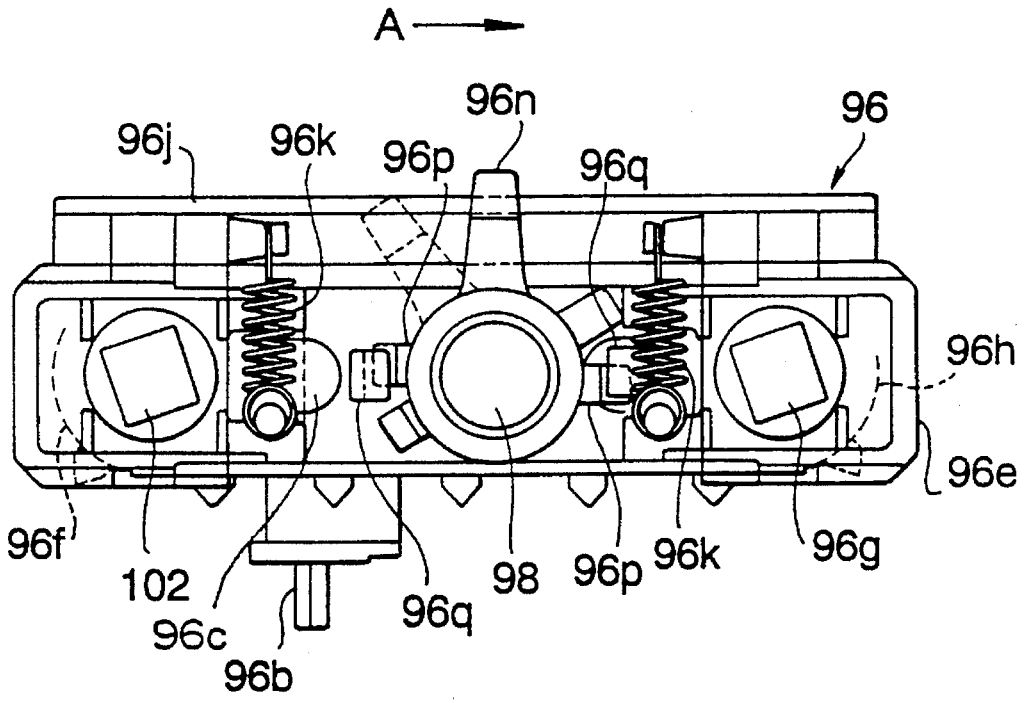
FIG. 15 is a right view of the right side tractor.
Figure 16:
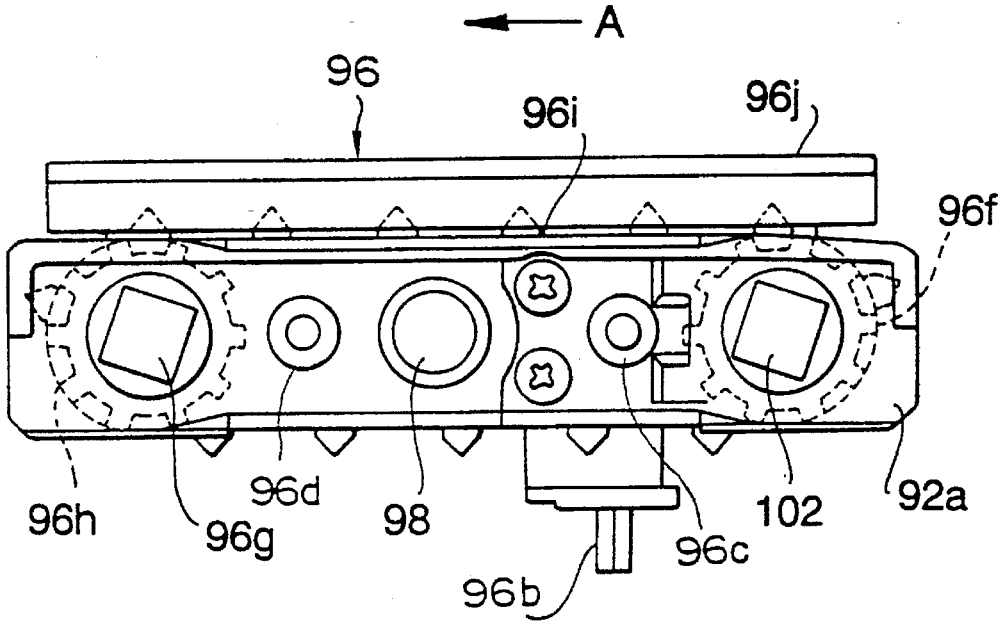
FIG. 16 is a left view of the right side tractor.

The tractor 96 is provided with a plate spring 96*m*, placed between the tractor body 96*a* and the movable housing 96*e*. The plate spring 96*m* biases the movable housing 96*e* laterally towards the outside of the feed system 20. When the upper cover 96*j* is closed, the tractor belt 96*i* is maintained in position by the tractor pins 962, engaged with a cover groove 963 as shown in FIG. 13. In FIGS. 12, 13, and 15, a lock lever 96*n* is rotatably mounted to the sleeve of the tractor body 96*a* near the end of the guide shaft 98, and a manually operable lever portion of the lock lever 96*n* projects above the movable housing 96*e*. The lock lever 96*n* has locked and released positions. The lock lever is provided with an eccentric inner diameter (see FIG. 13) and the eccentric inner diameter encircles the tractor body 96*a* sleeve. When the lock lever is rotated to the "locked" position, the smaller diameter portion of the eccentric inner diameter presses against resilient tabs on the inner sleeve, which in turn press against the guide shaft 98, immobilizing the tractor body 96*a*. When the lock lever 96*n* is in the released position (solid line in FIG. 15), the resilient tabs are released and the tractor body 96*a* becomes movable on the guide shaft 98; further, a lock member 96*p* on the lock lever 96*n* engages a hook 96*q* on the outer surface of the housing 96*e*, preventing the movable housing 96*e* from moving inwards with reference to the tractor body 96*a*. When the lock lever 96*n* is in the locked position (dotted line in FIG. 15), the tractor body 96*a* is held with reference to the guide shaft 98, and the hook 96*q* does not engage the lock member 96*n*, allowing the inward movement of the movable housing 96*e* and therefore the tractor pulleys 96*f* and 96*h*.

To load and set the paper P in the tractors 94 and 96, the leading edge of the paper P is introduced into the inlet 26, pushed through the back-tension rollers 70*a* and 70*b*, and past the retracted transfer unit 44 to the tractor unit 74. At this point, the upper covers 94*j* and 96*j* are opened, as shown by a double-dotted line in FIG. 11, to allow access to the tractor belts 94*i* and 96*i*. The feeding holes Pa of the paper P are engaged with the tractor pins 962 and 942 of the tractor belts 96*i* and 94*i*, and the upper covers 94*j* and 96*j* are then closed, as shown by the solid line in FIG. 11, to secure the engagement between the holes Pa and pins 962 and 942, and to guide the pin 962 by the groove 963 and the pin 942 by the groove 943.

The lock levers 96*n* and 94*n* are then moved by the operator to the release position, and the tractors 94 and 96 become slidable along the guide shaft 98, while the movable housing 96*e* (and 94*e*) is held with reference to the tractor body 96*a* (and 94*a*). The operator moves either one of the tractors 94 or 96 inwardly or outwardly to match the chosen continuous form sheet width, and the remaining one of tractors 94 or 96 is moved symmetrically in the opposite direction by virtue of the two racks 94*b* and 96*b*, linked by the pinion 114. When the operator returns the lock levers 94*n* and 96*n* to the locked position, each of the hooks 94*q* and 96*q* are released by the corresponding lock member 94*p* and 96*p*, allowing the movable housings 94*e* and 96 *e* to move inwardly with reference to the tractor bodies 94*a* and 96*a*, respectively. If the paper P is deformed by the fixing unit 22, thereby having a reduced width, the movable housings 94*e* and 96*e* move to compensate for the reduced width.

Thus, when the effective width of the paper P is reduced, the feeding holes Pa of the paper P still engage the tractor pins 962 and 942 properly as the tractor unit 74 adapts to the reduced width, providing a proper paper feed and preventing jams.

The reduced width may be alternatively accounted for by other structures instead of the movable housings 94*e* and 96*e* of the tractors 94 and 96. For example, one tractor may be movable, and the remaining tractor fixed. Alternatively, a movable housing may be fixed, and lockable to the guide shaft 98 by the corresponding lock lever. Furthermore, the tractor belts 94*i* or 96*i* themselves may be movable to absorb a change in paper width from deformation or heating.

D. Tractor Feed Control System

The continuous form printer 10 embodying the invention is able to generate PFS (Pulse Feed Signals) for ½, ⅙, or ⅛ inches, and is therefore able to feed paper P by any of ½, ⅙, or ⅛ inch feeding intervals.

For PFS output, the drive shaft 102, penetrating the side plate 92*b*, supports coaxially fixed first and second PFS encoders 104 and 106. The first PFS encoder 104 generates ⅙ inch pulses, and the second PFS encoder 106 generates ⅛ inch pulses.

Figure 17:
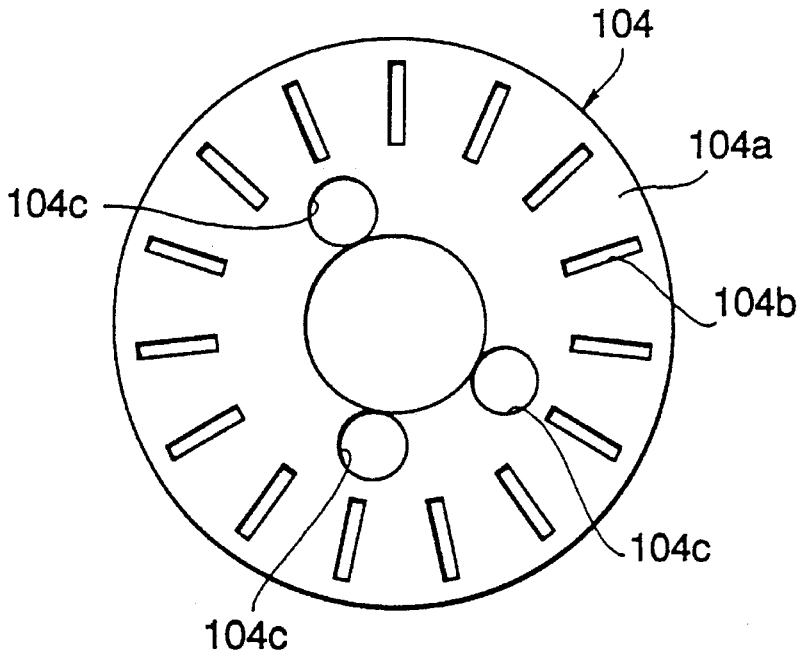
FIG. 17 shows a ⅙ inch encoder wheel.
Figure 18:
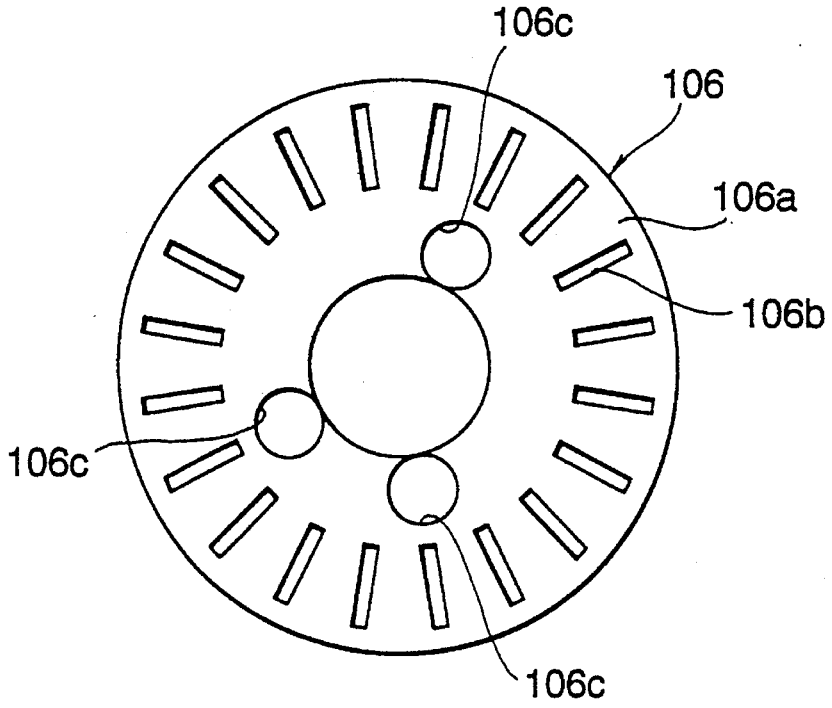
FIG. 18 shows a ⅛ inch encoder wheel.

As shown in FIG. 17, the first encoder 104 includes a disk 104*a* having 15 encoder slits 104*b* extending radially at intervals corresponding to a ⅙ inch of paper feed. One rotation of the shaft 102 therefore corresponds to 2½ inch of paper feed. The second encoder 106 (FIG. 18) includes a disk 106*a* having 20 encoder slits 106*b* extending radially at intervals corresponding to ⅛ inch of paper feed. The slits 104*b* and 106*c* of the encoders 104 and 106 are of the same size and radial position.

Figure 19:
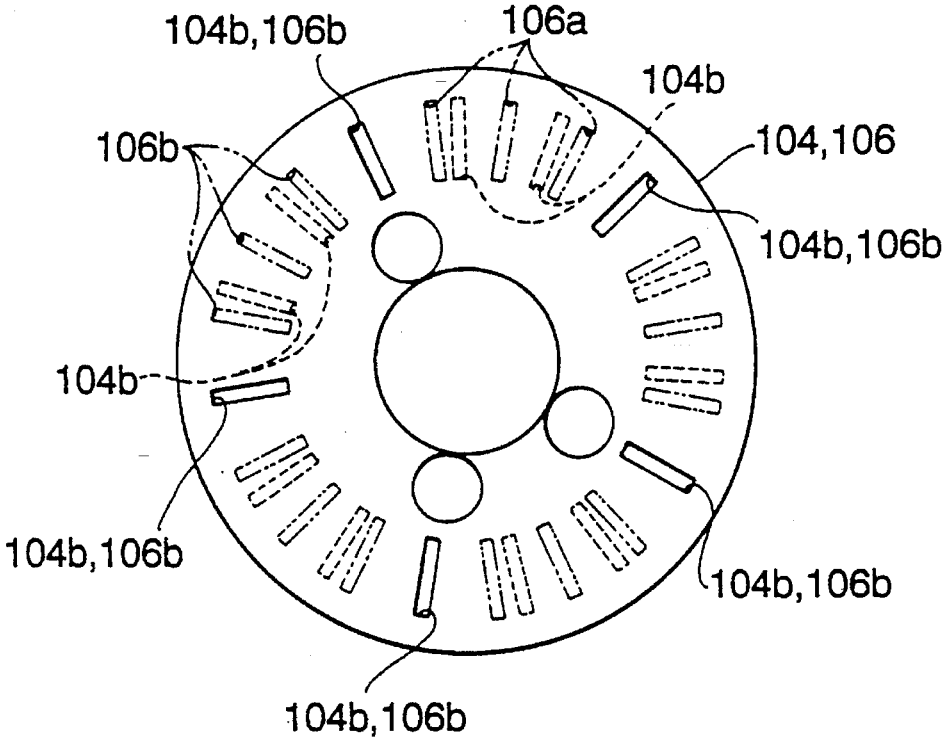
FIG. 19 shows superimposed ⅙ inch and ⅛ inch encoder wheels.

If the encoders 104 and 106 are coaxially mounted with one slit 104*b* and 106*b* aligned, every third slit 104*b* of encoder 104 (⅜") and every fourth slit 106*b* of encoder 106 (⅝") are aligned at intervals corresponding to ½ inch (⅜"=⅝"=½"). Five predetermined slits 104*b* and 106*b* of each of encoders 104 and 106 respectively are thus aligned with each other as shown in FIG. 19. In FIG. 19, solid lines denote the aligned slits, dashed lines denote non-aligned slits 104*b*, and single-dotted lines denote non-aligned slits 106*b*.

Figure 20:
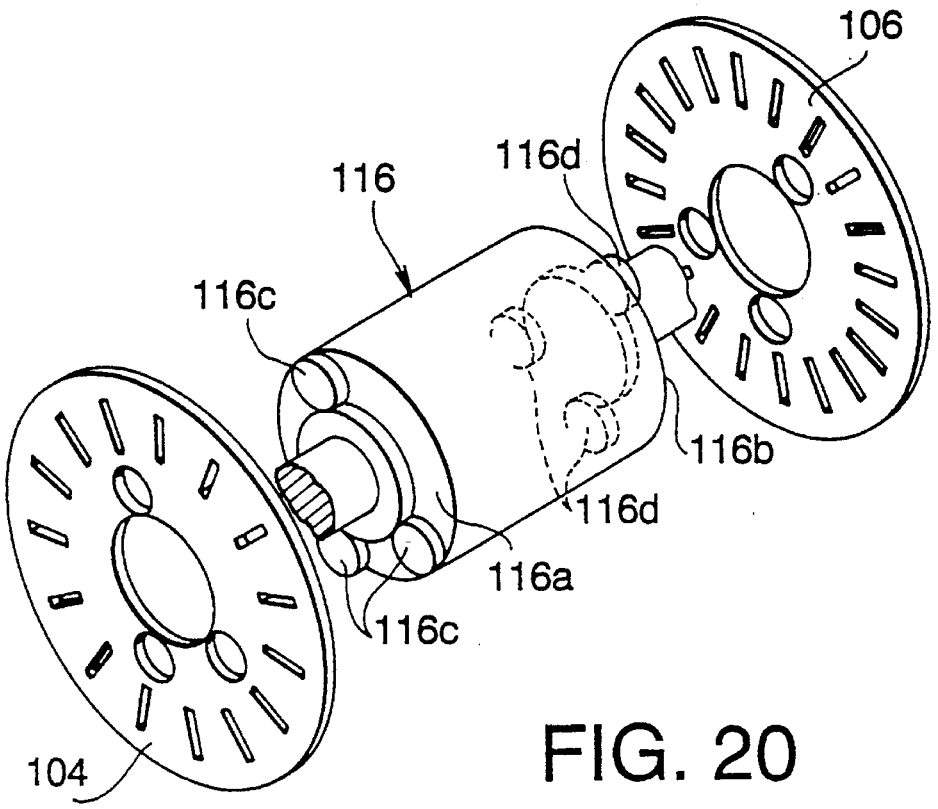
FIG. 20 is a side view of an encoder positioning sleeve.

The drive shaft 102 is provided with a positioning sleeve 116 (FIG. 20) having three bosses 116*c* on one side surface 116*a*, and three opposing bosses 116*d* on the parallel opposite side surface 116*b*, each of the bosses provided adjacent to the shaft. The bosses 116*c* and 116*d* are arranged asymmetrically about the shaft 102, and mate with corresponding positioning holes 104*c* and 106*c*, respectively, provided in the encoders 104 and 106, determining the position of the encoders 104 and 106 (in order to overlap the predetermined five slits). The encoders 104 and 106 abut the side surfaces 116*a* and 116*b* respectively, and the encoders 104 and 106 are thereby arranged in parallel and are appropriately aligned on the shaft 102 by means of the positioning sleeve 116.

Thus, the paper feed encoder system uses the aligned slits 104*b* and 106*b* of the encoders 104 and 106 to generate ½ inch PFS pulses. A dedicated encoder, sensor, or wiring to generate and transmit ½ inch PFS pulses is therefore not needed. Alternatively, a unitarily formed encoder having aligned slits instead of the coupled encoders 104 and 106 may be used.

As shown in FIG. 8, first and second PFS sensors 120 and 122 are each photo-interruptor sensors with a light receiving element and a light emitting element. The PFS sensors 120 and 122 output OFF signals when light is blocked by the encoders 104 and 106 and ON signals when light passes through the slits 104*b* and 106*b* in encoders 104 and 106.

Figure 21:
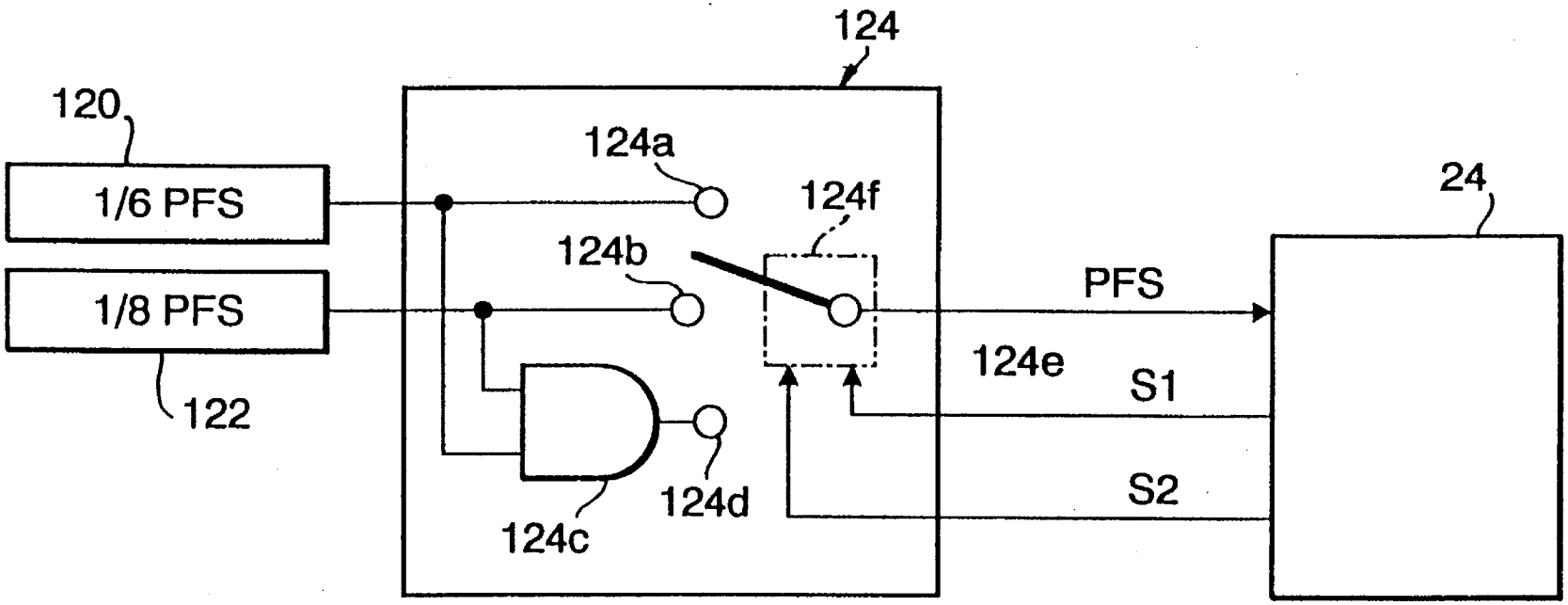
FIG. 21 shows a pulse feed signal selector.

The PFS pulse for ⅙ inch feeding interval is defined by the ON signal from the first PFS sensor 120, for ⅛ inch from the second PFS sensor 122, and for ½ inch from both the first and second PFS sensors 120 and 122. A PFS selector 124 for selecting the PFS pulse interval according to the feeding interval is mounted on a sensor plate as shown in FIG. 7. The PFS selector 124, shown in detail in FIG. 21, includes: a first terminal 124*a* for the first PFS sensor 120; a second terminal 124*b* for the second PFS sensor 122; an AND gate 124*c* that performs an AND function on signals from the first and second sensors 120 and 122; a third terminal 124*d* for the output of the AND gate 124*c*; a switch 124*f* for switching between the three PFS terminals 124*a*, 124*b*, and 124*d*; and an output terminal 124*e* connected to the switch 124*f* and to the control unit 24. Furthermore, the control unit 24 controls the switch 124*f* by means of the control lines S1 and S2.

The control unit 24, for example, sends signals S1 high and S2 low to change the switch 124*f* to the first (⅙") terminal 124*a*, S1 low and S2 high to change the switch 124*f* to the second (⅛") terminal 124*b*, and S1 low and S2 low to change the switch 124*f* to the third (AND, ½") terminal 124*d*. The control unit receives a PFS signal through terminal 124*e* corresponding to a selected one of the first, second, or third terminals 124*a*, 124*b*, or 124*d*, thus receiving the appropriate PFS pulses of ⅙, ⅛, or ½ inch. The controller 24 is thereby able to feed the paper P by any of three feed intervals, using the appropriately determined PFS pulse from only two encoders.

E. Fixing Unit

The fixing unit 22 includes a detachable roller unit 138 that can be easily removed or replaced, allowing convenient maintenance. Reference numerals including a bracketed second numeral in FIGS. 29 through 36 denote an element having a corresponding element for left and right sides, where the bracketed second numeral identifies a corresponding element on the opposite side.

The fixing unit 22 includes a heat roller 128 and a pressure roller 130, and the rollers fix a toner image to the paper P by heat and pressure. As shown from the viewpoint of FIG. 27, the heat roller is driven counterclockwise by the fixing unit drive system 132. The pressure roller 130 is freely rotatable and vertically movable.

Figure 23:
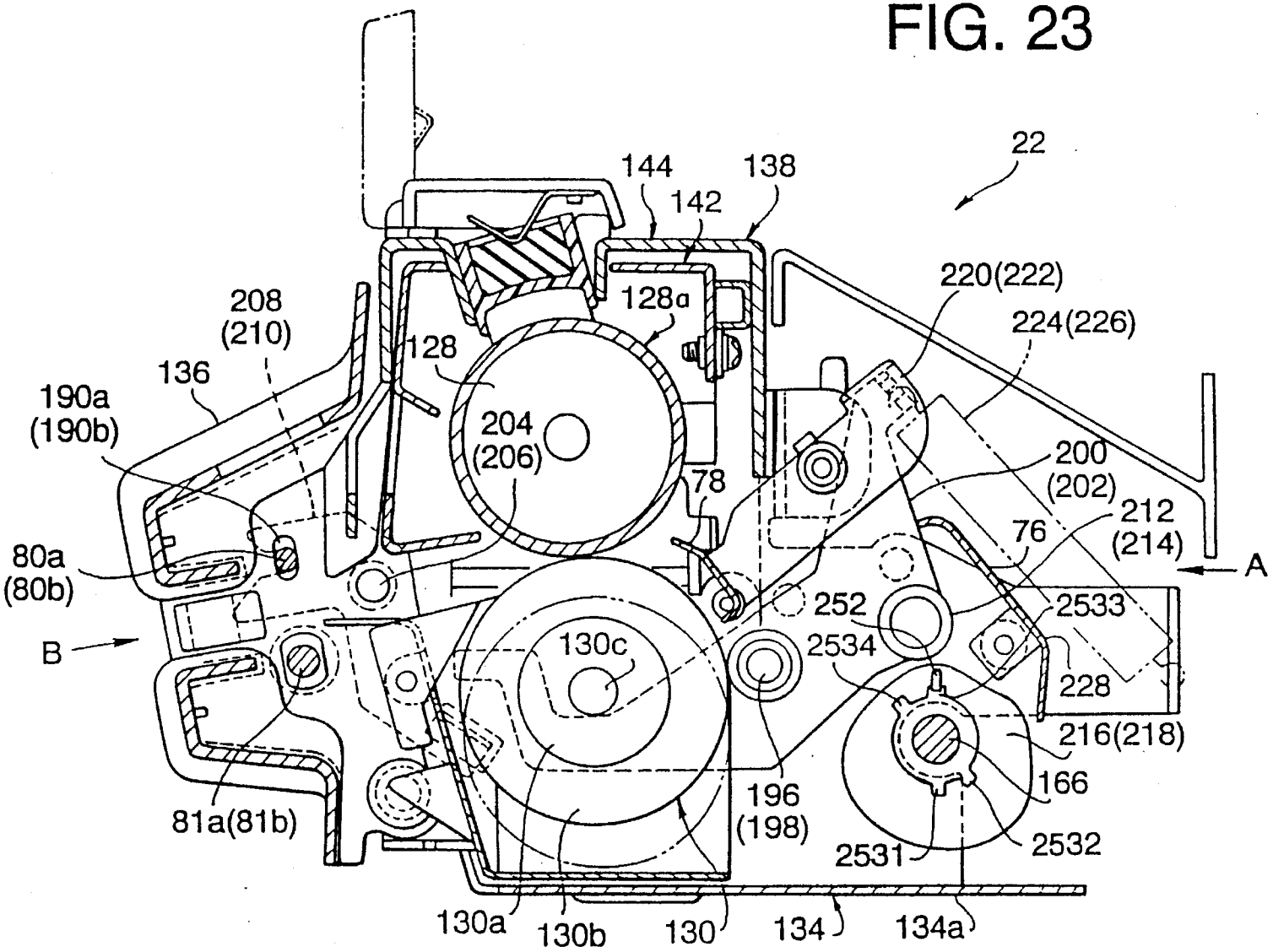
FIG. 23 is a schematic side view of the fixing unit and surrounding components, showing internal detail.
Figure 24:
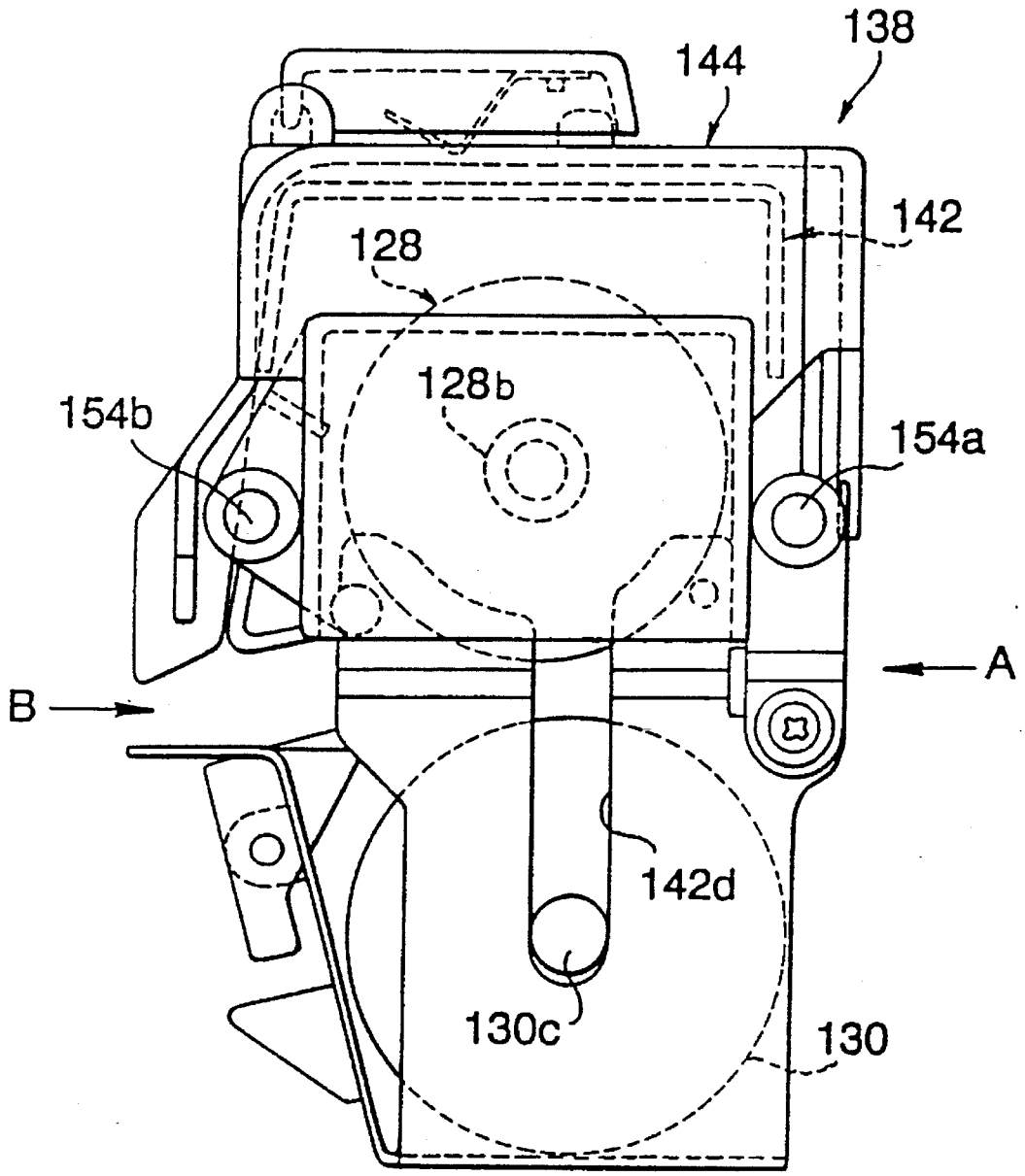
FIG. 24 shows a removable roller unit, detached from the printer.

Shown in detail in FIGS. 23 and 24, the heat roller 128 includes a sleeve 128*a* and a hollow shaft 128*b*. A heat source, such as a halogen lamp, is inserted in the hollow shaft 128*b* and heats the heat roller 128. The pressure roller 130 includes a rotatable core 130*a*, an elastic sleeve 130*b* surrounding the core 130*a*, and a fixed shaft 130*c* having a bearing (not shown) such that the core 130*a* is rotatable about the fixed shaft 130*c*.

The lower discharge roller 81 is driven by the fixing unit driving system 132 in synchronization with the heat roller 128. The upper discharge roller 80 is swingable towards and away from the paper path 68.

Figure 26:
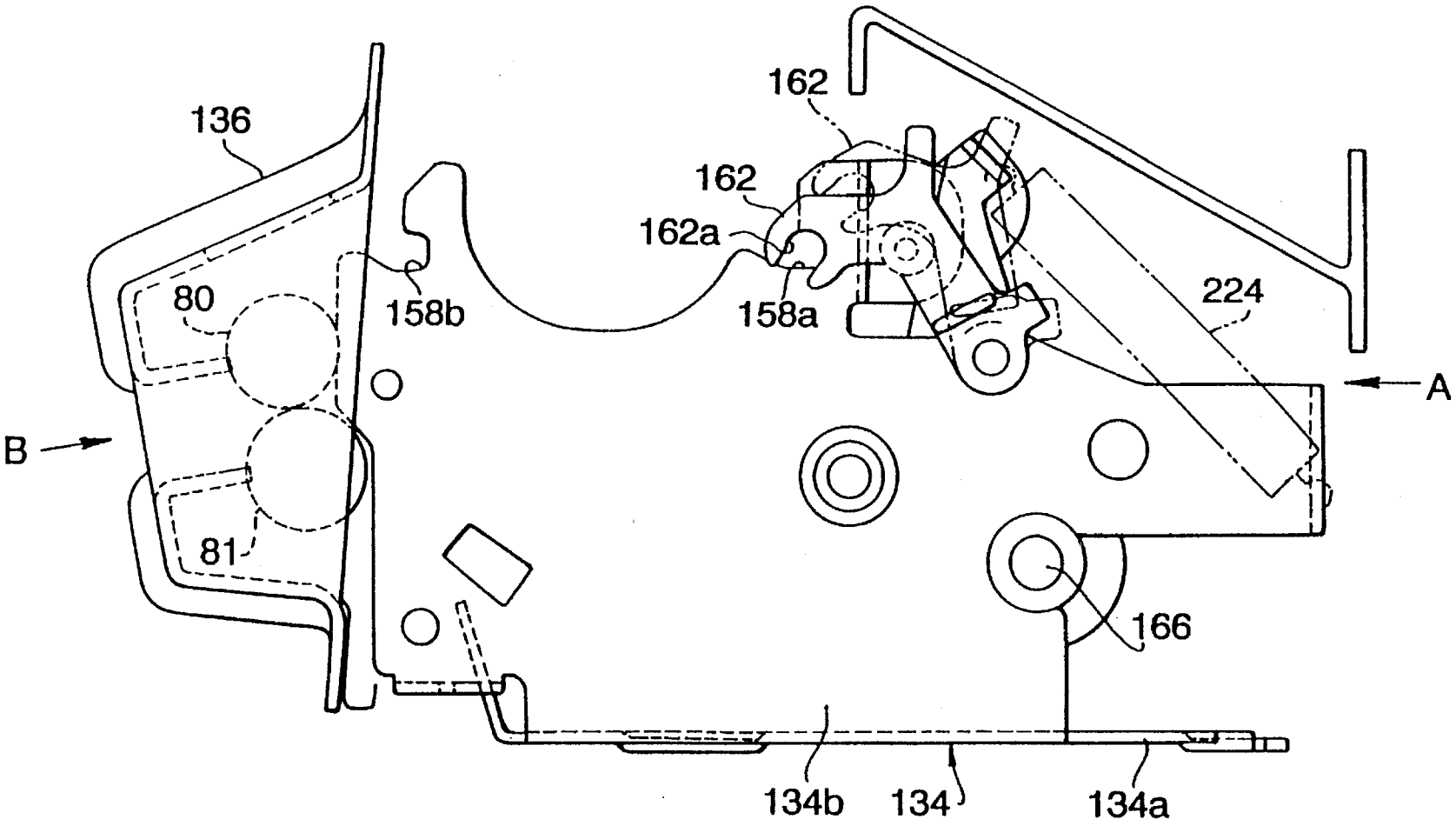
FIG. 26 shows a fixing unit frame and attaching/detaching mechanism for the removable roller unit.
Figure 27:
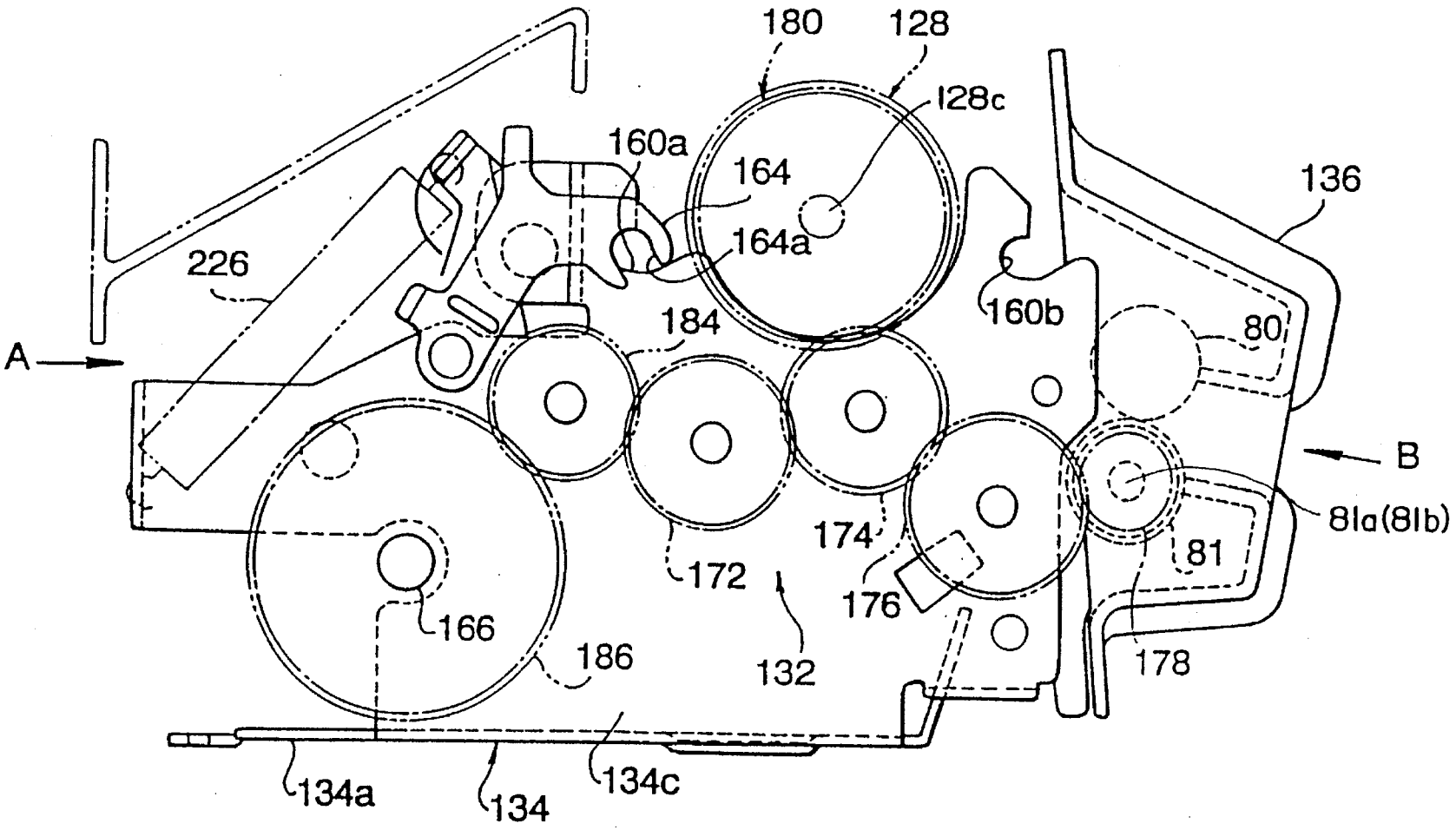
FIG. 27 shows a side view of a fixing unit drive system, including a heat roller drive gear.
Figure 28:
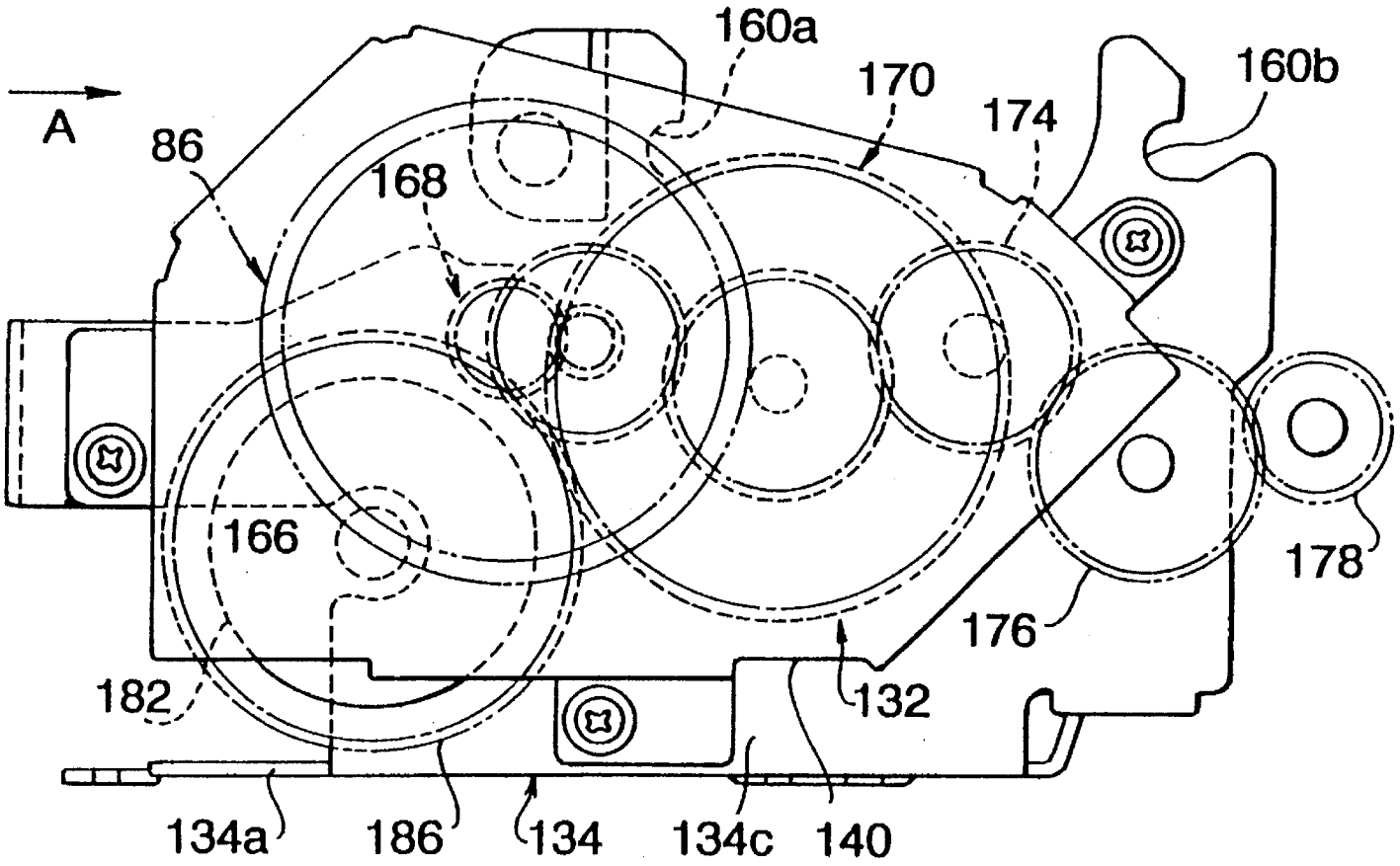
FIG. 28 shows the fixing unit drive system, including a reduction gear.

The fixing unit 22 includes a frame 134 fixed to a chassis 12*d* in the lower housing 12*b* (FIG. 6), a discharged paper cover 136 swingably mounted to the frame 134, and a detachable roller unit 138 mounted in the frame 134. As seen in FIGS. 26 through 28, the frame includes a bottom plate 134*a* and side plates 134*b* and 134*c*. A support stay 140 (see FIG. 28) is mounted in parallel to the side plate 134*c*. The fixing unit driving system 132 is arranged between the side plate 134*c* and the support stay 140.

Figure 25:
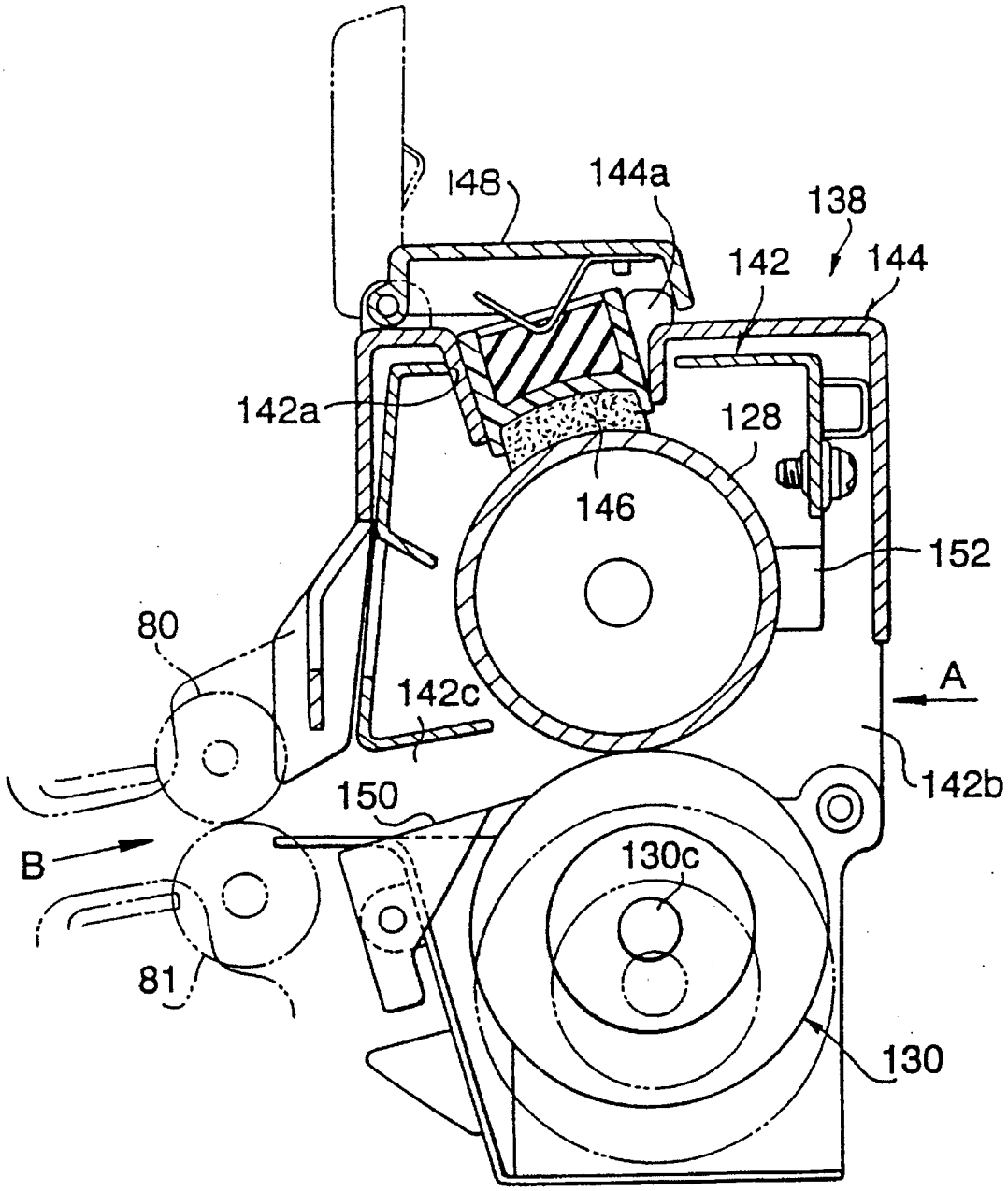
FIG. 25 is a side view of the detached removable roller unit, showing internal detail.

FIGS. 24 and 25 show a detachable roller unit 138. The removable roller unit 138 includes a unit housing 142, the upper housing 144 covering the unit housing 142, the heat roller 128 and the vertically movable pressure roller 130. The unit housing 142 is provided with paper entry and exit openings 142*b* and 142*c* for the paper P to pass through the roller unit 138. Openings 142*a* and 144*a* for inserting a cleaning felt block 146 are provided on the unit housing 142 and on the upper housing 144, and the cleaning felt block 146 is held in place by a swingable cover 148 (see FIG. 25). Vertical guide slots 142*d* for supporting the pressure roller 130 are formed on a lower portion of each lateral side of the housing 142.

Figure 31:
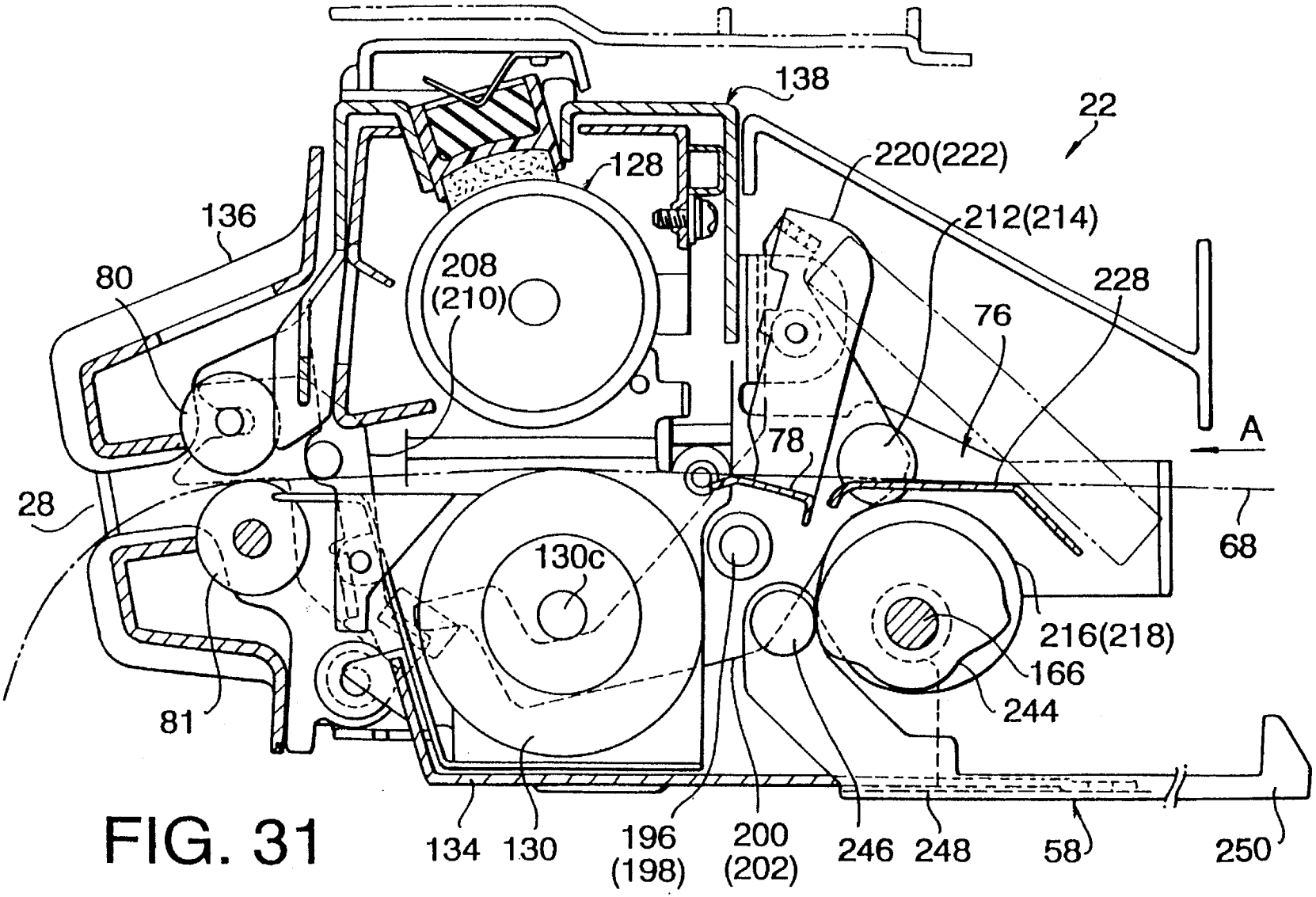
FIG. 31 shows a first state of a positioning mechanism for a discharge roller and the pressure roller.

As shown in FIG. 31, the heat roller 128 is positioned higher than the paper path 68. The upper ends of the guide slots 142*d* are open (see FIG. 24) to allow the pressure roller 130 to contact the heat roller 128, and the lower ends of the guide slots 142*d* are positioned such that an upper end of the pressure roller 130 is removed from the paper path 68 when the roller 130 is at the lower end of the guide slots 142*d*. The paper path 68 substantially leads directly into the nip of the discharge rollers 80 and 81.

As shown in FIG. 25, a separating plate 150, biased upwards by a spring (not shown), is provided on the roller unit 138 for separating heated paper P from the pressure roller 130 and for guiding the paper P into the discharge roller nip. A thermal fuse 152 for the heat source (halogen lamp) is placed in contact with the heat roller 128. Further, two thermistors (not shown) are placed in contact with the outer end of the heat roller 128.

The heat roller 128 and the press roller 130 must be periodically replaced due to wear. The detachable roller unit 138 allows the heat roller 128 and pressure roller 130 to be replaced as a unit; the detachable roller unit 138 is replaced instead of the individual rollers 128 and 130. Other unworn parts are not removed or replaced.

Figure 22:
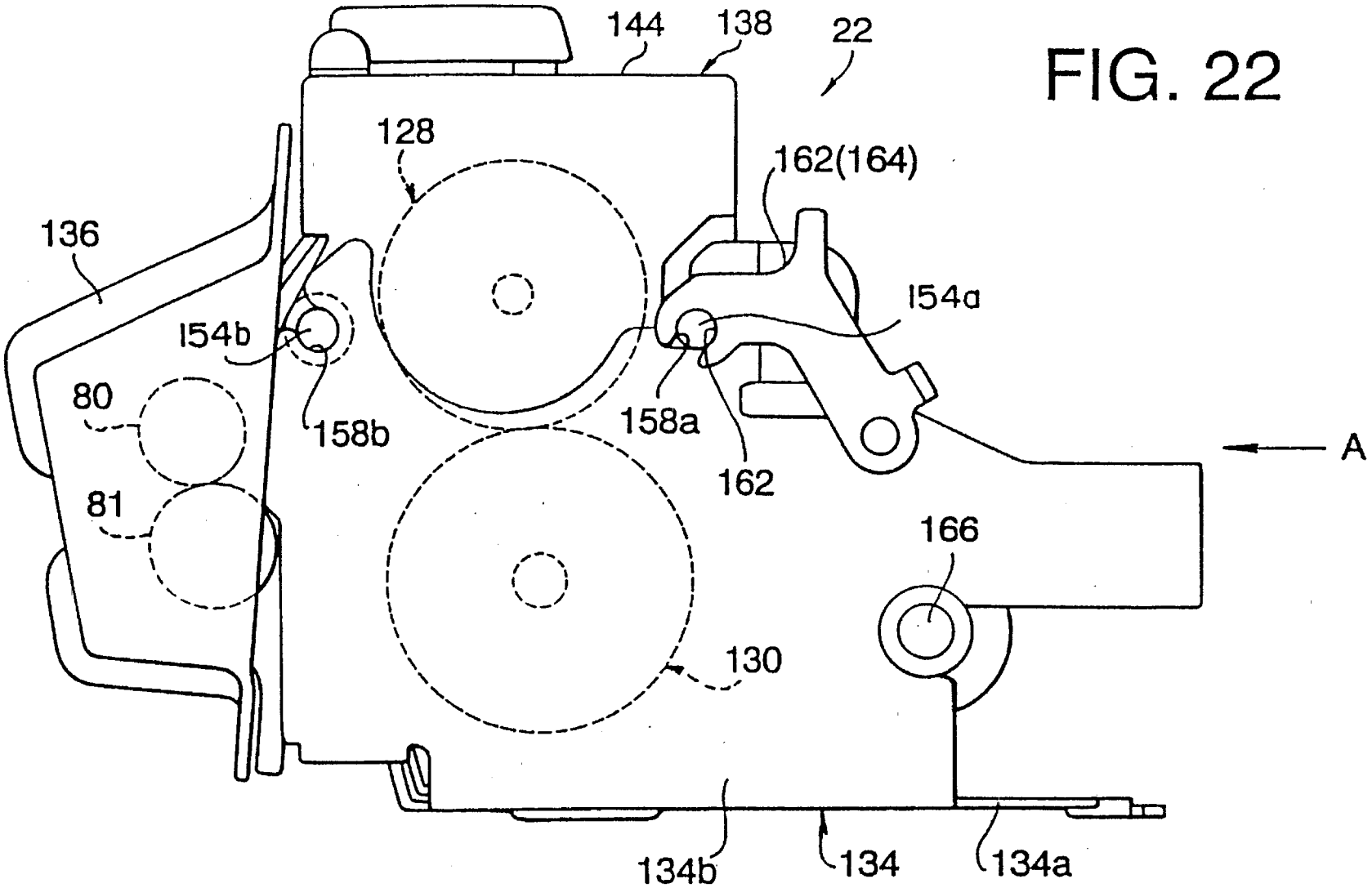
FIG. 22 is a side view of a fixing unit and surrounding components.

FIGS. 22 through 24 show a mechanism for detaching and attaching the roller unit 138 from and to the frame 134. As shown in FIGS. 22 and 24, fitting pins 154*a* and 154*b* are provided on one side of the unit housing 142 (on the opposite side of the housing 142, corresponding fitting pins 156*a* and 156*b* are symmetrically provided). FIGS. 26 and 27 show the left and right sides of the frame 134. Concave recesses 158*a* and 158*b*, are provided to the side plate 134*b* to hold the fitting pins 154*a* and 154*b*; similarly, concave recesses 160*a*, 160*b* are provided to the side plate 134*c* to hold the fitting pins 156*a* and 156*b*. The recesses 158*a*, 158*b*, 160*a* and 160*b* all open towards the downstream direction so that the unit housing 142 may be removed from the frame 134 by moving the housing in the direction A, as shown in FIGS. 22 and 26. The recesses 158*a*, 158*b*, 160*a*, and 160*b* are arranged such that portions of the frame 134 are directly above the centers of the fitting pins 154*a*, 154*b*, 156*a*, and 156*b*, so the unit housing 142 may not move upwards when the pins and recesses are engaged.

As shown in FIGS. 26 and 27, latches 162 and 164, rotatably supported by the side panels 134*b* and 134*c* respectively, may swing between an engaged position (shown by a solid line) and a released position (shown in FIG. 26 by a double-dotted line). The latches 162 and 164 have recesses 162*a* and 164*a* respectively, which engage fitting pins 154*a* and 156*a*. The recesses 162*a* and 164*a* of latches 162 and 164 are shaped such that when the latches 162 and 164 are engaged with the pins 154*a* and 156*a*, the unit housing 142 may not move horizontally in the direction A, as shown in FIGS. 26 and 27.

As described, by fitting the fitting pins 154*a*, 154*b*, 156*a*, and 156*b* into the recesses 158*a*, 158*b*, 160*a*, and 160*b*, and engaging the latches 162 and 164, the detachable roller unit 138 is attachable to and detachable from the frame 134 (FIG. 25 shows the detached unit 138, FIG. 22 shows the unit 138 when attached). When the detachable roller unit 138 is detached from the frame 134, electrical connections (not shown) are first unplugged, and the latches 162 and 164 are swung to release the fitting pins 154*a* and 156*a*. The unit 138 is moved horizontally to remove the pins 154*a*, 154*b*, 156*a*, and 156*b* from respective recesses 158*a*, 158*b*, 160*a*, and 160*b*, and the unit 138 is then lifted upwards. The roller unit 138 is therefore easily and quickly removable, and the rollers 128 and 130 may therefore be easily replaced. Furthermore, the mounting arrangement is stable, allowing a stable fixing operation.

F. Fixing Unit Mechanical Control

The fixing unit drive system 132 for driving the heat roller 128, the lower discharge roller 81, and a cam shaft 166 is shown in FIGS. 27 and 28. The cam shaft 166 rotates cams (described later) that move the transfer unit 44, a tension sensor 76, and a guide plate 78. As shown in FIG. 28, a drive gear 168 is coaxially secured to a motor shaft 86*a* of the fixing unit motor 86. The drive gear 168 engages a reduction gear 170 rotatably supported on the outer side of the right side panel 134*c*. The reduction gear 170 engages a fixing unit input gear 172, which further engages a heat roller input gear 174. The heat roller input gear engages a discharge roller idle gear 176, which further engages a discharge roller gear 178. The lower discharge roller 81 is coaxially secured to the discharge roller gear 178. When the roller unit 138 is attached, a driven heat roller gear 180 (FIG. 27). coaxially fixed to the shaft 128*c* of the heat roller 128, engages the heat roller gear 174.

The fixing unit input gear 172 also engages a cam shaft idle gear 184, which engages a cam gear 186. The cam gear 186 drives the cam shaft 166 via an electromagnetic clutch 182. The fixing unit motor 86 turns the fixing unit input gear 172 counterclockwise, ultimately driving the heat roller 128 (upper roller in facing rollers 128 and 130) counterclockwise and the lower discharge roller 81 clockwise. The rotation of the fixing unit motor does not drive the cam shaft 166 when the electromagnetic clutch 182 is OFF.

Figure 29:
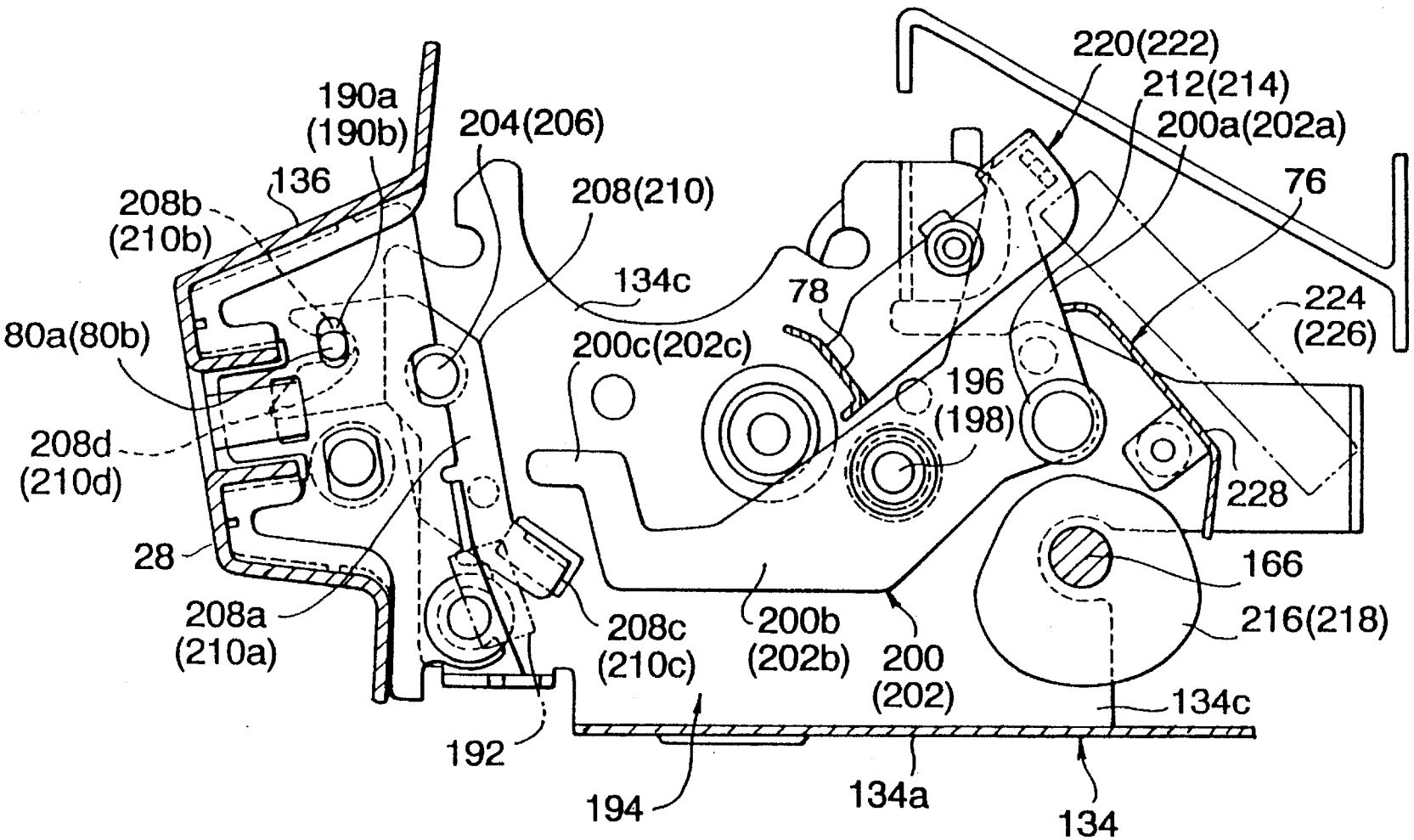
FIG. 29 is a side view of a structure for mounting a set of discharge rollers to a discharged paper cover, further showing a mechanism for moving a pressure roller and a discharge roller.
Figure 30:
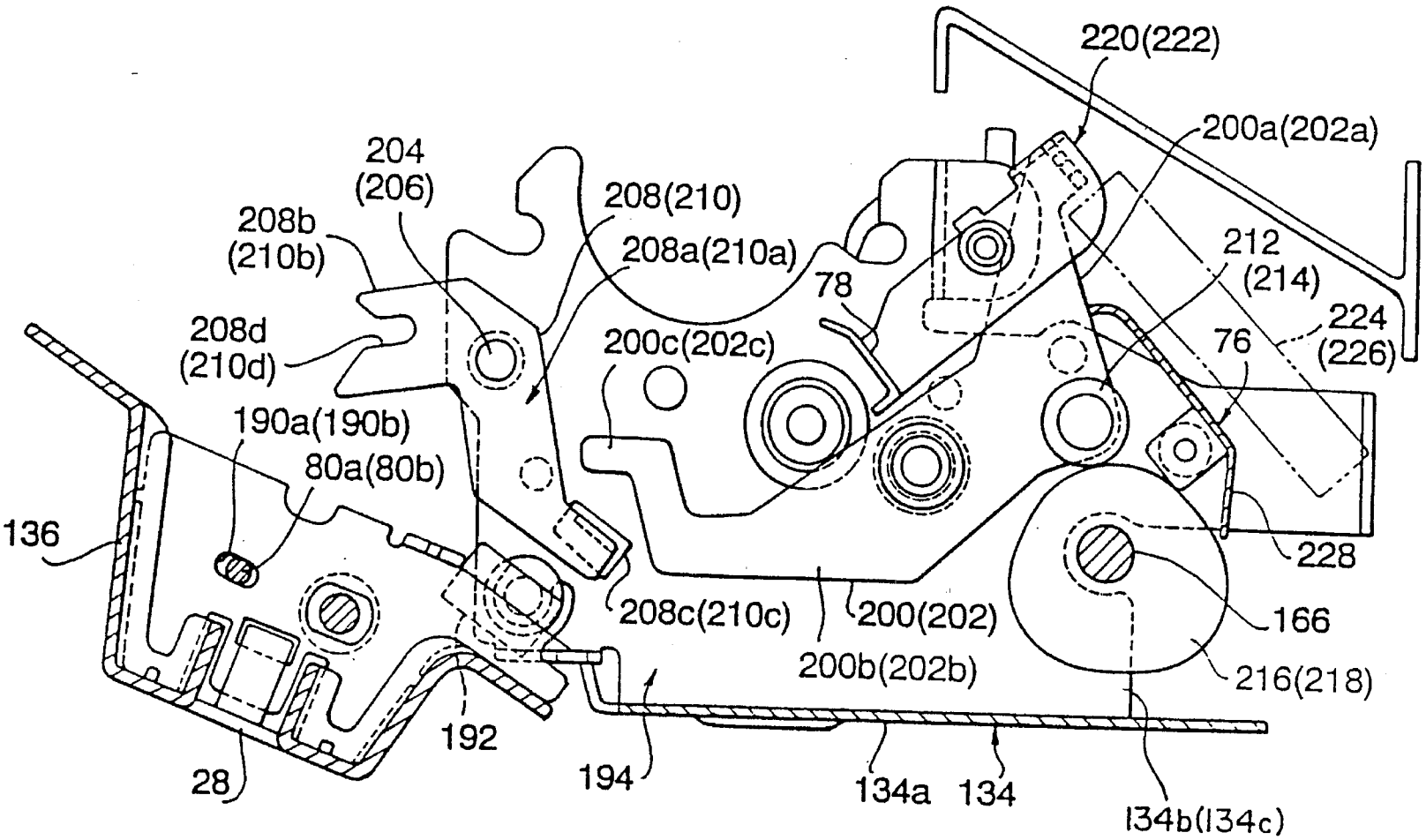
FIG. 30 shows a second position of the discharged paper cover.

A structure for mounting the discharge rollers 80 and 81 to the discharge area cover 136 is shown in FIGS. 27, 29 and 30. As shown in FIG. 27, the lower discharge roller 81 is rotatably arranged beneath the discharge area cover 136, and rotatably supported in the discharge area cover by end shafts 81*a* and 81*b*. The discharge roller gear 178 is coaxially fixed to the lower discharge roller 81, and is rotated by the fixing unit motor 86 by means of the discharge roller idle gear 176. The upper discharge roller 80 is rotatably mounted to the discharge area cover 136, and is vertically movable. As shown in FIGS. 29 and 30, vertical guide slots 190*a* and 190*b* for the shaft ends 80*a* and 80*b* of the upper discharge roller 80 are formed on the lateral sides of the discharge area cover 136. The upper discharge roller 80 contacts the paper P along the paper path 68 when the shaft ends 80*a* and 80*b* are located towards the lower ends of the slots 190*a* and 190*b*, and the upper discharge roller 80 is free of the paper P when the shaft ends 80*a* and 80*b* are at the upper end of the guide slots 190*a* and 190*b*. The discharge area cover 136 is resiliently attached to the rear of the frame 134 by means of a rotational biasing spring 192, which biases the cover 136 to move towards the frame 134. When the discharge area cover is attached to the frame 134, the nip of the discharge rollers 80 and 81 is in the paper path 68. As shown in FIG. 30, when the discharge area cover 136 is rotated away from the frame 134, the rear of the frame 134 is exposed and the discharge rollers 81 and 80 are moved downward and away from the frame 134.

A contacting mechanism 194 to contact the pressure roller 130 to the heat roller 128 and to contact the upper discharge roller 80 to the lower discharge roller 81 is shown in FIGS. 23, 29, and 30. As shown in FIG. 29, the mechanism 194 includes: first actuator levers 200 and 202, which are rotatably supported about shafts 196 and 198 inside the side panels 134*b* and 134*c* of the frame 134, for pushing the pressure roller 130 towards the heat roller 128, thereby driving the pressure roller 130; second actuator levers 208 and 210, rotatably supported about shafts 204 and 206 inside the panels 134*b* and 134*c*, for pushing the upper discharge roller 80 towards the lower discharge roller 81, thereby driving the upper discharge roller 80; and first cams 216 and 218 (also visible in FIG. 6), secured to the cam shaft 166 inside the side panels 134*b* and 134*c*, and contacting and guiding cam followers 212 and 214 mounted on the first actuator levers 200 and 202.

The first actuator levers 200 and 202 are substantially L-shaped, and include upright portions 200*a* and 202*a*, and horizontal portions 200*b* and 202*b*. The shafts 196 and 198 are positioned proximate to the middle of the horizontal portions 200*b* and 202*b*, and the first cam followers 212 and 214 are positioned approximately at the elbow of the L-shape. The actuator levers 200 and 202 are indirectly biased to rotate in a clockwise direction (as seen in FIG. 31) by springs 224 and 226, through guide plate levers 220 and 222. The angular positions of the actuator levers 200 and 202 about the shafts 196 and 198 are determined by the cams 216 and 218.

The shaft 130*c* of the pressure roller 130 (see FIG. 23) contacts an upper portion of the horizontal portions 200*b* and 202*b* of the first actuator levers 200 and 202. The first actuator levers 200 and 202 are therefore swingable between positions to make the pressure roller 130 separate from the heat roller 128 and to make the pressure roller 130 abut the heat roller 128, according to the contact of the first cam followers 212 and 214 and the first cams 216 and 218. The rotation of the cam shaft 166 by the fixing unit motor 86 moves the actuator levers 200 and 202 between retracted and contacting positions (contacting the pressure roller 130).

The first actuator levers include contact portions 200*c* and 202*c* that can contact lower ends of the second actuator levers 208 and 210. The second actuator levers are substantially L-shaped and rotatably supported at the elbow of the L-shape by the shafts 204 and 206. The second actuator levers include lever bodies 208*a* and 210*a*, upper portions 208*b* and 210*b*, and lower portions 208*c* and 210*c*. U-shaped grooves 208*d* and 210*d*, for receiving the shafts 80*a* and 80*b* of the upper discharge roller 80, are formed at distal ends of the upper portions 208*b* and 210*b*. The U-shaped grooves 208*d* and 210*d* accept the shafts 80*a* and 80*b* of the upper discharge roller 80 when the discharge area cover 136 is closed to the frame 134.

Figure 32:
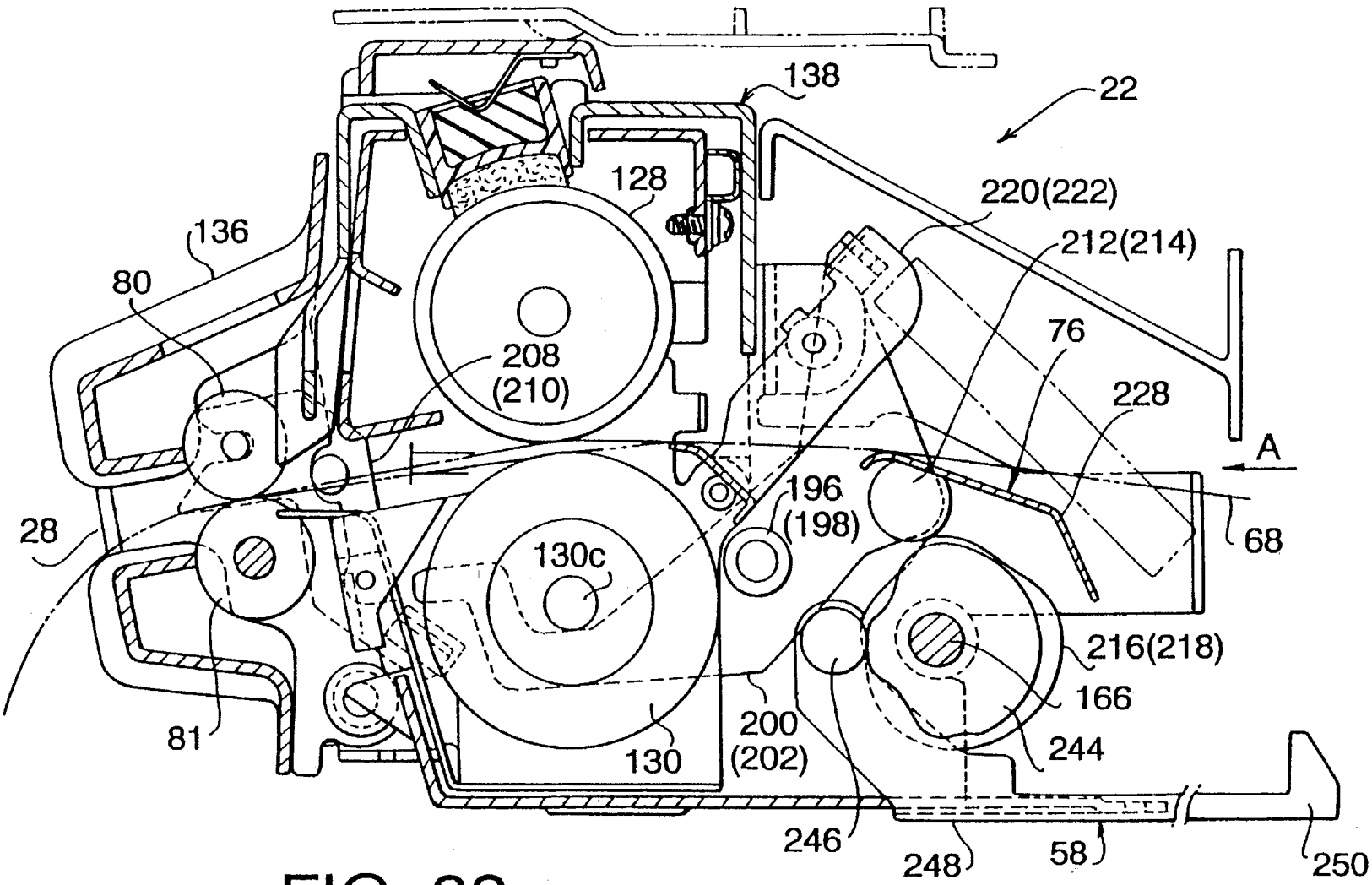
FIG. 32 shows a second state of the positioning mechanism.
Figure 33:
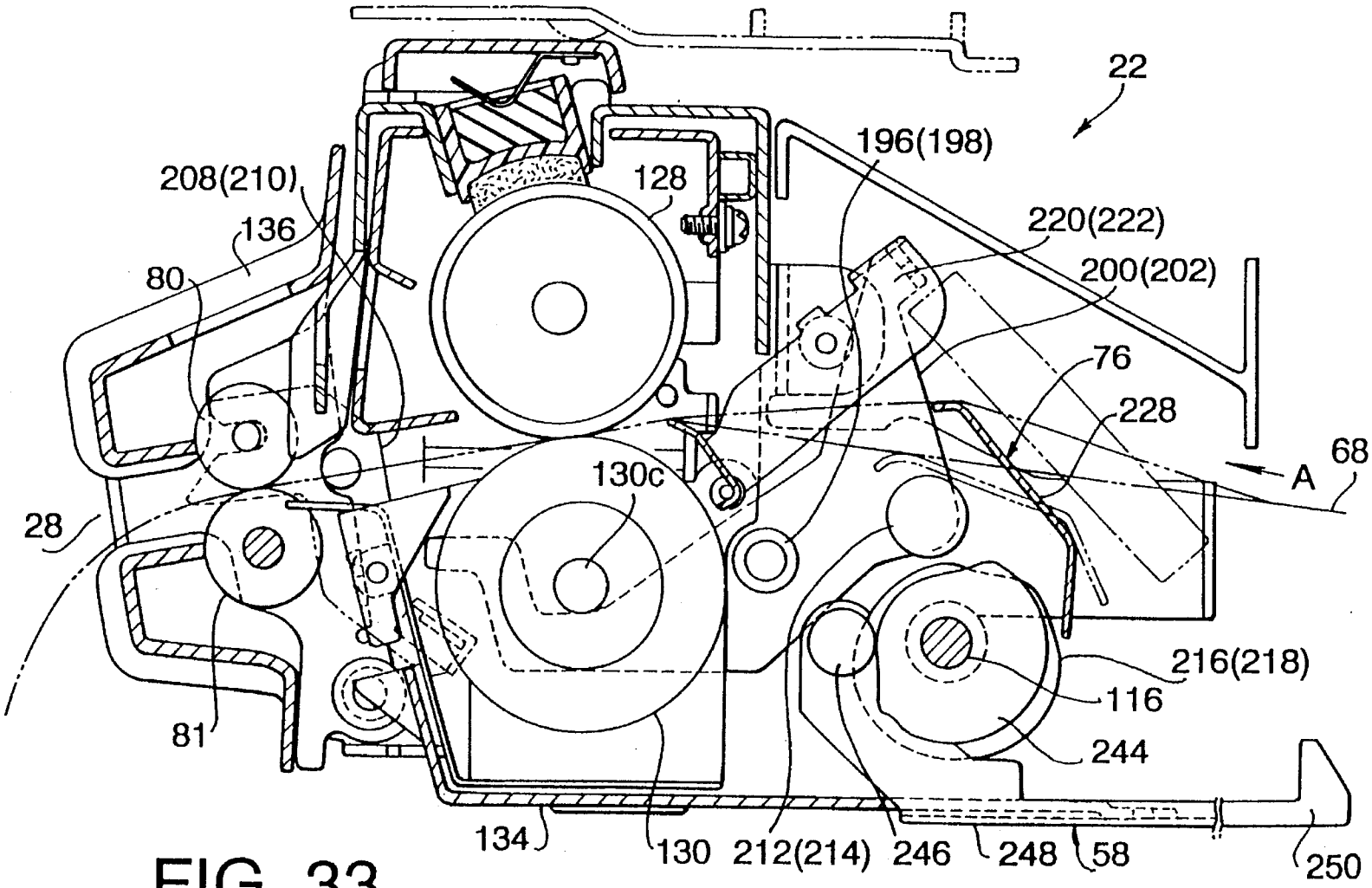
FIG. 33 shows a third state of the positioning mechanism.

When the second actuator levers 208 and 210 are not in contact with the first actuator levers, the upper discharge roller 80 abuts the lower discharge roller 81. When the first actuator levers 200 and 202 push the second actuator levers 208 and 210 at the lower portions 208*c* and 210*c*, the second actuator levers 208 and 210 rotate clockwise (as seen in FIG. 31), raising the upper discharge roller 80 away from the lower discharge roller 81. As shown in FIG. 32, when the first actuator levers 200 and 202 rotate to move the pressure roller 130 toward from the heat roller 128, the contact portions 200*c* and 202*c* move away from the second actuator levers 208 and 210, and the upper and lower discharge rollers 80 and 81 contact each other. In FIG. 33, when the pressure roller 130 makes contact with the heat roller 128, the upper discharge roller 80 remains in contact with the lower discharge roller 81.

As shown in FIG. 30, by opening the discharge area cover 136, the shafts 80*a* and 80*b* of the upper discharge roller leave the U-shaped grooves 208*d* and 210*d* of the second actuating levers 208 and 210. The discharge roller gear 178, coaxial with the lower discharge roller 81, is then released from the discharge roller idle gear 176 in FIG. 27.

The guide plate levers 220 and 222 are rotatably supported by the side panels 134*b* and 134*c* by means of the shafts 196 and 198 (FIG. 33). A guide plate 78 (FIG. 31) is fixed between the guide plate levers 220 and 222, and the guide plate 78 is movable to be substantially aligned with the top of the press roller 130.

As shown in FIGS. 35 through 37 and 38(*a*) through 38(*e*), a tension sensor 76, for detecting the tension of the paper P, is arranged between the tractor unit 74 and the fixing unit 22. The rotational speed of the heat roller 128 is controlled by maintaining constant tension as measured by the tension sensor 76.

Figure 34:
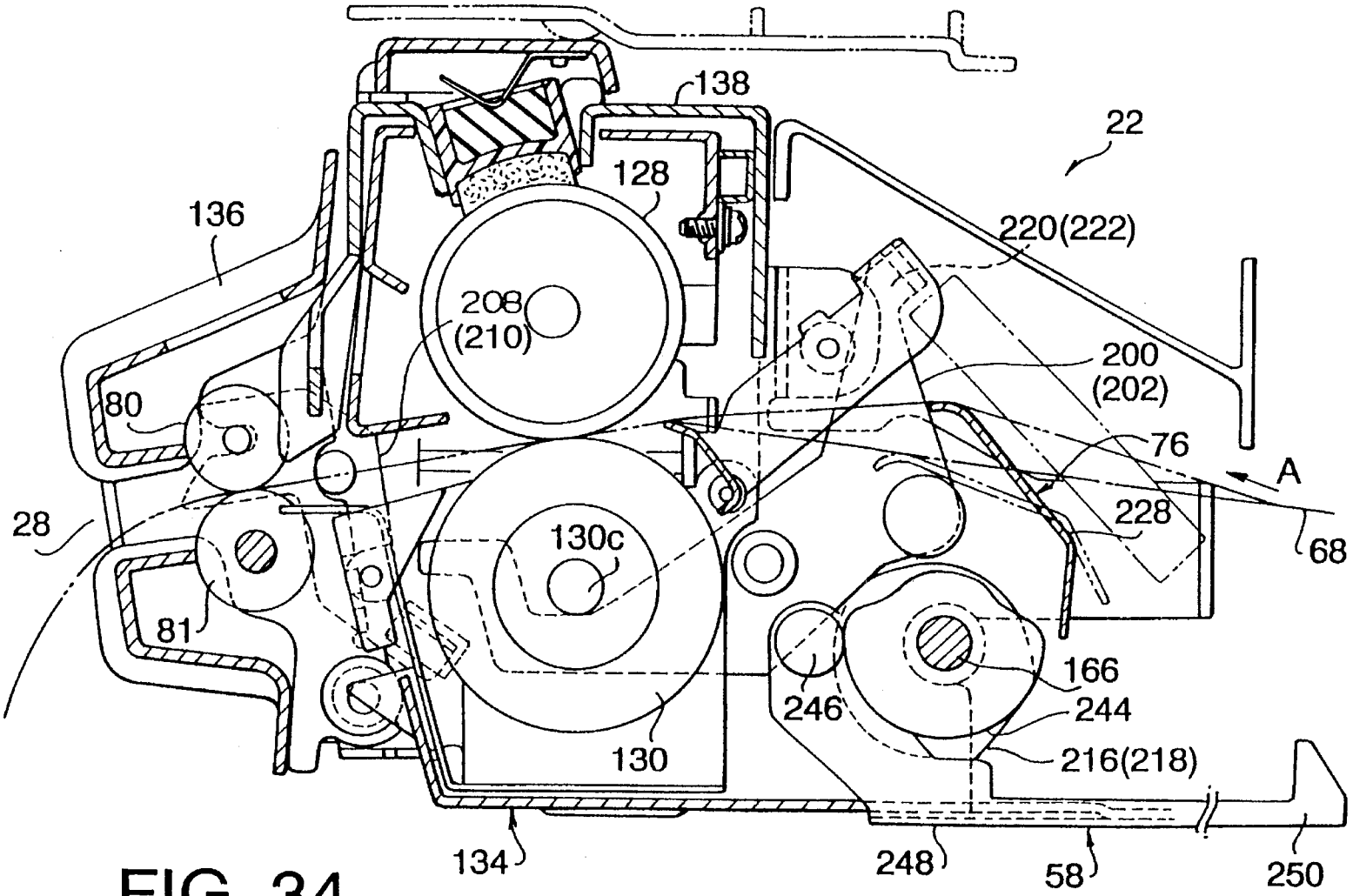
FIG. 34 shows a fourth state of the positioning mechanism.

As shown in FIG. 34, the tension plate 228 of the tension sensor 76 projects into the paper path 68. Shown in detail in FIGS. 37 through 39, the tension sensor includes: the tension plate 228, arranged to rotate in proportion to the tension of the paper P; support pins 230*a* and 230*b* for rotatably supporting the tension plate 228; a cam follower 232 mounted below the center of the tension plate 228, and a barrier arm 234 for interrupting photo-interruptor sensors 238 and 240.

Figure 35:
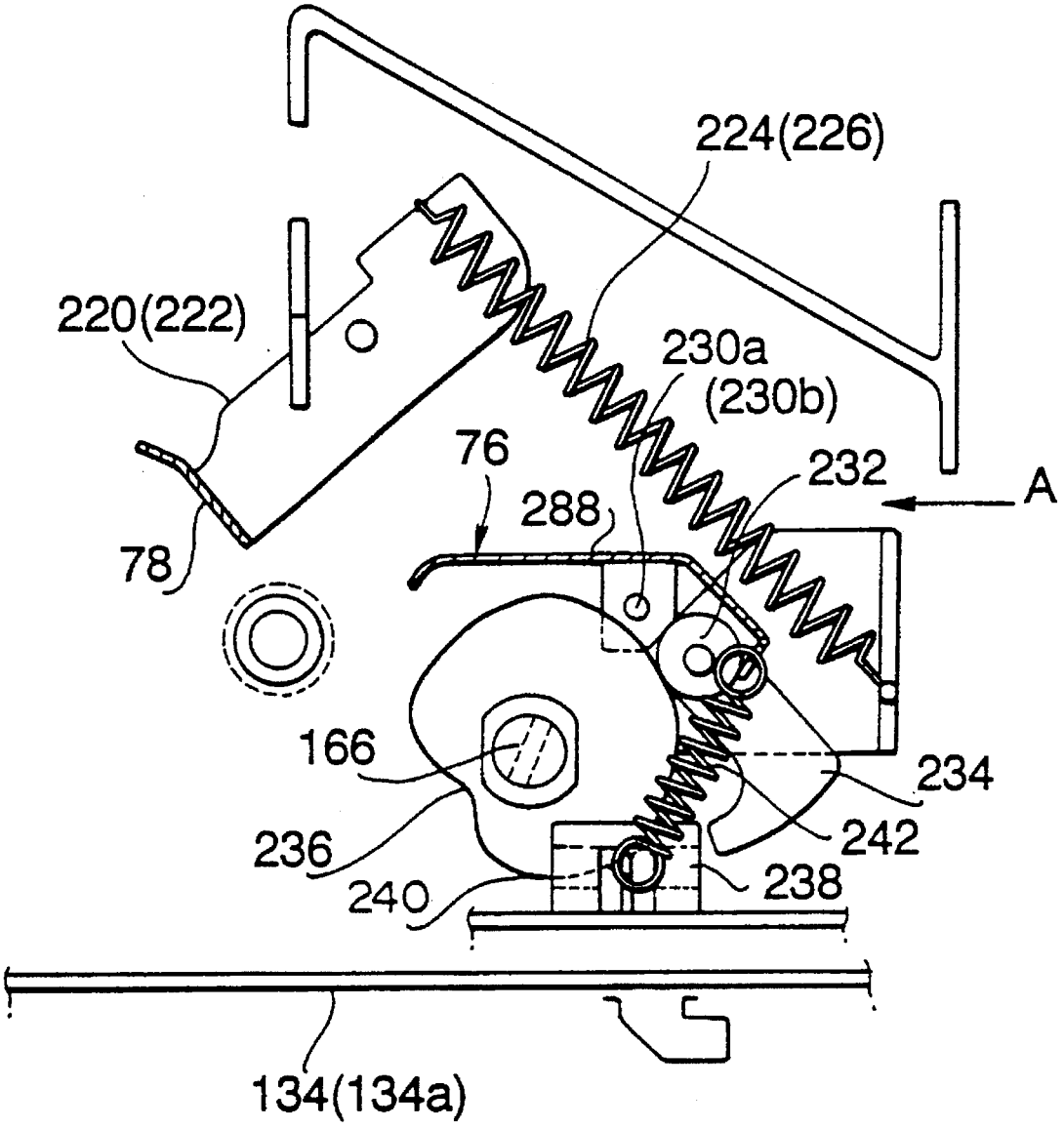
FIG. 35 is a side view of a tension sensor.
Figure 36:
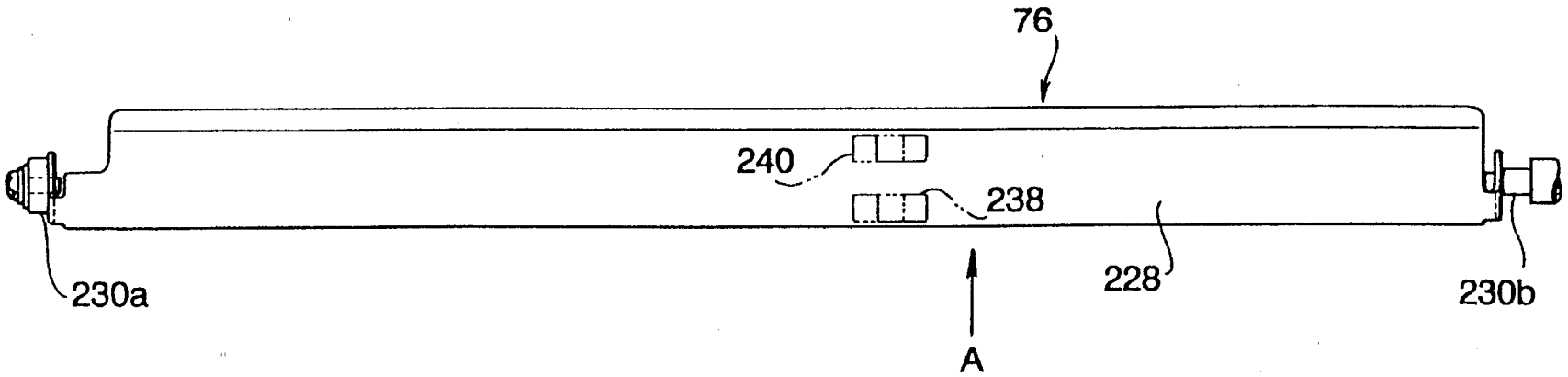
FIG. 36 is a top view of the tension sensor.
Figure 37:
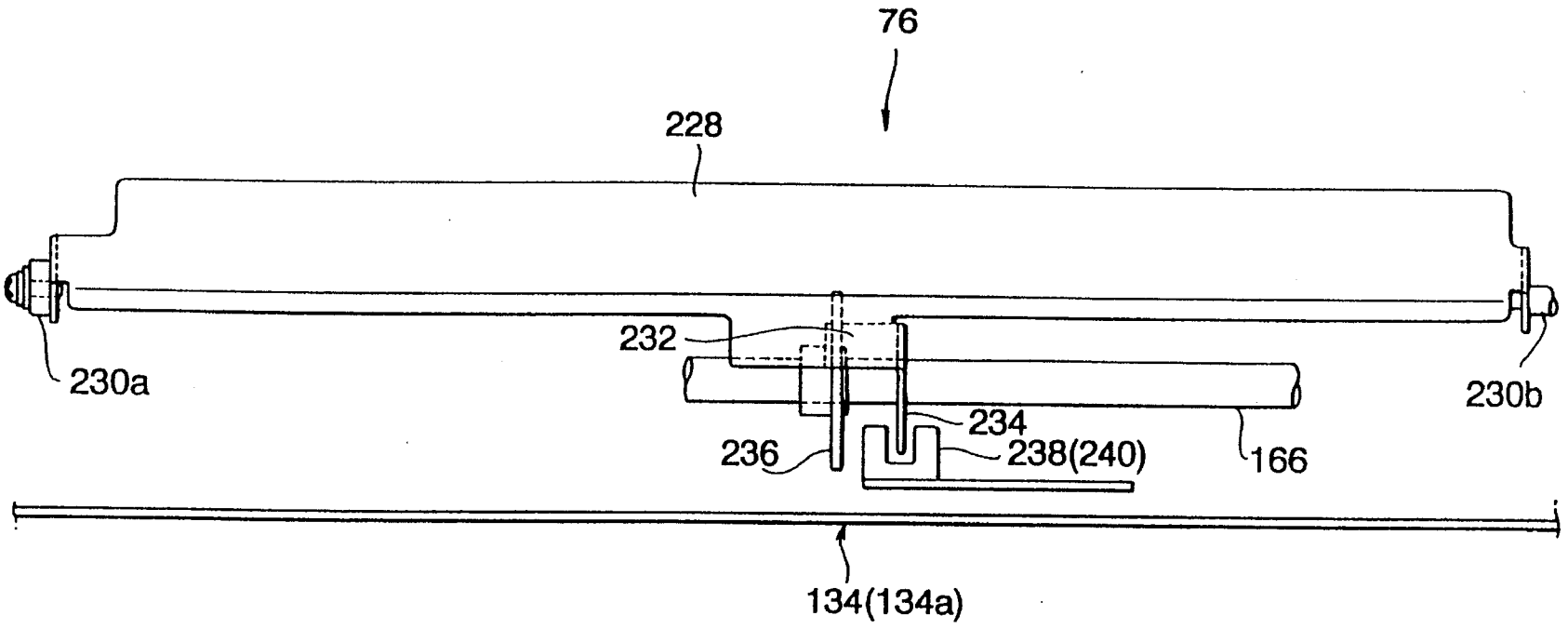
FIG. 37 is a front view of the tension sensor.

As shown in FIG. 35, the tension sensor 76 further includes: a second cam 236; the first and second photo-interruptor sensors 238 and 240, for detecting the barrier arm 234 according to the position of the tension plate 228; and a spring 242, for forcing the tension plate 228 in a direction such that the cam follower 232 contacts the second cam 236.

Figures 38A, 38B, 38C, 38D, 38E:
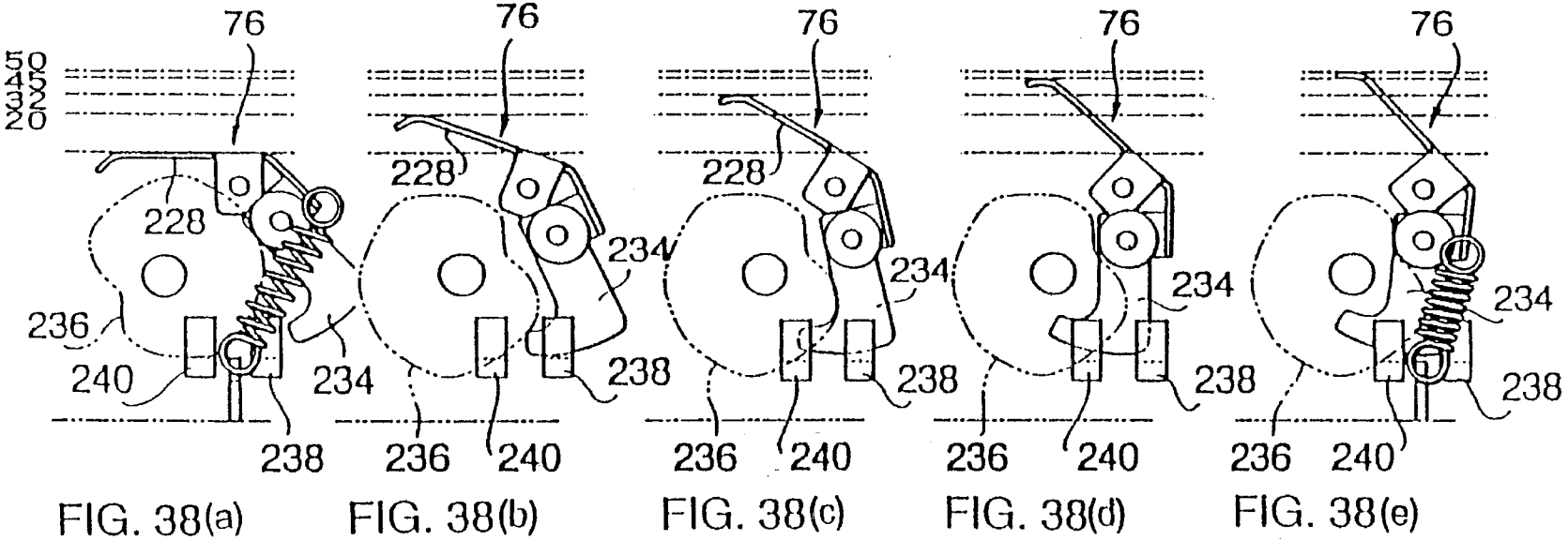
FIG. 38(*a*) through FIG. 38(*e*) show various positions of the tension sensor.

In FIG. 38(*a*), when the pressure roller 130 is separated from the heat roller 128, the cam follower 232 contacts the second cam 236 at the largest radial displacement of the cam 236 surface, at which point the tension plate 228 becomes level and is substantially withdrawn from the paper path 68. When the pressure roller 130 is brought up to meet the heat roller 128 as shown in FIG. 38(*b*), the second cam 236 has rotated to a region of small radial displacement of the cam 236 surface, the cam follower 232 is therefore free, and the tension plate 228 may move into the paper path 68. The range of possible positions of the tension sensor 76 and paper path 68 (depending on the paper P tension) when the pressure roller 130 and heat roller 128 are in contact is shown in FIGS. 38(*b*) through 38(*d*).

The tension plate 228 is movable between a "DOWN" position (FIG. 38(*b*)), defined by the bottom of a range of positions of the paper path 68, through a "MID" position (FIG. 38(*c*) defined by the optimum position of the paper path 68, to an "UP" position (FIG. 38(*d*)) defined by the top of the range of positions of the paper path 68. The first and second detecting sensors 238 and 240 are provided to detect the position of the tension plate 228. The sensors 238 and 240 are conventional photo-interruptor sensors, each having a light emitting portion and a photodetector. Each of the sensors 238 and 240 generates an OFF signal when interrupted by the barrier arm 234 and an ON signal when uninterrupted by the barrier arm 234.

When the tension plate 228 is in the DOWN position as shown in FIG. 38(*b*), the barrier arm 234 turns OFF the first sensor 238 and the second sensor 240 remains ON. When the tension plate is in the MID position as shown in FIG. 38(*c*), both sensors 238 and 240 are turned OFF by the barrier arm 234. In the UP position, shown in FIG. 38(*d*), the second sensor 240 is turned OFF by the barrier arm 234 and the first sensor 238 is ON. The outputs of the first and second photo-interruptor sensors 238 and 240 together represent a tension signal S3, having UP (ON-OFF), MID (OFF-OFF), and DOWN (OFF-ON) values. The tension signal S3 is monitored by the controller 24.

A transfer unit retracting mechanism 58 for moving the transfer unit 44 appears in FIGS. 6 and 31 through 34. The transfer unit retracting mechanism includes: a third cam 244 fixed to the cam shaft 166; a connection arm 248 having a cam follower 246 connecting the cam 244; and a transfer unit retractor 250 formed at the end of the connection arm 248 that can engage an engagement pin 56 (shown in FIGS. 2 and 3).

When the pressure roller 130 is separated from the heat roller 128 (FIG. 31), the cam follower 246 contacts the second cam 236 at a large radial displacement of the cam 236 surface, at which point the transfer unit retractor 250 is pulls the pin 56. The transfer unit 44 is thereby rotated around the axis 48 and moved away from the drum 16 against the bias of the spring 52 (FIG. 3). When the pressure roller 130 makes contact with the heat roller 128, the third cam 244 has rotated to a region of small radial displacement of the cam 244 surface, and the transfer unit retractor 250 allows the pin 56 to move. The transfer unit 44 is thereby brought close to the drum 16 (FIG. 2).

Thus, the transfer unit 44 is moved towards and away from the drum 16, from an operating position to a retracted position, in synchronization with the movement of the upper discharge roller 80 and pressure roller 130, and according to the guiding motion of the third cam 244 attached to the cam shaft 166.

In order to detect the rotational position of the cam shaft 166, a pressure roller position (PRP) sensor 252 is provided (shown in FIGS. 23 and 39), and includes 4 interruptor members (2531 through 2534) provided about the circumference of the cam shaft 166, and a photo-interruptor sensor for detecting the interruptor members. The PRP sensor 252 is OFF when the photo-interruptor is interrupted by any of the interruptor members, and ON when not interrupted. The PRP sensor 252 is connected to the controller 24, which switches off the electromagnetic clutch 182 to stop driving the cam shaft 166 when the signal from the PRP sensor 252 turns ON.

The first interruptor member 2531 turns OFF the PRP sensor 252 when the cam shaft 166 beings rotating from the fully retracted position (of the pressure roller 130 with reference to contact with the heat roller 128) of FIG. 31 and turns ON the PRP sensor when the cam shaft 166 rotates to the semi-retracted position (of the pressure roller 130 with reference to contact with the heat roller 128) of FIG. 32. The second interruptor member 2532 turns OFF the PRP sensor 252 when the cam shaft 166 begins rotating from the half-separated position of FIG. 32 and turns on the PRP sensor when the cam shaft 166 rotates to the contact position (of the pressure roller 130 with reference to contact with the heat roller 128) shown in FIG. 35. The third interruptor member 2533 turns OFF the PRP sensor 252 when the cam shaft begins rotating from the contact position of FIG. 33 and turns ON the PRP sensor 252 when the cam shaft 166 rotates to the contact position (of the pressure roller 130 with reference to contact with the heat roller 128) shown in FIG. 34. The fourth interruptor member 2534 turns OFF the PRP sensor 252 when the cam shaft begins rotating from the contact position of FIG. 34 and turns ON when the cam shaft 166 rotates to the fully retracted position shown in FIG. 31.

The motions resulting from the rotation of the cam shaft 166 appear in FIGS. 31 to 34, including motion of the pressure roller 130, the upper discharge roller 80, the guide plate 78, and the tension plate 228.

The electromagnetic clutch 182 turns ON when the fixing unit motor 86 is driven, rotating the cam shaft 166, and thereby moving the pressure roller 130 and upper discharge roller 80 vertically (in opposite directions) away from the facing heat roller 128 and lower discharge roller 81 respectively, and away from the paper P. Simultaneously, the transfer unit 44 is retracted from the paper path 68 by the transfer unit retractor, and the guide plate 78 and the tension plate 228 are kept level. Thus, before a printing operation, the paper path 68 is almost linear as it passes the tension plate 228, the guide plate 78, the top of the pressure roller 130, and the bottom of the discharge roller 81.

When printing is started, the heat roller 128 and the lower discharge roller 81 begin to rotate. However, at this point, the rollers 128 and 81 are separated from the paper path 68 and therefore do not affect the paper P. As shown in FIG. 33, while the heat roller 128 is separated from the pressure roller 130, the electromagnetic clutch 182 receives an ON signal from the controller 24, and the fixing unit motor 86 drives the cam shaft 166 until the first interruptor member 2531 turns OFF the PRP sensor 252.

In FIG. 32, when the cam shaft 166 is stopped by controller 24 based on the signal from the PRP sensor 252, the pressure roller 130 is half-separated from the heat roller, but the upper discharge roller 80 contacts the lower discharge roller. At this point, the tension plate 228 and the guide plate 78 are substantially halfway to their respective operating positions, and the transfer unit 44 has been moved into the operating position.

At the condition shown in FIG. 32, the electromagnetic clutch receives an ON signal from the controller 24, and the cam shaft 166 is rotated, turning the heat roller 128 and the lower discharge roller 81 until the second interruptor member 2532 generates an OFF at the PRP sensor 252. As the discharge rollers 80 and 81 are in contact with the paper P, the paper P is carried by the rollers 80 and 81 and the heat roller 128 does not contact the paper P. When the cam shaft 166 stops (FIG. 33), the pressure roller 130 contacts the heat roller 128, the upper discharge roller 80 remains in contact with the lower discharge roller 81, and the tension plate 288 and the guide plate 78 are in their operating positions. The paper P is thereafter driven by the heat roller 128. As the tension plate 228 and the guide plate 78 are fully interposed into the paper path 68, the paper path 68 is bent in an inverted V-shape.

In FIG. 33, the electromagnetic clutch 182 receives an ON signal from the controller 24, and the cam shaft 166 is again rotated until the controller 24 receives an OFF signal when the third interruptor member 2533 interrupts the PRP sensor 252. When the cam shaft 166 stops (FIG. 34), the pressure roller is still in contact with the heat roller 128, but the transfer unit 44 has been retracted from the paper path 68.

In FIG. 34, when the electromagnetic clutch 182 receives an ON signal from the controller 24, the cam shaft 166 is again rotated until the fourth interruptor member 2534 turns OFF the PRP sensor 252 (FIG. 33). Thus, a complete cycle of the motion of the pressure roller 130, the upper discharge roller, the guide plate 78, the tension plate 228 and the transfer unit 44 is controlled by the cam shaft 166 and associated cams 244, 216, and 218.

G. Tractor Feed Control Process

Figure 39:
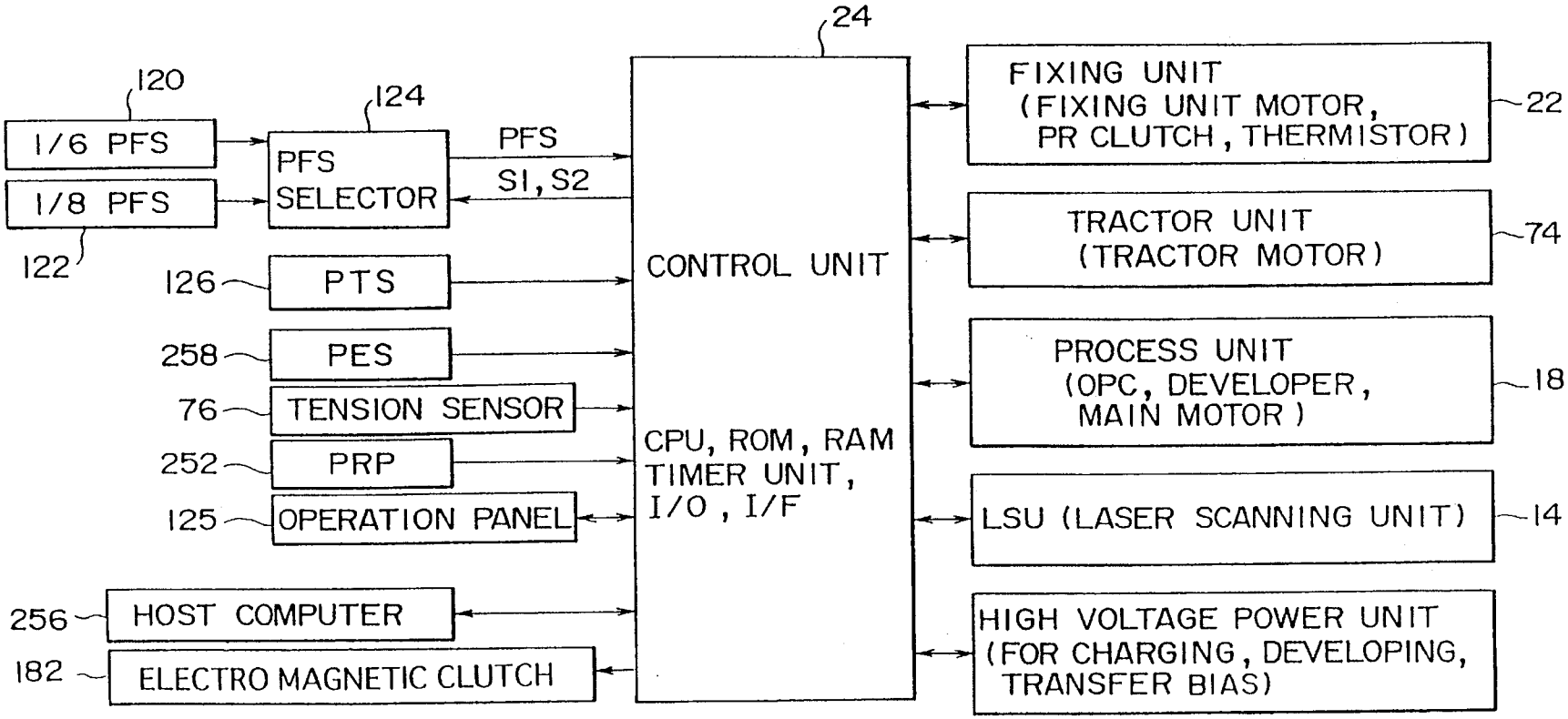
FIG. 39 is a block diagram of a controller and associated components of the continuous form printer.

The controller for the printer 10 appears in a block diagram in FIG. 39. The controller 24 is connected to: the laser scanning unit (LSU) 14, the process unit 18, the fixing unit 22, actuators for the tractor unit 74, an operation panel 125 for inputs such as feeding interval (corresponding to the selected PFS), a high voltage power supply for charging the charging unit 40 and the transfer unit 44, the electromagnetic clutch 182, the pressure roller position (PRP) sensor 252, the tension sensor 76, a paper top sensor 126, a paper empty sensor (PES) 258, and the PFS selector 124. The controller 24 further receives printing data and information from a host computer 256.

As shown in FIGS. 7 and 11, the paper top sensor 126 is mounted on the center portion of the bottom plate **92*a* of the tractor frame 92. As shown in FIGS. 9 and 11, the paper top sensor 126 includes an actuator 126*a* and a sensor body 126*b*. The paper top sensor 126 generates an OFF signal when the actuator 126 projects into the paper path 68, and generates an ON signal when the actuator 126*a* is pushed below the paper path 68 by the paper P. The control unit 24 monitors the paper top sensor 126**.

Figure 40:
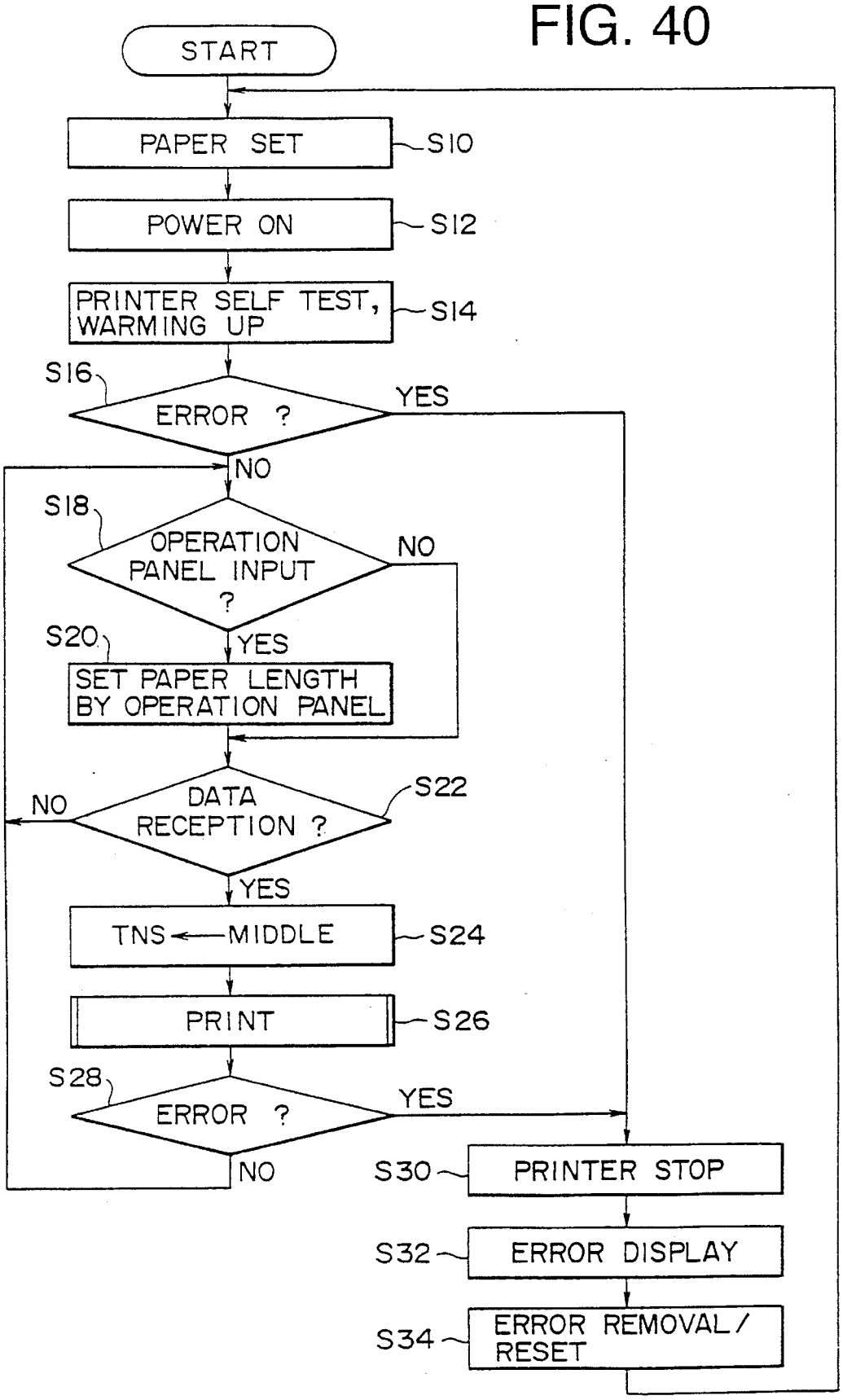
FIG. 40 is a flow chart showing a main control routine of the continuous form printer.

A process for controlling printing by the printer 10 by the controller 24 is shown in FIGS. 40 through 48. A main routine for printing operations is shown in FIG. 40.

Starting at step S10, the paper P is inserted in the opening 26 and is brought along the paper path 68 to the tractor unit 74, where the feed holes Pa of the paper P are aligned with the projections 941 and 961 of the tractors 94 and 96, with the upper covers **94*j* and 96*j* open. The upper covers 94*j* and 96*j* are then shut, and the paper setting is complete. In step S12, the power is supplied to the printer 10. In step S14, the controller performs a series of self-check operations, including: memory checks, a check of a polygonal mirror unit, a laser diode (LD) check and level synchro check in the LSU 14, a toner check, and a warm-up process that waits until the heat roller 128 is at operating temperature. The controller 24 then performs an error check, to check for paper empty, toner empty or the like. If an error is found in step S16, the printer is stopped (S30), the operation panel 125 displays the error condition (S32), and after the error is corrected (S34), the controller returns to the beginning of the process at step S10**.

If no error is detected at step S16, the controller 24 proceeds to step S18, where a check for paper length data from the operation panel 125 is made. If no input is found, the paper length is set of 11 inches and the feeding interval is set to ½ inch in step S18, and the flow proceeds to step S22. If an input is found at step S18, the paper length and feeding interval are taken from the operation panel 125 in step S20.

Step S22 loops back through step S18 until printing data is received from the host computer 256. After printing data is received in step S22, a variable TNS, representing paper tension and described later, is set to "MID" (S24). The print operation (step S26, described later as the printing subroutine) then begins. After the printing subroutine at step S26 is complete, the printer makes an error check (identical to step S16) at step S28, and proceeds to step S30 or step S18 (in an identical fashion to step S16) based on the error status.

Figure 41:
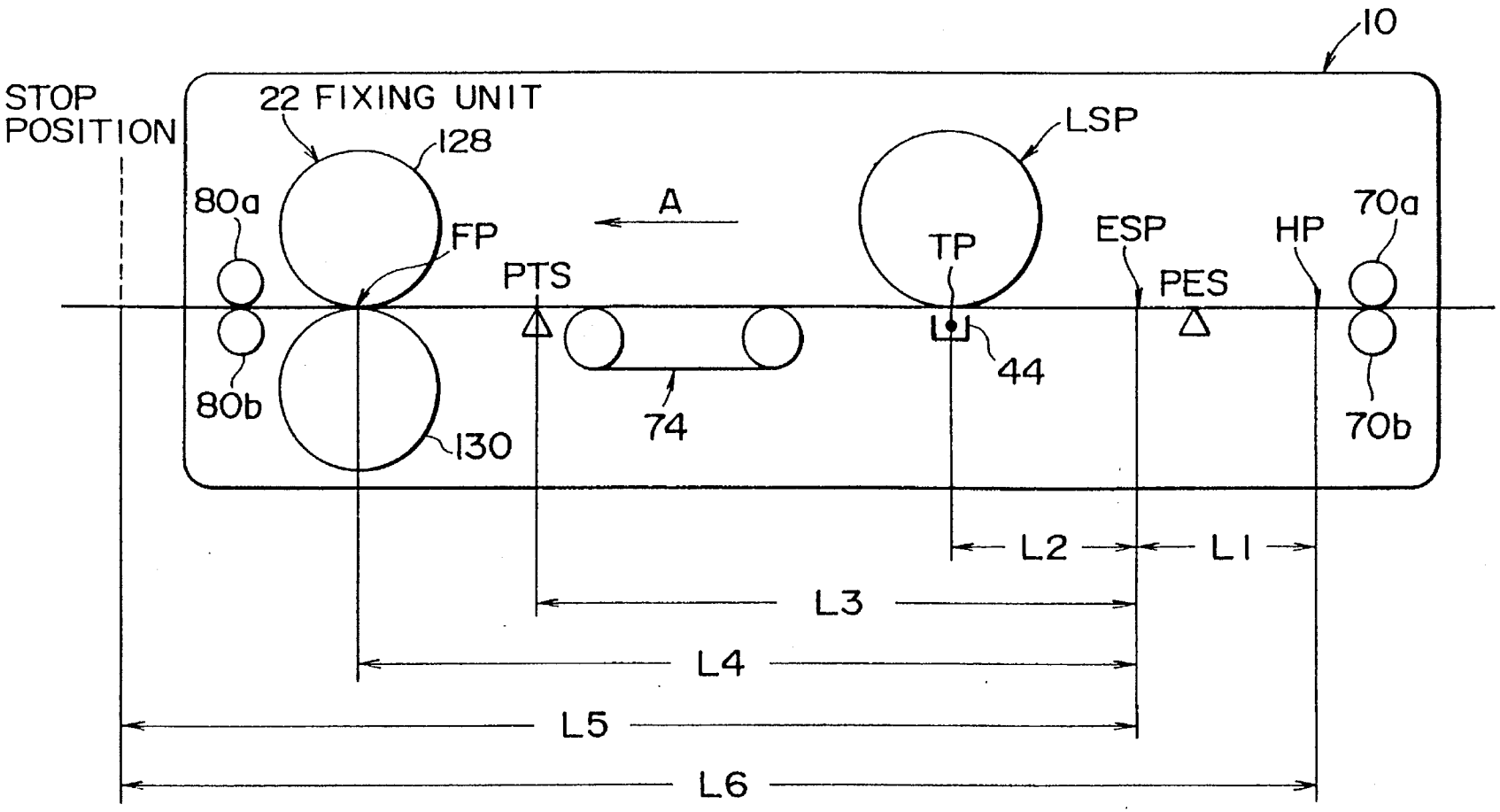
FIG. 41 is a schematic showing sensor and control positions along a paper path of the printer.
Figure 42:
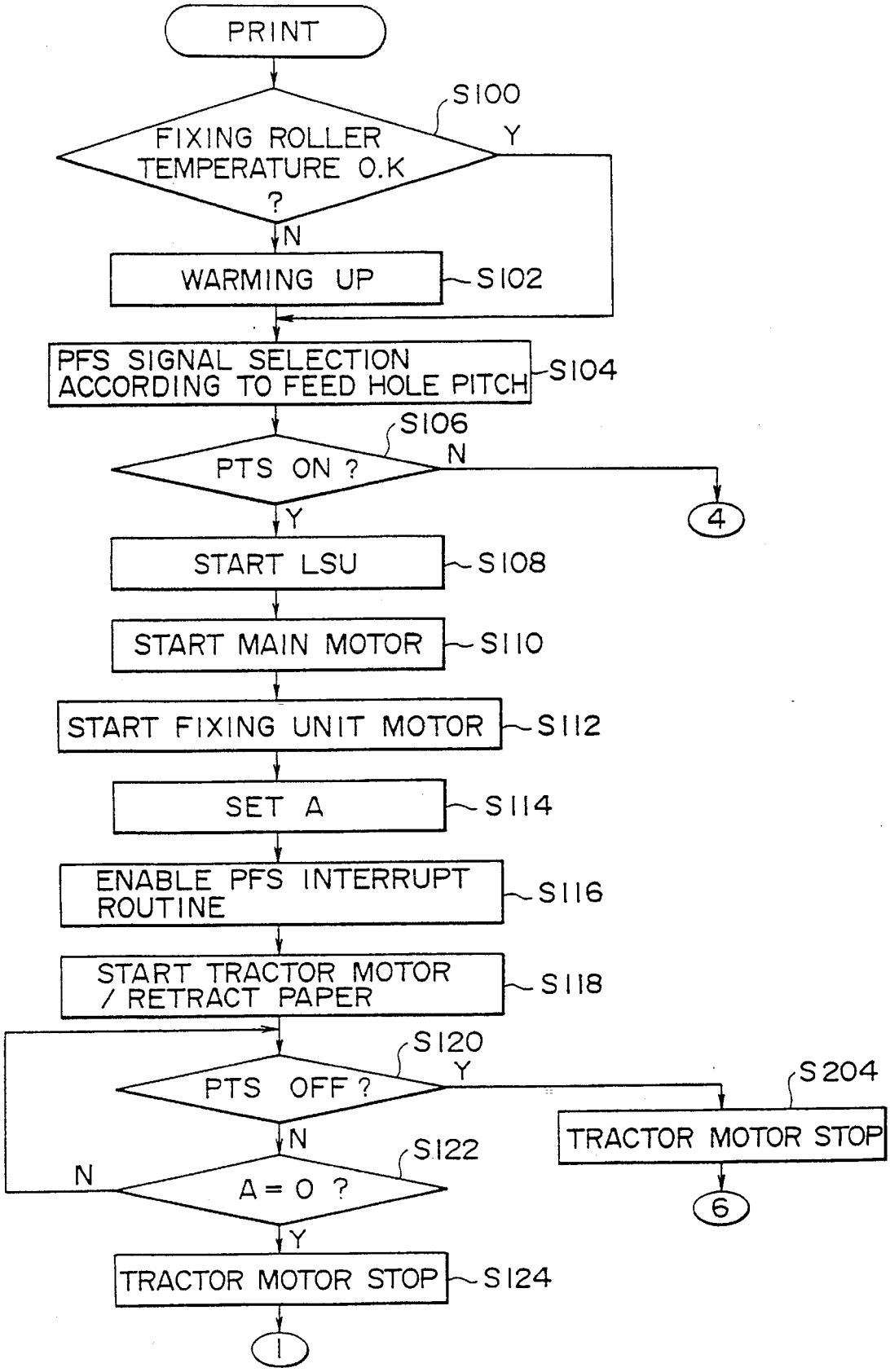
FIG. 42 is a flow chart showing a first part of a printing control process.

FIG. 41 shows the length parameters used by the control process described herein. Various positions are defined along the paper path 68. A transfer position TP is defined as the position between the drum 16 and the transfer unit 44. A home position HP is defined as a position between the paper empty sensor PES and the back tension rollers 70*a* and 70*b*. A laser scanning position LSP is defined on the drum 16 at the location where the LSU 14 scans the drum 16. An exposure start position ESP is defined as a position, along the paper path 68, spaced upstream of the transfer position TP by the same distance as the circumferential distance from the transfer position TP to the laser scanning position LSP, along the surface of the drum 16. A fixing position FP is defined at the nip of the rollers 128 and 130. A paper top sensor 126 position PTS is defined between the tractor unit 74 and the fixing unit 22. The paper top sensor 126 senses the leading edge of a sheet, defined at the last separated perforations between sheets of the fanfold paper P. Lastly, a STOP position is defined at a predetermined distance outside the printer 10 body and outlet 28. Six predetermined intervals along the paper path 68 are defined in the printer 10, including: interval L1 between the home position HP and the exposure start position ESP; interval L2 between ESP and the transfer position TP; interval L3 between ESP and the paper top sensor 126 position PTS; interval L4 between ESP and the fixing position FP; interval L5 between ESP and STOP; and interval L6 between the home position HP and STOP.

The printing operation subroutine of step S26 in FIG. 40 appears in detail in FIGS. 42 through 49. At the beginning of the subroutine in FIG. 42, the controller 24 checks the heat roller 128 in step S100 by means of the thermistors in contact with the heat roller 128, to determine if the roller 128 is hot enough for satisfactory fixing. If the roller 128 is not hot enough, the controller calls a warm-up operation (S102) which activates the heating means (halogen lamp) until the roller 128 is heated to a fixing temperature. Otherwise, the controller 24 proceeds directly to step S104, where a PFS signal is selected according to the paper length and feeding interval (corresponding to the selected PFS) set in the main routine step S18 or S20. If no data is available from the operation panel 125 regarding the paper length, the paper length is set to 11 inches.

If the feeding interval is set to ½ inch, an L level signal is sent by the control lines S1 and S2 to the control switch 124*f* of the PFS selector 124, so that the output terminal 124*e* of the PFS selector 124 outputs the ½" PFS. If the feeding interval is set to ⅙ inch, an H level signal is sent to the control line S1 and an L level signal is sent to the control line S2 so that the output terminal 124*e* outputs ⅙" PFS. If the feeding interval is set to ⅛ inch, an L level signal is sent to the control line S1 and an H level signal is sent to the control line S2 so that the output terminal 124*e* outputs ⅛ PFS.

The controller 24 then checks the paper top sensor 126 at step S106. If the paper top sensor 126 is OFF in step S106, it indicates that the paper P set in the tractor unit 74 has reached the paper top sensor 126. In this case, the top set operation (FIG. 46, described later) is initiated. If the paper top sensor 126 is ON in step S106, it indicates that the paper P set in the tractor unit 74 has not yet reached the paper top sensor 126, and the controller proceeds to step S108.

In step S108 through S112, the controller 24 starts the laser scanning unit (LSU) 14, the main motor for driving the process unit 18, and the fixing unit motor for driving the fixing unit 22. A PFS counter A is then set according to the predetermined interval L6 and the feeding interval (corresponding to the selected PFS) at step S114. The counter A is set according to:

$$A \leftarrow L6 \div m \tag{1}$$

where m=2 for ½" PFS, 6 for ⅙" PFS, and 8 for ⅛" PFS.

After the PFS counter A is set, a PFS interrupt process (FIG. 47, described later) is enabled in step S116. The PFS interrupt process interrupts a running process and performs a decrement by 1 of counter A (and other counters) every time the PFS sensor 124 sends a PFS pulse to the controller 24. The tractor motor 84 is then driven in reverse to retract the paper P in step S118. The controller 24 then loops through a check of the paper top sensor 126 and the counter A until either the paper top sensor 126 is OFF or A reaches zero, checking the paper top sensor 126 first (S120, S122). If the paper top sensor 126 turns OFF before the counter A reaches zero, it indicates that the last printed page has been separated from the fanfold paper P, and that the leading edge of the current page defines the next blank page to be printed. At this point, the tractor motor 84 is stopped (S204) and a semi-top set operation (similar to the top set operation, and entering the top set operation shown in FIG. 46 at the point labeled "6") is performed.

If the PFS counter A reaches zero before the top sensor 126 is turned OFF, it indicates that the printed page has not been separated, and that the printed page has been pulled back into the printer 10. In this case, the tractor motor 84 is stopped (S124), and the controller proceeds to print the following page as described in FIG. 43.

Figure 43:
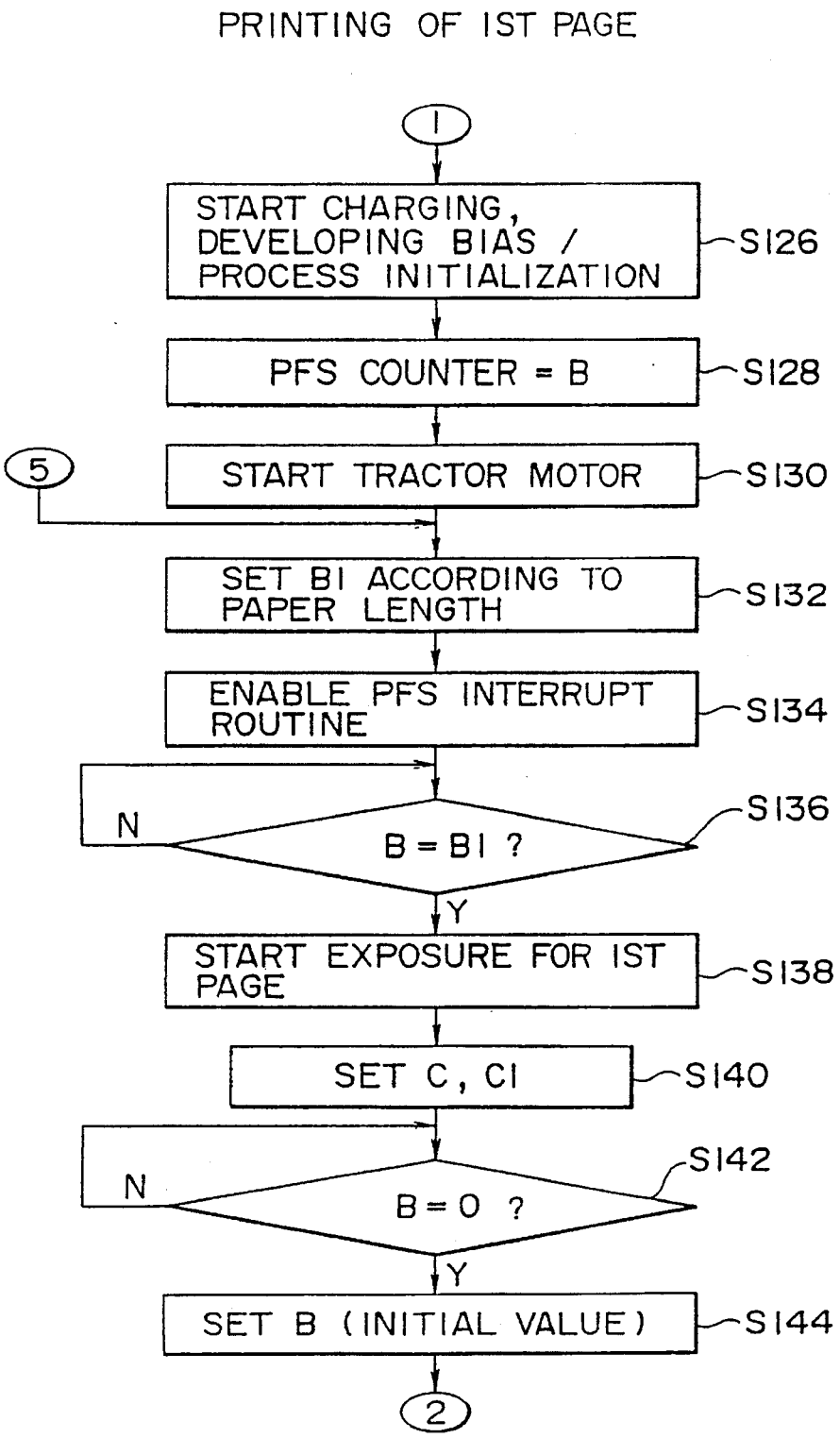
FIG. 43 is a flow chart showing a second part of the printing control process.

As shown in FIG. 43, a bias voltage is then applied to the charging unit 40 and the developer 42, and the process unit 18 is initialized (S126). The PFS counter B is then set to a value based on the predetermined interval from the home position HP to the transfer position TP (L1+L2) and the feeding interval (corresponding to the selected PFS) (S128), according to:

$$B \leftarrow (L1+L2) \div m \tag{2}$$

where m is as previously defined.

After B has been set, the controller 24 rotates the tractor motor 84 to transport the paper P (S130). A PFS count target B1 is then set based on the interval from the exposure start position ESP to the transfer position TP (L2) and the feeding interval (corresponding to the selected PFS), according to:

$$B1 \leftarrow L2 \div m \tag{3}$$

where m is as previously defined.

After B1 has been set, the PFS interrupt process is enabled (S134), decrementing B for every detection of a pulse from the PFS selector 124 (S134). When the PFS counter B reaches B1 (S136), indicating that the leading perforations Pb of the first page to print have reached the exposure starting position ESP, the controller 24 starts the laser scanning unit (LSU) 14 and the LSU 14 begins scanning a latent image onto the surface of the photoconductive drum 16 (S138) at the laser scanning point LSP. The latent image becomes a toner image on the drum 16 as it passes the processing unit 18.

At this point, the PFS counter C is set to a value based on the predetermined interval L4 from the exposure starting position ESP to the fixing position FP (L4) and the feeding interval (corresponding to the selected PFS), and further sets a PFS count target C1 (S140) according to:

$$C \leftarrow L4 \div m \quad (4)$$

and $$C1 = (\text{value in } C) - (L2 \div m) \quad (5)$$

where m is as previously defined.

When the PFS counter B reaches zero (S142), indicating that the leading perforations Pb of the page to be printed have reached the transfer position TP, the controller 24 energizes the transfer unit 44 to begin transferring the toner image on the drum 16 to the paper P. Following step S142, the PFS counter B is reset based on the paper P length as set (per sheet) and the feeding interval (corresponding to the selected PFS) (S144), according to:

$$B \leftarrow (\text{page length}) \div m \quad (6)$$

where m is as previously defined.

Figure 44:
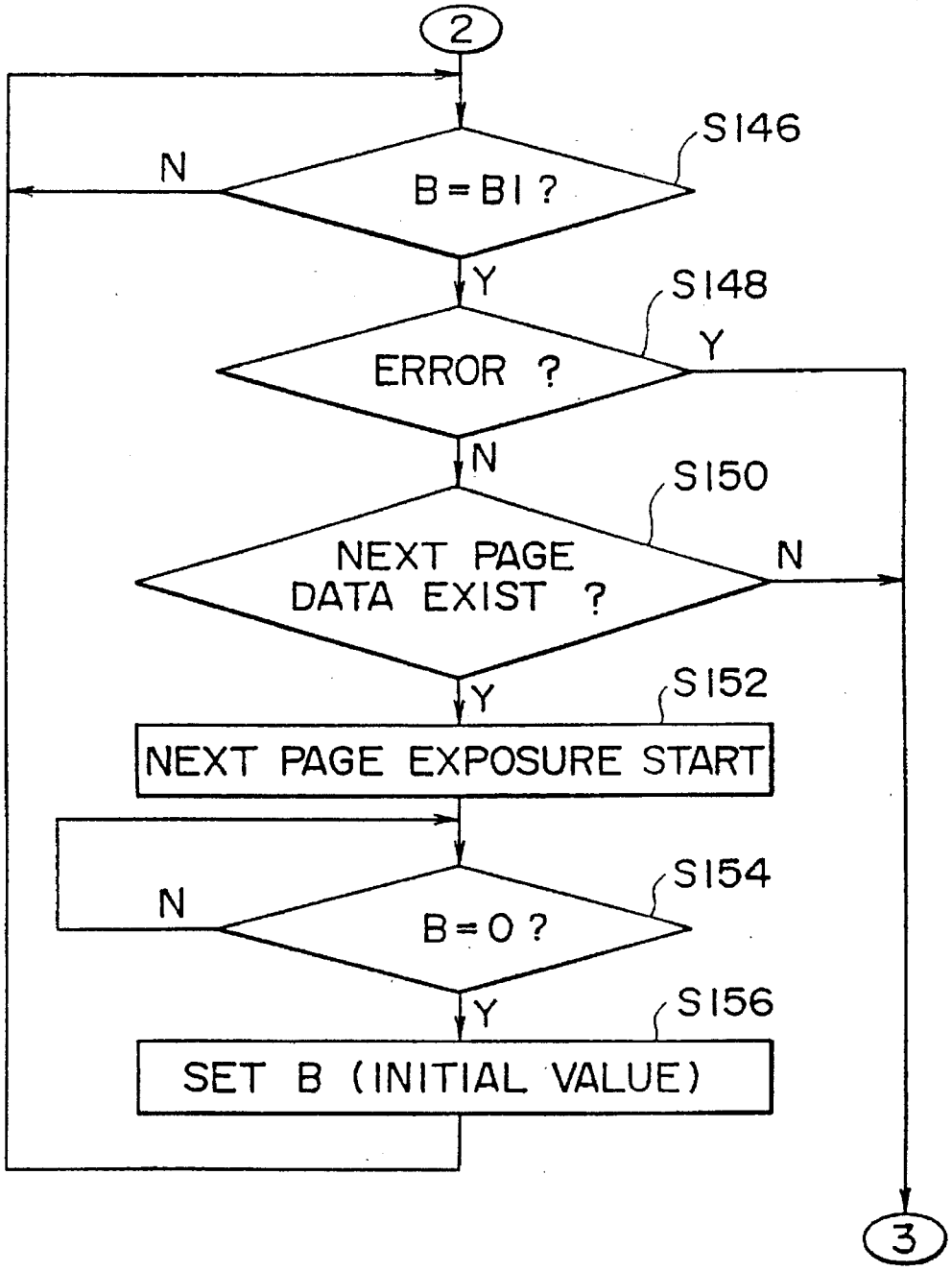
FIG. 44 is a flow chart showing a third part of the printing control process.
Figure 45:
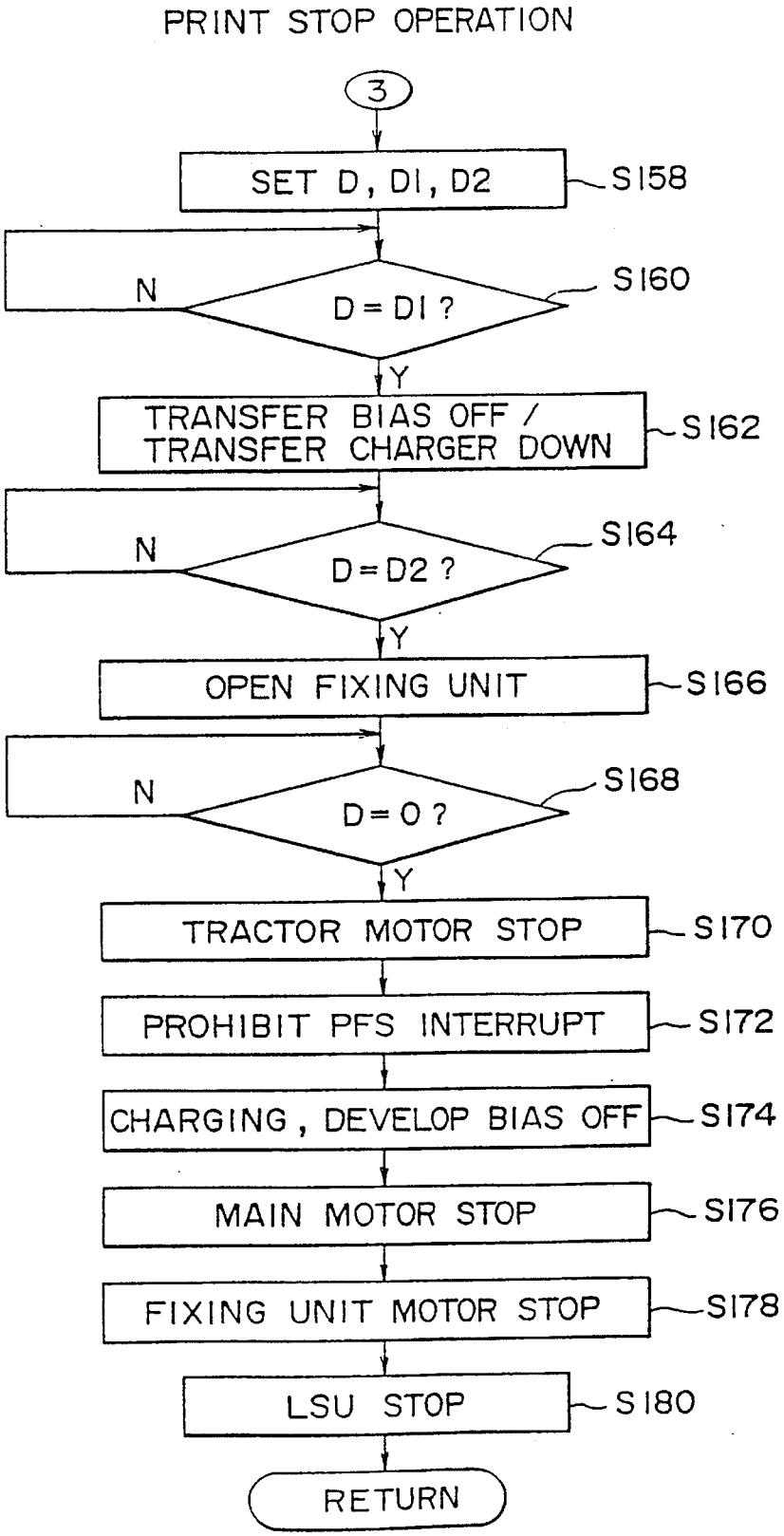
FIG. 45 is a flow chart showing a fourth part of the printing control process.

In step 144, the leading edge of the next page to be printed is defined. Continuous printing of successive pages is begun in FIG. 44. As shown in FIG. 44, when the PFS counter reaches B1 (S146), indicating that the perforations Pb of the next page have reached the exposure starting position ESP, an error check is performed (S148). If an error is detected, for example "toner out", "paper empty", or "no printing data" type errors (S150), the controller 24 proceeds to the print stop process (FIG. 45).

If no error is detected at step S148 or step S150, the controller 24 proceeds to expose the next latent image on the drum 16 and continues the printing process. At step S154, the PFS counter B is again reset based on the paper P length (per sheet) and the feeding interval (corresponding to the selected PFS), according to formula (6) as previously defined. In step S156, the leading edge of the page following the next page is defined, and the steps S145 through S156 are then repeated until no more printing data exists at step S150 (or until an error is detected at step S148), whereupon the controller proceeds to the print stop process as shown in FIG. 45.

Figure 47:
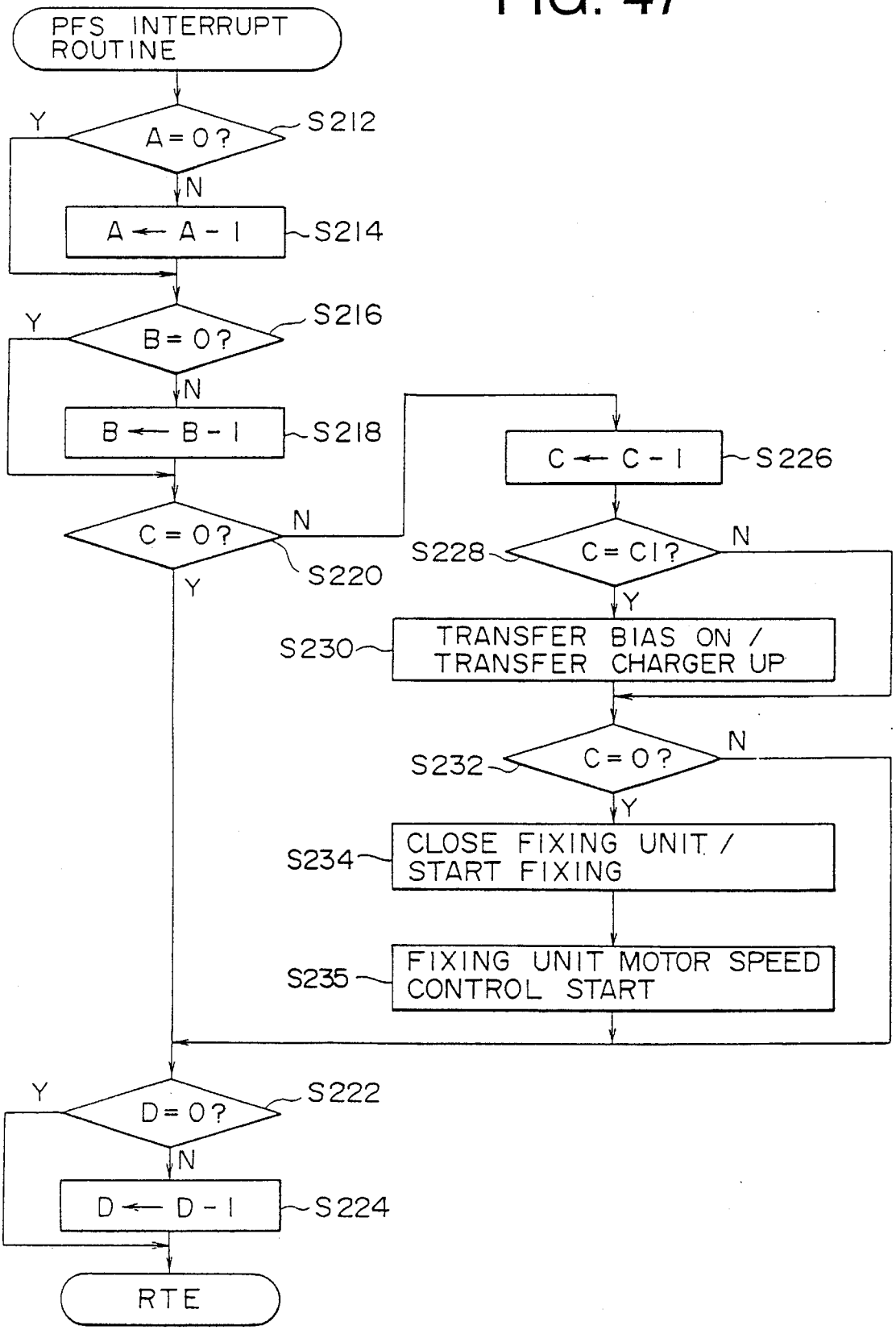
FIG. 47 is a flow chart showing a pulse feed signal interrupt process.

During the print stop process, the PFS interrupt process of FIG. 47 continues to decrement the counter D (and other counters) for every PFS pulse received by the controller 24 from the PFS selector 124. As shown in FIG. 45, the print stop process is initialized by setting: a PFS counter D to a value based on the predetermined interval from the exposure start position ESP to the STOP position (L5); a PFS count target D1 to a value obtained by subtracting the value in D from the PFS count generated between the exposure start position ESP to the paper top position TP; and a PFS target count D2 to a value obtained by subtracting the value in D from the PFS count generated between the exposure start position ESP to the fixing position FP, according to:

$$D \leftarrow L5 \div m \quad (7)$$

$$D1 = (\text{value in } D) - (L2 \div m) \quad (8)$$

$$D2 = (\text{value in } D) - (L4 + m) \quad (9)$$

where m is as previously defined.

When the PFS counter D value reaches the PFS target value D1 (S160), indicating that the leading perforations Pb defining the last printed page have reached the transfer portion TP, the controller 24 stops the bias voltage to the transfer unit 44, and retracts the transfer unit 44 from the drum 16 (S162). When the PFS counter D value reaches D2 (S164), indicating that the perforations Pb defining the last printed page has reached the fixing position FP, the controller 24 stops the fixing operation and moves the press roller 130 away from the heat roller 128 (S166). When the PFS counter D value reaches zero (step S168), indicating that the perforations Pb defining the last printed position have reached the STOP position outside the printer 10, the controller 24 then: stops the tractor motor 84 (S170); prohibits the PFS interrupt process (S172); removes the biasing voltage from the charging unit 40 and the developing unit 42 (S174); stops the main motor 82 driving the process unit 18 (S176); stops the fixing unit motor 86 driving the fixing unit 22 (S178); and stops the laser scanning unit (LSU) 14 (S180), completing the subroutine and returning to the main routine.

The controller 24 controls the elements of the printer 10 so that the perforations Pb of the last printed page reach the STOP position outside the printer 10 so that the operator may check or separate the last printed page.

Figure 46:
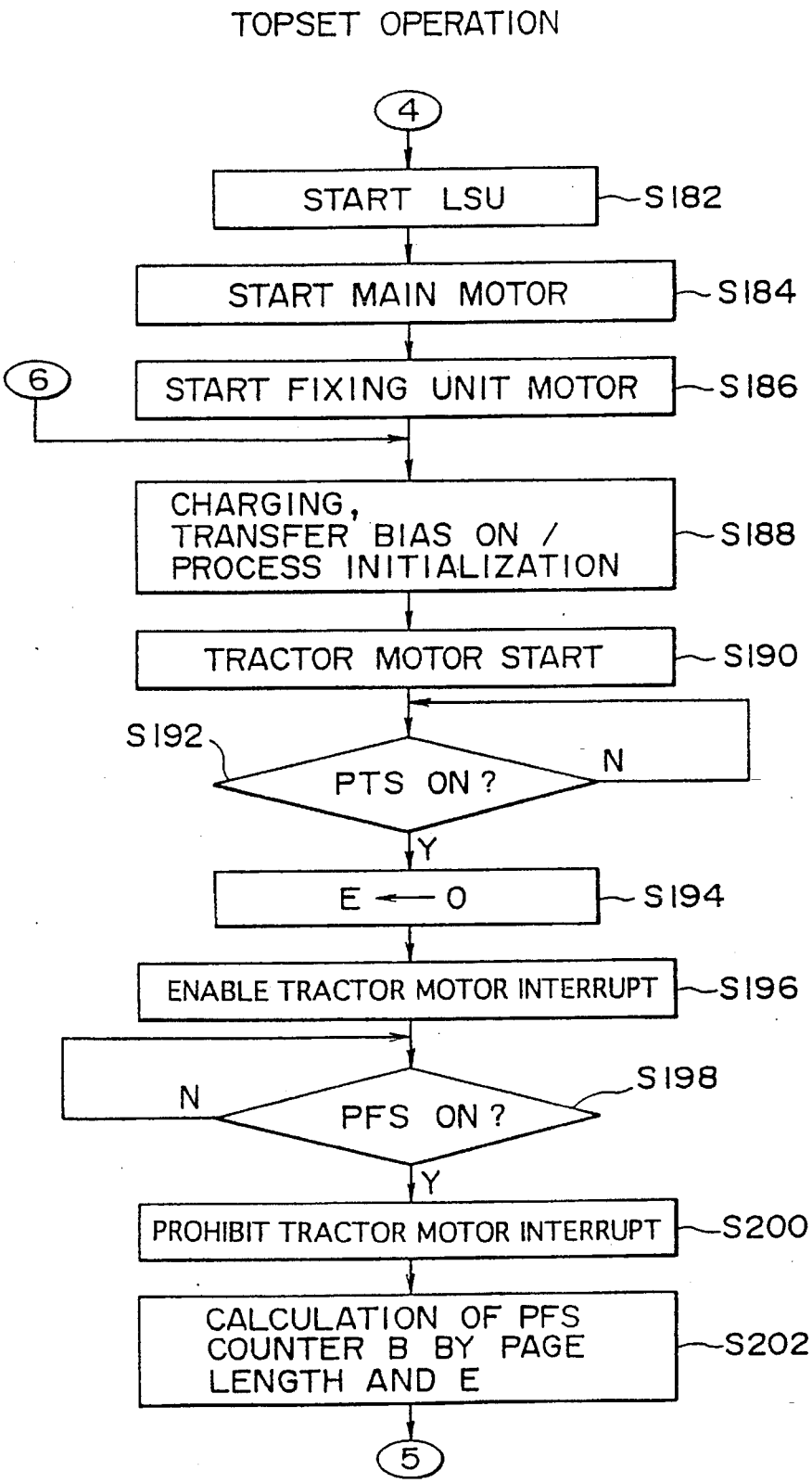
FIG. 46 is a flow chart showing a top set process of the printing process.

The top set operation, called at previously described step S106, appears in FIG. 46. The top set operation finds the perforations Pb which are upstream from and closest to the exposure starting position ESP. The top set operation is performed after the paper P is set in the printer, or following a retraction, to properly register the paper P before printing. A portion of the top set operation serves as the semi-top set operation (called at previously described step S204).

At the beginning of the top set operation, the laser scanning unit (LSU) 14 (S182), the main motor 82 driving the process unit 18 (S184), and the fixing unit motor driving the fixing unit 22 (S186) are started, and a bias voltage is applied to the charging unit 40 and the developing unit 42 (step S188). The semi-top operation skips three steps only (i.e., S182, S184, S186) as the elements started in the three skipped steps have already been activated, and is otherwise identical to the top set operation. The process unit 18 is then initialized (S188), and the tractor motor 84 is rotated to transport the paper P (S190).

Figure 48:
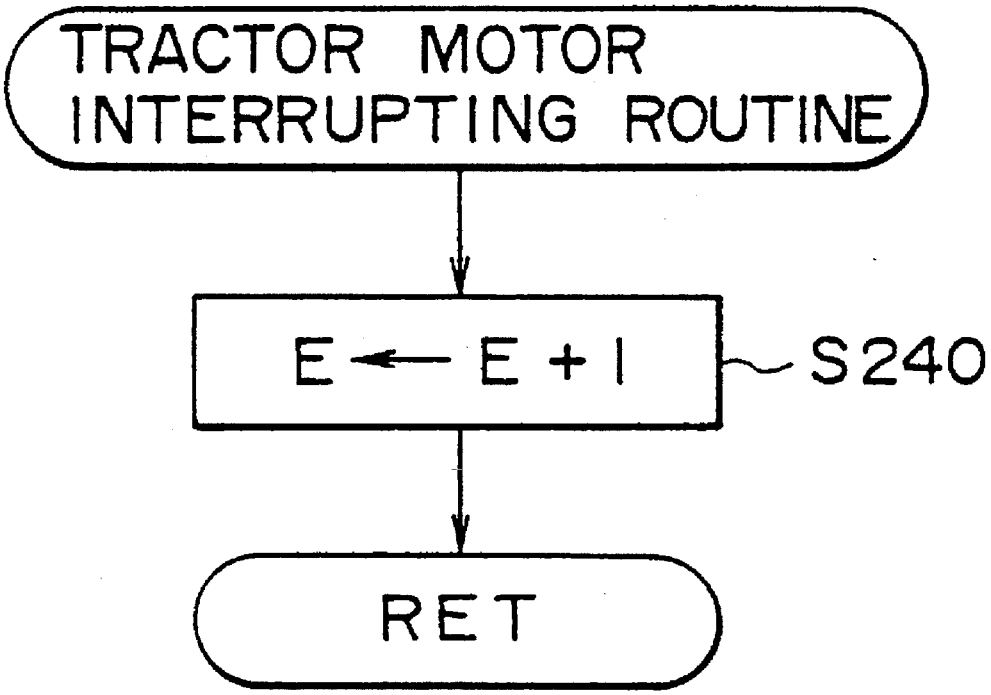
FIG. 48 is a flow chart showing a tractor motor phase pulse count interrupt process.

The controller then loops until the paper top sensor 126 turns ON (S192), and then sets a phase pulse counter E to zero. As shown in FIG. 48, the counter E is incremented by 1 for every phase pulse of the tractor motor 84 (S240) only when the tractor motor phase pulse interrupt of FIG. 48 is enabled. The phase pulses are sent to the controller 24 by a motor monitor circuit (not shown).

The tractor motor phase pulse interrupt is then enabled (S196). As the tractor motor 84 rotates, for every phase pulse of the tractor motor 84, the interrupt of FIG. 48 is activated. The controller then loops until the next PFS output pulse is sent to the controller 24 from the PFS selector 124 (S198). At this point, the tractor motor phase pulse interrupt is prohibited (S200). The controller 24 then sets PFS counter B to a value, representative of the interval from the exposure start position ESP to the closest upstream perforations Pb, based on the phase pulse counter E value, the feeding interval (corresponding to the selected PFS), and the paper length as set (S202), according to a "closest upstream perforations" calculation hereinafter described.

The "closest upstream perforations" calculation uses known design parameters of the paper top sensor 126 in addition to the counter E value, the feeding interval (corresponding to the selected PFS), and the paper length as set. For paper feed as measured by the ⅙ PFS sensor 120, the design position for detection by the paper top sensor 126 is defined as $X_6$. For paper feed as measured by the ⅛ PFS sensor 122, the design position for detection by the paper top sensor 126 is defined as $X_8$. However, the paper top sensor 126 output has tolerance limits because of mounting variations, deformation of the paper P, or cutting error of the perforations Pb. The upstream tolerance is defined as $Y_U$ and the downstream tolerance is defined as $Y_D$. If the page length * n (where n is related to a number of pages between and ESP and the paper top sensor 126) is equal to L3 (the distance from the paper top sensor 126 to the exposure start position ESP), then the perforations Pb, defining the front of the page to be printed, are precisely positioned when the PTS signal from the paper top sensor 126 is generated.

When the feeding interval (corresponding to the selected PFS) is ½ inches, the perforations Pb are necessarily midway between two feed holes Pa, and the PTS signal from the paper top sensor 126 will always be output before the next ½" PFS output. The ½ inch feeding interval is therefore easily accounted for. However, the feeding interval (corresponding to the selected PFS) may also be ⅙ or ⅛ inch. In this case, the relationship of the timing of outputs of the paper top sensor 126 and the PFS output is not constant for successive pages. Thus, the PFS counter E is set to count the phase pulses of the tractor motor 84 after the paper top sensor 126 is activated and before the next PFS pulse is generated, so that the timing relationship between the two sensor outputs can be determined.

If the output from the ⅙" PFS sensor 120 is used by the controller 24, and if the phase pulse counter E value is determined to be less than 8 at step S202, the true paper top sensor 126 signal output position is determined to be in the range from the upstream tolerance $Y_U$ to the design position $X_6$. If the phase pulse counter E value is more than 7, the true paper top sensor 126 signal output position is determined to be in the range from the downstream tolerance $Y_D$ to the design position $X_6$. That is, when the paper top sensor 126 signal is output upstream of the design position, the ⅙" PFS sensor 120 counts one more pulse than if the signal is output downstream.

If the output from the ⅛" PFS sensor 122 is used by the controller 24, and if the phase pulse counter E value is determined to be less than 21 at step S202, the true paper top sensor 126 signal output position is determined to be in the range from the upstream tolerance $Y_U$ to the design position $X_8$. If the phase pulse counter E value is more than 20, the true paper top sensor 126 signal output position is determined to be in the range from the downstream tolerance $Y_D$ to the design position $X_8$. That is, when the paper top sensor 126 signal is output upstream of the design position, the ⅛" PFS sensor 122 counts one more pulse than if the signal is output downstream.

Thus, if a paper top sensor 126 signal is detected between the upstream tolerance $Y_U$ and $X_6$ or $X_8$, the PFS counter B is set according to:

$$B \leftarrow (\text{page length} * n - L3 + L2) + m \quad (10)$$

where n is related to a no. of pages between and ESP and PTS and m is as previously described.

If a paper top sensor 126 signal is detected between the downstream tolerance $Y_D$ and $X_6$ or $X_8$, the PFS counter B is set according to:

$$B \leftarrow (\text{page length} * n - L3 + L2) \div m - 1 \quad (11)$$

where n and m are as previously described.

L2 is added in the calculations because the exposure of a latent image (S138) starts with the PFS counter B set at B1 (L2÷m, S132) after step S202. The top set operation is then complete at step S202. When the paper top sensor 126 is OFF in step S120, the tractor motor 84 is stopped at step S204 before the semi-top operation is started at step S188.

As described, the controller 24 can determine the exact position of the perforations Pb along the paper path 68 at various feeding intervals (corresponding to the selected PFS), as set in the controller to ⅙", ⅛", or ½".

The PFS interrupt routine, enabled in steps S116 and S134, appears in FIG. 47. The PFS interrupt routine checks and conditionally decrements PFS counters A, B, C and D in order (S212 through 224). When the PFS interrupt routine is performed, the PFS counter A is checked to see if it is zero (S212), and the counter A is only decremented by 1 if it is not zero (S214). Similarly, counters B and D are checked (S216, S222), and only decremented by 1 if they are not zero (S218, S224). However, when PFS counter C is checked, if it is not zero (S220), the controller 24 executes steps S226 through S234 of the PFS interrupt routine.

In step S226, the PFS counter C is decremented by 1, and the controller 24 then checks (S228) if the counter C has reached the value C1 (determined in equation (5) as described previously). If the PFS counter C equals C1, indicating that the perforations Pb of the next page are at the transfer position TP, a bias voltage is applied to the corona charger 46 and the transfer unit 44 is moved into its operating position (S230). The PFS counter C is again checked to see if it is zero (S232), and if the counter C is zero, the pressure roller 130 is moved to abut the heat roller 128 for a fixing operation (S234), and the speed control operation of the fixing unit motor 86 is started (S235). The controller then proceeds to steps S222 and S224, and returns back to the main routine. If the counter C has not reached zero at step S232, the routine proceeds directly to step S222.

H. Fixing Unit Speed Control Process

Figure 49:
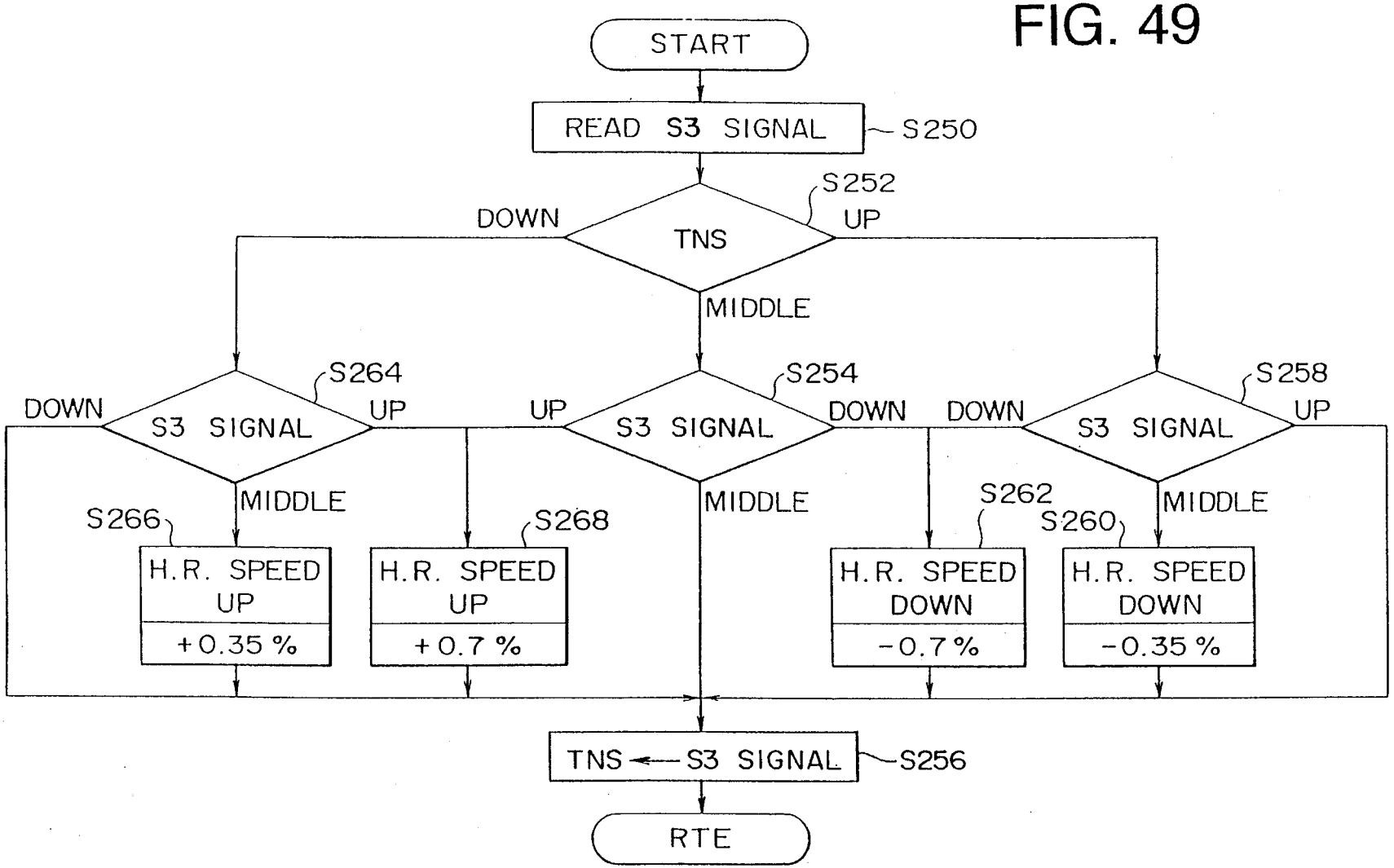
FIG. 49 is a flow chart showing a speed control process.

The speed control process, called by the top set operation in step S235, appears in FIG. 49. The speed control process sets the speed at which the paper P is advanced by the heat roller 128 slightly faster than the tractor unit 74 paper advance speed, resulting in a predetermined paper tension between the tractor unit 74 and the heat roller 128 along the paper path. The paper tension is detected by means of the tension plate 228, and is used for speed control of the fixing unit motor 86. The paper tension may vary from the target value depending on the thickness of the paper P (e.g., label paper), wear of the heat roller 128, slipping between the heat roller 128 and the paper P, and thermal expansion of the heat roller 128, resulting in an unstable fixing operation. The speed control process ensures a constant paper tension and therefore a stable fixing operation.

After step S235 of FIG. 47, when the speed control process is called, the process starts at step S250 of FIG. 49. In step S250, an S3 signal from the paper tension sensor 76 is read by the controller 24. The S3 signal can be an UP, MID, or DOWN value depending on the paper tension as previously described. The controller then checks the previously read tension signal S3 value stored in the TNS tension variable (S252), and branches to DOWN, MID, and UP correction checks at S264, S254, and S258, respectively, depending on the TNS value. When the speed control routine is called for the first time, the TNS value has been initialized at MID at step S24 of the main routine, and is thereafter the S3 value recorded in the previous pass through the speed control routine.

If the last pass tension variable TNS is MID in step S252, and the current signal S3 is also MID in step S254, then the motor 86 and heat roller 128 are judged to be rotating at an optimum speed, and no speed change is necessary. In this case, the controller 24 stores the current tension signal S3 in the last pass variable TNS (S256) before exiting the speed control subroutine.

If the last pass tension variable TNS is MID in step S252, and the current signal S3 is then DOWN in step S254, the difference in speeds between the heat roller 128 advance and the tractor unit 74 advance is judged to have increased, and the speed of the fixing unit motor is accordingly reduced by 0.7% (S262). The controller 24 then stores the current tension signal S3 in the last pass variable TNS (S256) before exiting the speed control subroutine.

If the last pass tension variable TNS is MID in step S252, and the current signal S3 is then UP in step S254, the difference in speeds between the heat roller 128 advance and the tractor unit 74 advance is judged to have decreased, and the speed of the fixing unit motor is according increased by 0.7% (S268). The controller 24 then stores the current tension signal S3 in the last pass variable TNS (S256) before exiting the speed control subroutine.

If the last pass tension variable TNS is UP in step S252, and the current signal S3 is then DOWN in step S258, the difference in speeds between the heat roller 128 advance and the tractor unit 74 advance is judged to have increased rapidly, and the speed of the fixing unit motor is accordingly decreased by 0.7% (S262). The controller 24 then stores the current tension signal S3 in the last pass variable TNS (S256) before exiting the speed control subroutine.

If the last pass tension variable TNS is UP in step S252, and the current signal S3 is then MIDDLE in step S258, the difference in speeds between the heat roller 128 advance and the tractor unit 74 advance is judged to have increased slightly, and the speed of the fixing unit motor is accordingly reduced by 0.35% (S260). The controller 24 then stores the current tension signal S3 in the last pass variable TNS (S256) before exiting the speed control subroutine.

If the last pass tension variable TNS is UP in step S252, and the current signal S3 is then UP in step S258, the difference in speeds between the heat roller 128 advance and the tractor unit 74 advance is judged to have remained constant, and the speed of the fixing unit motor is accordingly left unchanged. The controller 24 then stores the current tension signal S3 in the last pass variable TNS (S256) before exiting the speed control subroutine.

If the last pass tension variable TNS is DOWN in step S252, and the current signal S3 is then UP in step S264, the difference in speeds between the heat roller 128 advance and the tractor unit 74 advance is judged to have decreased rapidly, and the speed of the fixing unit motor is accordingly increased by 0.7% (S266). The controller 24 then stores the current tension signal S3 in the last pass variable TNS (S256) before exiting the speed control subroutine.

If the last pass tension variable TNS is DOWN in step S252, and the current signal S3 is then MIDDLE in step S264, the difference in speeds between the heat roller 128 advance and the tractor unit 74 advance is judged to have decreased slightly, and the speed of the fixing unit motor is accordingly increased by 0.35% (S266). The controller 24 then stores the current tension signal S3 in the last pass variable TNS (S256) before exiting the speed control subroutine.

If the last pass tension variable TNS is DOWN in step S252, and the current signal S3 is then DOWN in step S258, the difference in speeds between the heat roller 128 advance and the tractor unit 74 advance is judged to have remained constant, and the speed of the fixing unit motor is accordingly left unchanged. The controller 24 then stores the current tension signal S3 in the last pass variable TNS (S256) before exiting the speed control subroutine.

Thus, according to the description, the speed control process is able to compensate for variations in the difference in speeds between the heat roller 128 advance and the tractor unit 74 advance, and thereby keep a constant paper tension between the fixing unit 22 and the tractor unit 74, ensuring a stable fixing process.

I. Fixing Unit Control Process

A control process for controlling the fixing unit 22 is shown in FIGS. 51 to 53 and 57 to 59. In the following description, the paper size is set to 11 inches and the feeding interval (corresponding to the selected PFS) is set to ½ inch for illustration purposes only. The fixing unit 22 can also be controlled according to other settings of paper size and feeding interval (corresponding to the selected PFS). In this example, integer numbers given for target values for the PFS counter F are representative of the target values for 11 inch paper, and the target values are different for different paper lengths.

Figure 55:
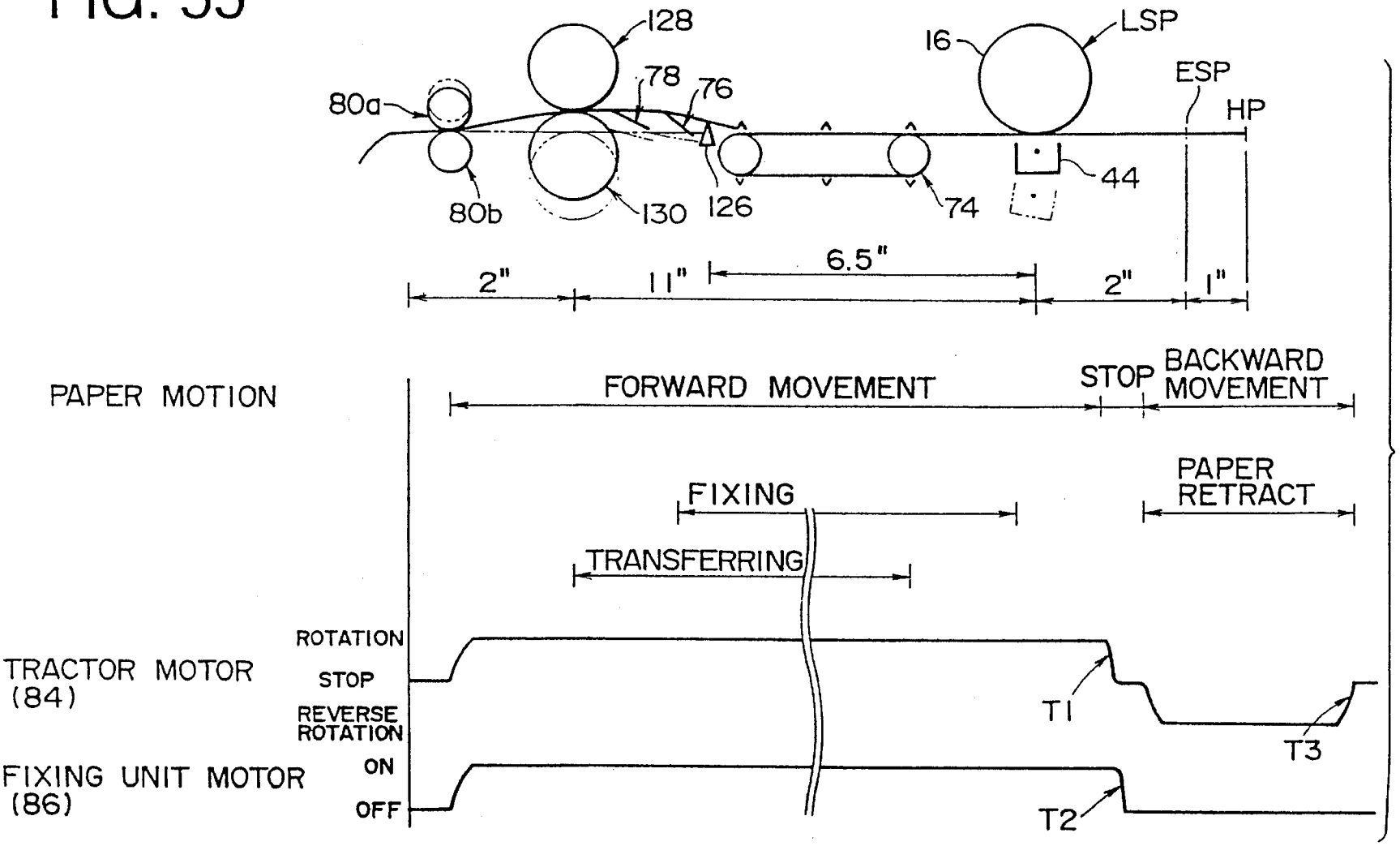
FIG. 55 is schematic showing dimensions and timing for the fixing unit control process.
Figure 56:
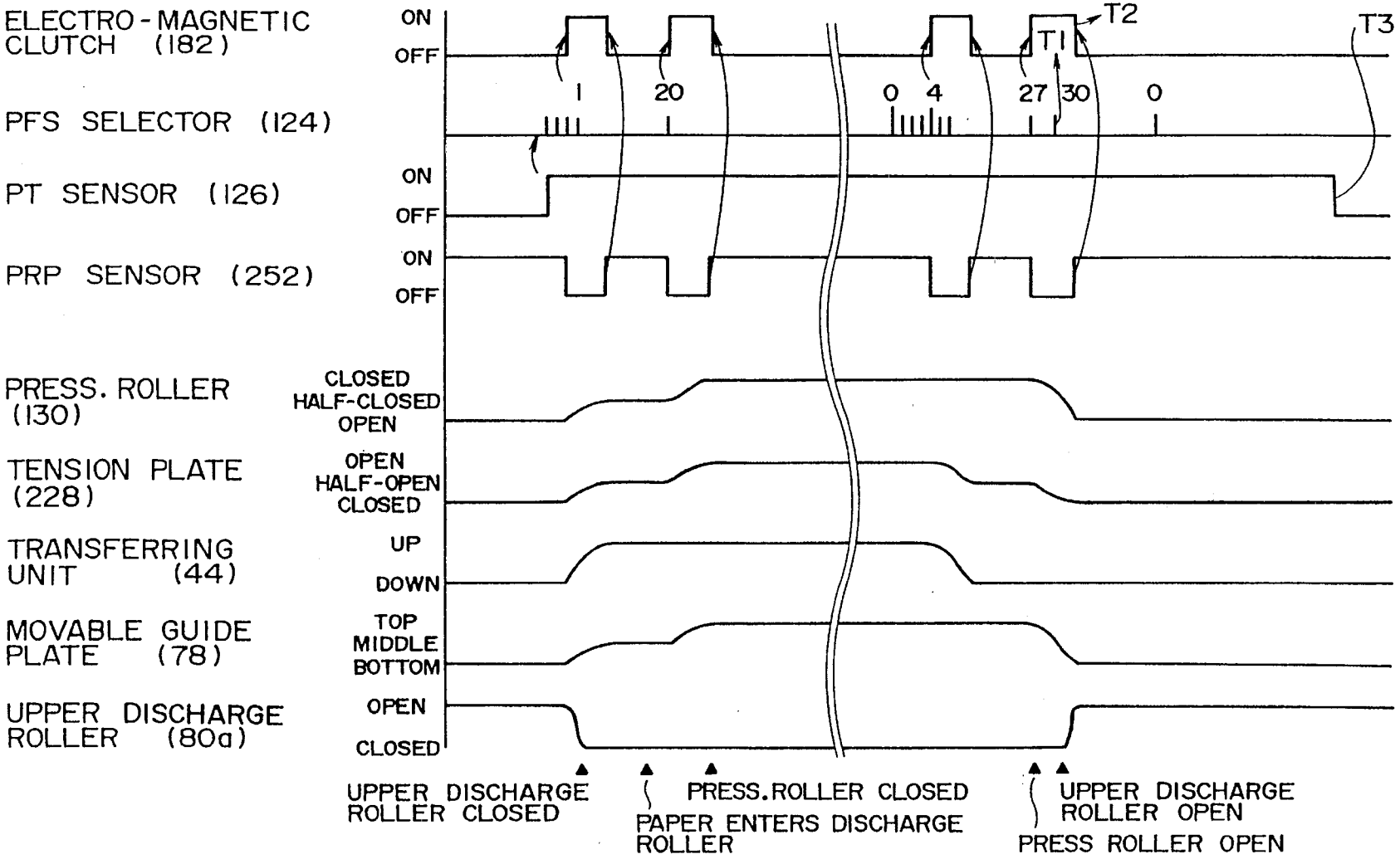
FIG. 56 is a timing diagram showing timing for the fixing unit control process.
Figure 57:
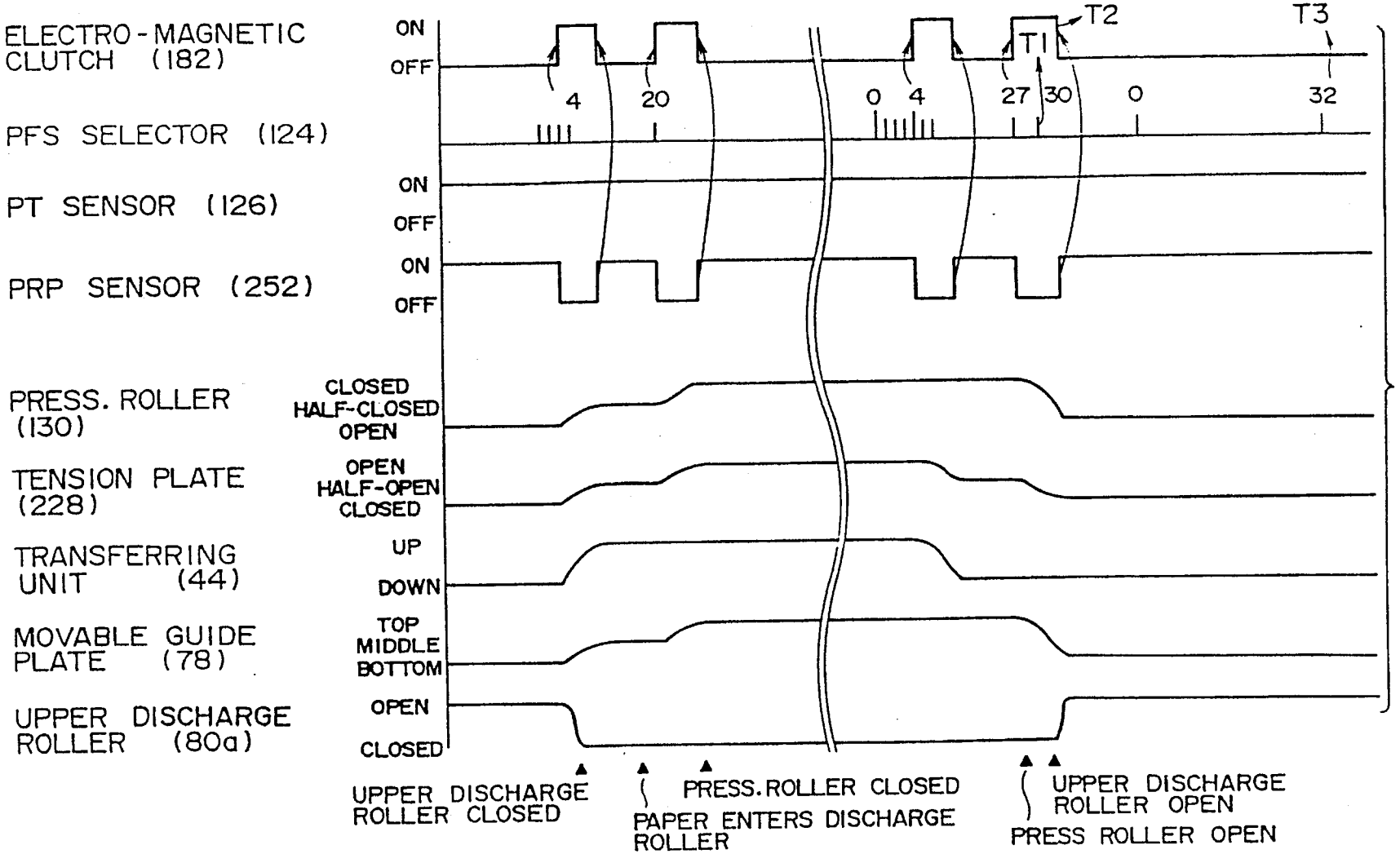
FIG. 57 is a timing diagram showing timing for the fixing unit control process after a top set operation.

FIGS. 55, 56 and 57 show the timing charts for the sensors and relevant operating members in the printer 10. Each chart is made up of several plots, and each plot shows either the timing for positions of described mechanical pats, or for described signals of electrical components, with reference to a horizontal time axis having significant events denoted at the bottom of each chart. The timing chart of FIG. 55 also shows paper motion. For illustration purposes, the following intervals, shown in a reference schematic at the top of FIG. 55, are used: the interval L1 between the home position HP and the exposure start position ESP is set to 1 inch; the interval L2 between the exposure starting position ESP and the transfer position TP is set to 2 inches; the interval (L3–L2) between the transfer position TP and the paper top sensor 126 position PTS is set to 6.5 inches; the interval (L4–L2) between the transfer position TP and the fixing position FP is set to 11 inches; and the interval (L5–L4) between the fixing position FP and the STOP position is set to 2 inches. FIG 56 shows timing for the case where the paper top set operation has not been completed when printing is started, and FIG. 57 shows timing for the case where the paper top set operation has been completed when printing is started and only the semi-top operation is required.

Figure 50:
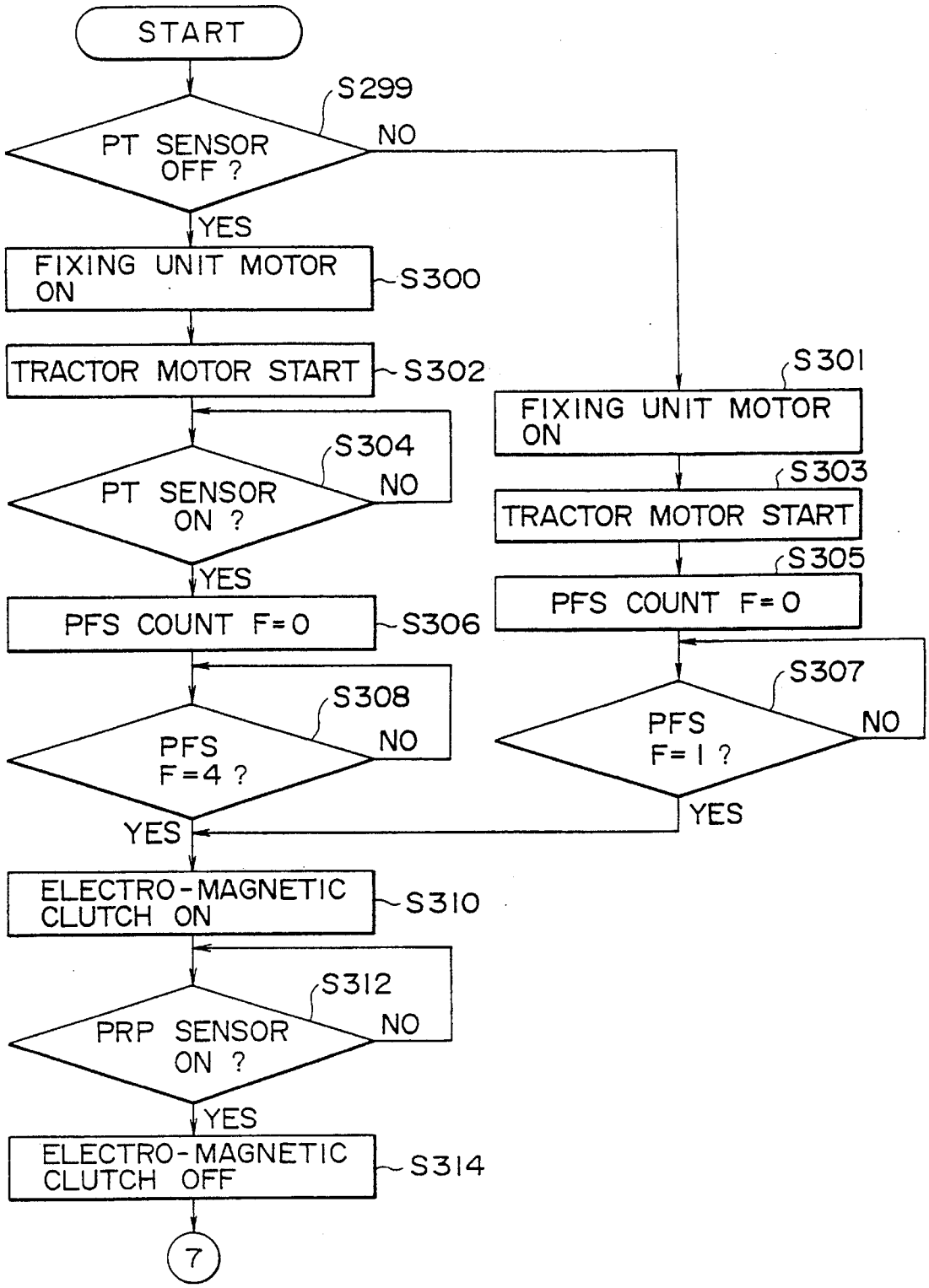
FIG. 50 is a flow chart showing a first part of a fixing unit control process.
Figure 51:
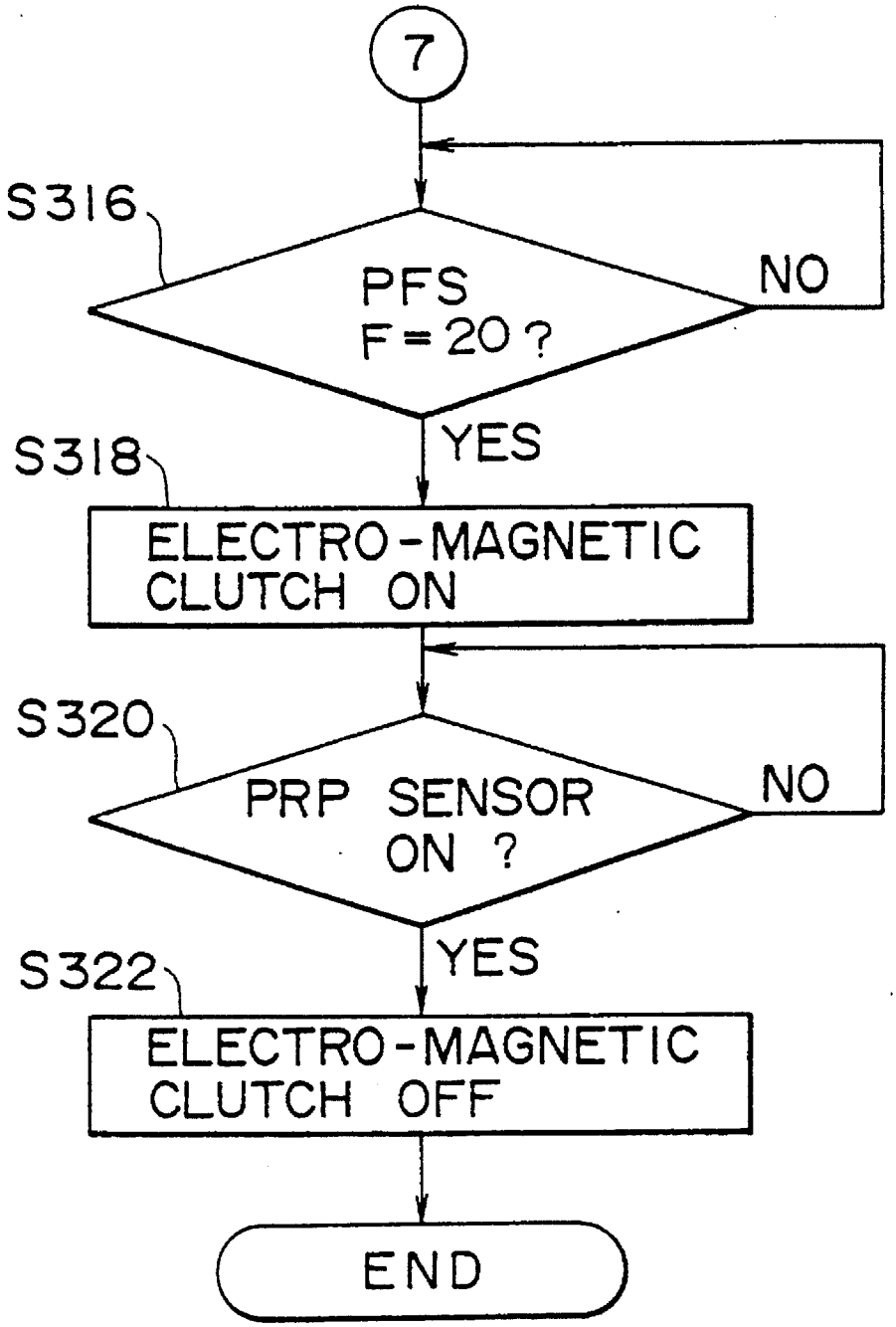
FIG. 51 is a flow chart showing a second part of the fixing unit control process.

When printing is started, a PFS counter F is incremented by an interrupt (not shown) that increments the PFS counter F by 1 for every PFS pulse sent from the PFS selector 124 to the controller 24. As shown in FIGS. 50 and 51, the controller checks the paper top sensor 126 (S299). If the paper top sensor 126 is ON (shown by the timing in FIG. 57), indicating that the top set operation has been completed and that the next printing operation may start from the page following the last printed page, the fixing unit motor 86 and tractor motor 84 are driven (S301, S303), and the PFS counter F is set to zero (S305). The controller 24 then waits until the PFS counter F reaches 1 (S307) before returning to the main fixing unit control process at step S310.

If the paper top sensor is OFF in step S299, indicating that the top set operation has not been completed (following the timing of FIG. 56), then the fixing unit motor 86 is turned ON (S300) and the tractor motor 84 is driven (S302) to transport the paper P in the direction A. The controller 24 then waits until the paper top sensor 126 is ON (S304), indicating that the perforations Pb defining the front of the page to be printed are upstream of the home position HP, and then zeroes the PFS counter F (S306).

The controller 24 then waits until the PFS counter F reaches 4 (S308) before proceeding to steps for applying the transfer charger and pressure roller (S310 through S314). A PFS count of 4 is sufficient for the transfer unit to reach its operating position before the perforations Pb defining the front of the page to be printed reach the transfer position TP.

In steps 310 through 314, the electromagnetic clutch is activated (S310) turning the cam shaft 166. The rotation of the cam shaft 166 moves the transfer unit 44 to its operating position and moves the pressure roller 130 halfway towards the heat roller 128, and allows the paper P to be transported by the discharge rollers 80 and 81. The rotation of the cam shaft 166 is stopped by deactivating the electromagnetic clutch 182 (S314) after the pressure roller position (PRP) sensor PRP detects (S312) the first interruptor member 2531.

The controller then waits until the PFS counter F reaches 20 (S316). The PFS count of 20 is sufficient for the pressure roller 130 to contact the heat roller 128 before the perforations defining the front of the page to be printed reach the fixing position FP. The electromagnetic clutch 182 is then activated (S318), and the cam shaft 166 again rotates. The rotation of the cam shaft 166 moves the pressure roller 130 to contact the heat roller 128, and is stopped by deactivating the electromagnetic clutch 182 (S322) after the pressure roller position (PRP) sensor 252 detects (S320) the second interruptor member 2532. At this point, the printer 10 is ready to print.

Figure 52:
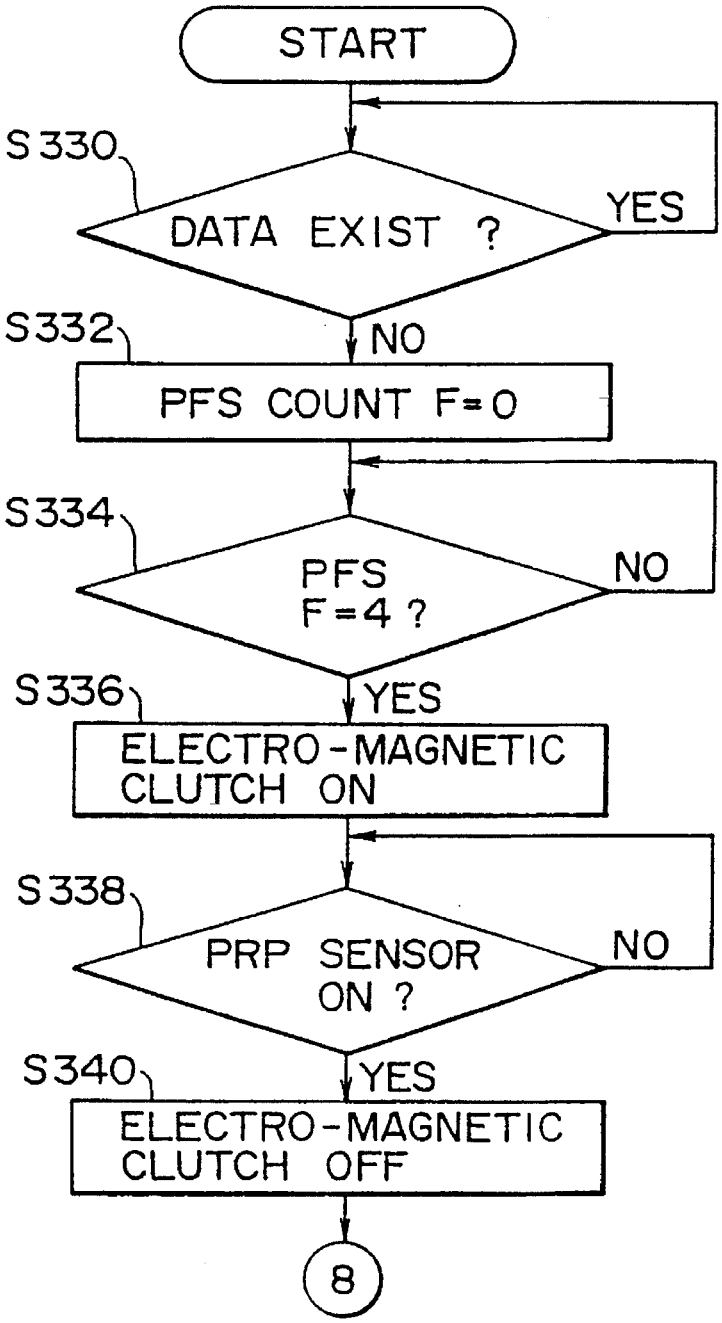
FIG. 52 is a flow chart showing a first part of a second fixing unit control process.
Figure 53:
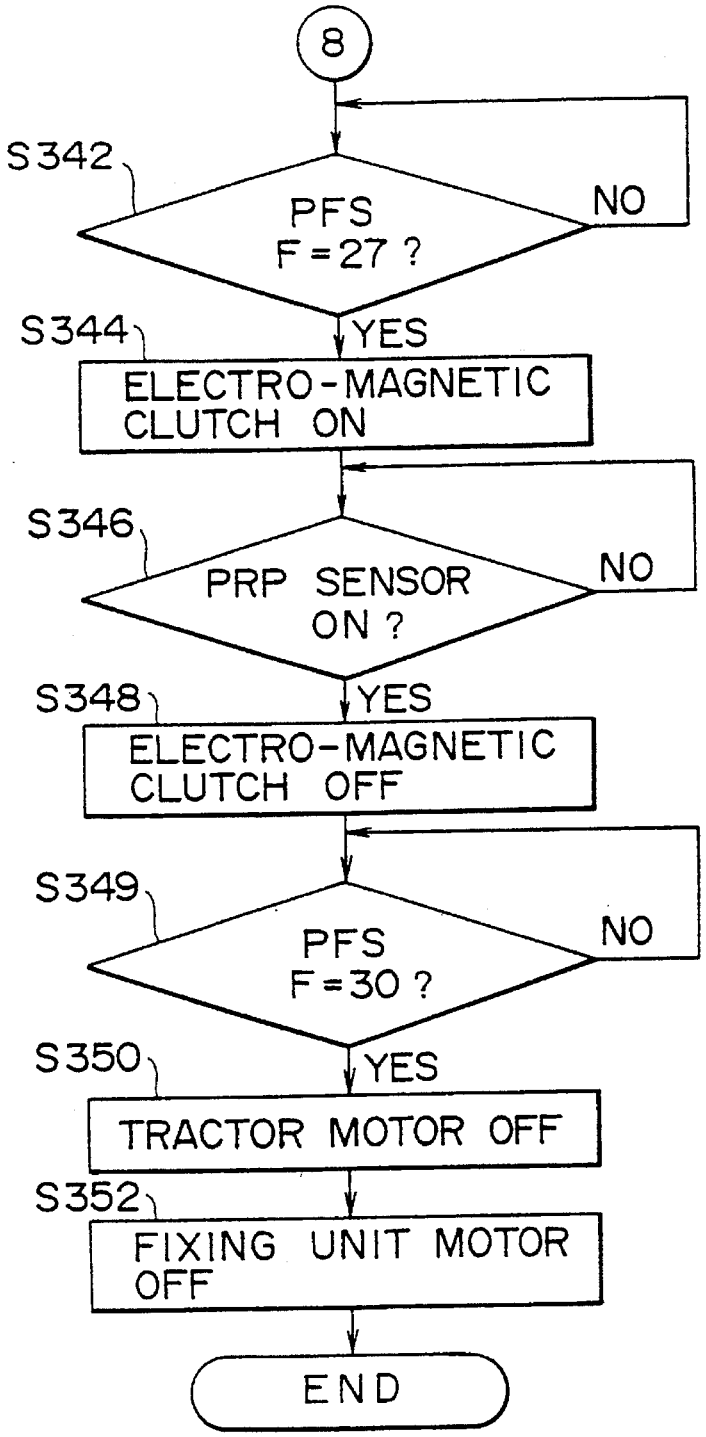
FIG. 53 is a flow chart showing a second part of the second fixing unit control process.

The control of the fixing unit 22 when printing is to be stopped is shown in FIGS. 52 and 53. When printing data is no longer received (S330), indicating that the perforations Pb defining the front of the next page to be printed have passed the exposure starting position ESP, the PFS counter F is zeroed (S332). When the PFS counter reaches 4 (S334), indicating that the perforations Pb defining the front of the next page to be printed have moved from the exposure start position ESP to the transfer position TP, the electromagnetic clutch is activated (S336), rotating the cam shaft 166. The rotation of the cam shaft 166 retracts the transfer unit 44 to the retracted position, and is stopped by deactivating the electromagnetic clutch 182 (S340) after the pressure roller position (PRP) sensor 252 detects (S338) the third interruptor member 2533.

The controller then waits until the PFS counter F reaches 27 (S342). The PFS count of 27 is sufficient for the pressure roller 130 to separate from the heat roller 128 before the perforations defining the front of the page to be printed reach the fixing position FP. The electromagnetic clutch 182 is then activated (S344), and the cam shaft 166 again rotates. The rotation of the cam shaft 166 moves the pressure roller 130 away from the heat roller 128, and is stopped by deactivating the electromagnetic clutch 182 (S348) after the pressure roller position (PRP) sensor 252 detects (S346) the fourth interruptor member 2534.

As the pressure roller 130 moves downward and away from the heat roller 128 as shown in FIG. 31, the paper P is separated from the heat roller 128, but is still transported by the discharge rollers 80 and 81. The controller 24 then waits until the PFS counter F reaches 30 (S349). The PFS count of 30 is sufficient for the rear end of the last page printed to reach the STOP position outside the printer 10 body. The controller then stops the tractor motor 86 (S350, time T1 in FIGS. 57 and 58) and stops the fixing unit motor 84 (S352, time T2 in FIGS. 56 and 57). At this point, printing is completed. The electromagnetic clutch 182 is thereafter deactivated according to the PRP sensor 252 and the fourth interruptor member 2534 (steps not shown).

Figure 54:
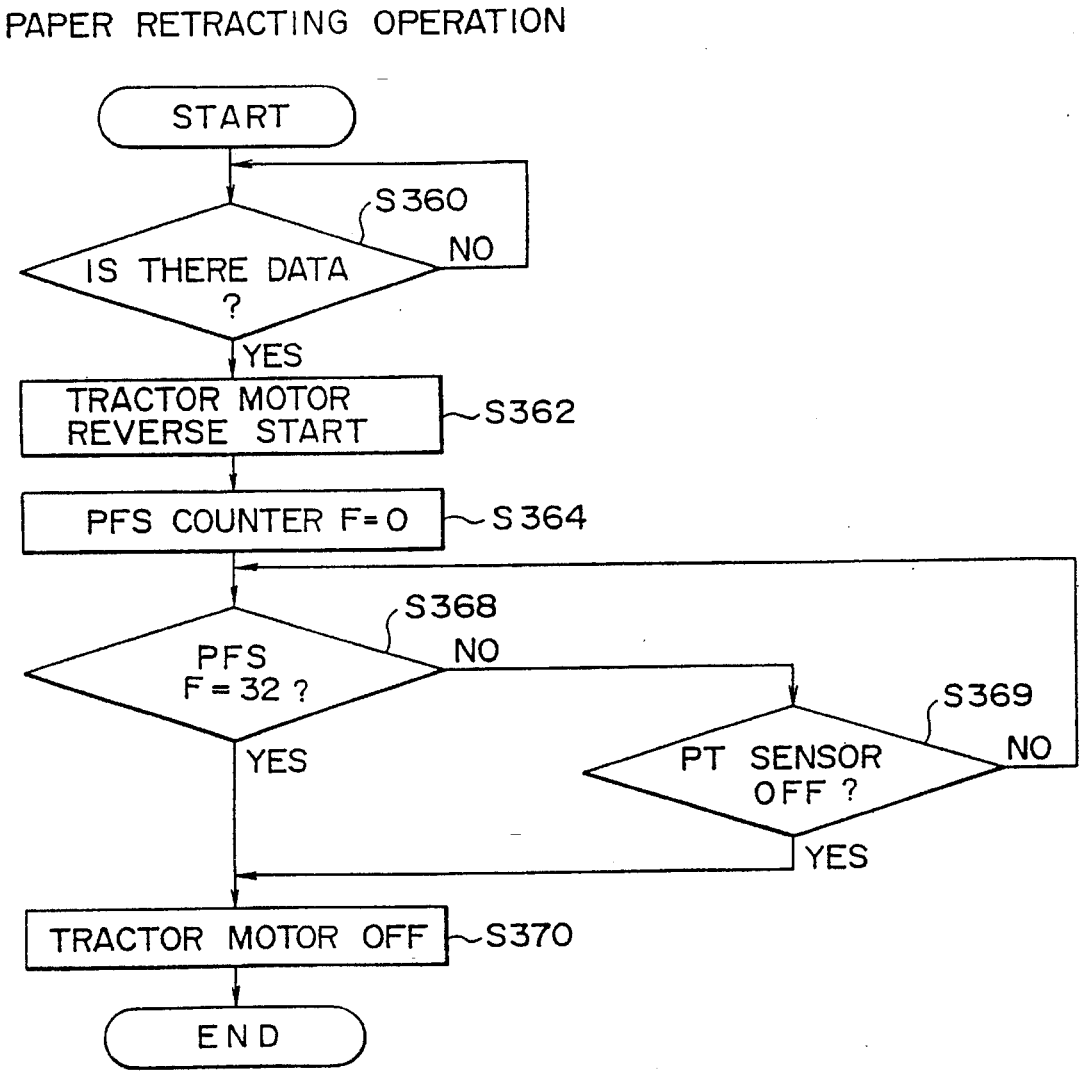
FIG. 54 is a flow chart showing a paper retracting process.

A paper retracting operation of the printer 10 is shown in FIG. 54. When the paper P is to be retracted, the controller first checks if print data is available (S360). If there is print data, the tractor motor 84 is rotated in reverse (S362), retracting the paper P. The PFS counter F is zeroed (S364), and the controller 24 then waits until the PFS counter reaches 32 (S368), indicating that the paper P has been retracted such that the perforations Pb defining the front end of the next page to be printed are at the home position HP, and the tractor motor is stopped (S370). However, if the paper top sensor 126 turns OFF while the PFS counter is counting towards 32 (S369), indicating that the last printed page has been separated, then the tractor motor 84 is immediately stopped. In this manner, the idle page generated by beginning a printing sequence is always only one page, saving blank idle pages and therefore paper.

Thus, if the paper P adheres to the surface of the heat roller 128 because of melted toner, the downward movement of the pressure roller 130 and the paper transport by the discharge rollers 80 and 81 strip the paper from the surface of the heat roller 128, avoiding scorching of the paper and adherence of the paper to the heat roller 128.

The present disclosure relates to subject matter contained in Japanese Patent Application No. HEI 05-307247, filed on Nov. 13, 1993, which is expressly incorporated herein by reference in its entirety.

What is claimed is:

1. An electrophotographic printer using continuous form paper, said printer comprising:

at least one tractor for feeding the paper along a paper path of said printer;

driving means for driving a heat roller;

said heat roller rotatably mounted and being downstream along said paper path from said at least one tractor;

a pressure roller, freely rotatably mounted and placed adjacent to said heat roller, said pressure roller movable between a contact position in contact with said heat roller and a retracted position remote from said heat roller, said pressure roller being downstream along said paper path from said at least one tractor, and said paper path passing between said heat roller and said pressure roller;

shifting means for moving said pressure roller between said contact position and said retracted position; and a pair of discharge rollers provided downstream along said paper path from said pressure roller, said discharge rollers able to feed the paper, at least one of said discharge rollers driven by said driving means, wherein said paper path is substantially straight between said at least one tractor and said discharge rollers when said pressure roller is in said retracted position, and wherein a bend is formed in said paper path when said pressure roller is in said contact position, and a region of contact between said pressure roller and said heat roller is positioned between said bend and said discharge rollers when said pressure roller is in said contact position.

2. The electrophotographic printer according to claim 1, comprising:

a controller for controlling said discharge rollers to feed the paper when said pressure roller is between said contact position and said retracted position.

3. The electrophotographic printer according to claim 1, wherein at least one of said discharge rollers is movable away from said paper path.

4. The electrophotographic printer according to claim 1, further comprising a guide means, movable in synchronization with said movement of said pressure roller, and wherein said guide means is moved into said paper path, and said bend in said paper path is formed at said guide means, when said pressure roller is in said contact position.

5. The electrophotographic printer according to claim 4, wherein said guide means is removed from said paper path when said pressure roller is in said retracted position, so that said paper path becomes straight between said tractor and said discharge rollers.

6. The electrophotographic printer according to claim 4, wherein:

said paper path is straight between said guide means and said discharge rollers;

an axis formed by the axes of said discharge rollers is perpendicular to said paper path; and an axis formed by the axes of said pressure roller and said heat roller is perpendicular to said paper path when said pressure roller is in said contact position and said bend is formed at said guide means.

7. The electrophotographic printer according to claim 3, wherein both of said pair of discharge rollers are movable together away from said paper path.

8. The electrophotographic printer according to claim 1, further comprising:

a separating plate mounted adjacent said pressure roller for separating the paper from said pressure roller when said pressure roller is in said contact position, as the paper moves downstream of said contact position, wherein said separating plate separates the paper without bending the paper out of said paper path.

9. The electrophotographic printer according to claim 1, wherein at least one of said pair of discharge rollers is movable between a contact position in contact with the other of said pair of discharge rollers, and a retracted position remote from the other of said pair of discharge rollers.

10. The electrophotographic printer according to claim 1, further comprising:

moving means for moving at least one of said pair of discharge rollers between a contact position in contact with the other of said pair of discharge rollers, and a retracted position remote from the other of said pair of discharge rollers.

11. The electrophotographic printer according to claim 10, further comprising:

linkage means for linking said shifting means and said moving means, wherein, when said shifting means moves said pressure roller into said contact position, said linkage means effects said moving means to move said discharge rollers into said contact position.

12. The electrophotographic printer according to claim 11, wherein, when said shifting means moves said pressure roller into said retracted position, said linkage means effects said moving means to move said discharge rollers into said retracted position.

13. A printer comprising:

a paper path along which paper to be printed on is fed;

a heat roller rotatably mounted along said paper path;

a pressure roller, freely rotatably mounted and placed opposite said heat roller along said paper path, said pressure roller movable between a contact position in contact with said heat roller and a retracted position remote from said heat roller, said paper path passing between said heat roller and said pressure roller;

driving means for driving at least one of said heat roller and said pressure roller;

means for moving said pressure roller between said contact position and said retracted position; and a pair of discharge rollers provided downstream along said paper path from said pressure roller and said heat roller, said discharge rollers able to feed the paper, at least one of said discharge rollers driven by said driving means;

wherein said paper path is substantially straight from a location upstream of said heat roller and said pressure roller to said discharge rollers when said pressure roller is in said retracted position, and wherein a bend is formed in said paper path when said pressure roller is in said contact position, and a region of contact between said pressure roller and said heat roller is positioned between said bend and said discharge rollers when said pressure roller is in said contact position.

14. The printer according to claim 13, wherein at least one of said pair of discharge rollers is movable between a contact position in contact with the other of said pair of discharge rollers, and a retracted position remote from the other of said pair of discharge rollers.

15. The printer according to claim 14, wherein said means for moving said pressure roller between said contact position and said retracted position further moves said at least one of said pair of discharge rollers between said contact position and said retracted position, synchronously with said moving said pressure roller.

16. The printer according to claim 13, further comprising:

guide means, synchronously movable with said movement of said pressure roller, for forming said bend in said paper path when said pressure roller is in said contact position.

17. The printer according to claim 16, wherein said means for moving said pressure roller between said contact position and said retracted position further moves said guide means in and out of position for forming said bend.

* * * * *

UNITED STATES PATENT AND TRADEMARK OFFICE

CERTIFICATE OF CORRECTION

PATENT NO. : 5,493,377

DATED : February 20, 1996

INVENTOR(S) : T. NISHIKAWA et al.

It is certified that error appears in the above-indentified patent and that said Letters Patent is hereby corrected as shown below:

On title page, item [56], "References Cited", "U.S. PATENT DOCUMENTS", line 1, insert ---5,063,416 11/1991 Honda et al.---.

On title page, item [56], "References Cited", "U.S. PATENT DOCUMENTS", line 2, insert ---5,187,528 2/1993 Nishikawa et al.---.

Signed and Sealed this

Thirty-first Day of December, 1996

*Attest:*

*Attesting Officer*

BRUCE LEHMAN

*Commissioner of Patents and Trademarks*